US008590826B2

(12) United States Patent
Pappas et al.

(10) Patent No.: US 8,590,826 B2
(45) Date of Patent: Nov. 26, 2013

(54) ENVELOPER ASSEMBLY FOR WINDING WEBS

(75) Inventors: Michael Pappas, Denville, NJ (US); William Christman, Rockaway Township, NJ (US); Michael Yermal, Dover, NJ (US)

(73) Assignee: Catbridge Machinery, LLC, Parsippany, NJ (US)

( * ) Notice: Subject to any disclaimer, the term of this patent is extended or adjusted under 35 U.S.C. 154(b) by 429 days.

(21) Appl. No.: 12/820,249

(22) Filed: Jun. 22, 2010

(65) Prior Publication Data

US 2010/0320307 A1 Dec. 23, 2010

Related U.S. Application Data

(60) Provisional application No. 61/219,428, filed on Jun. 23, 2009.

(51) Int. Cl.
*B65H 19/22* (2006.01)

(52) U.S. Cl.
USPC ..... 242/533.4; 242/533.5

(58) Field of Classification Search
USPC ..... 242/532.2, 533.4–533.5, 559.2–559.3
See application file for complete search history.

(56) References Cited

U.S. PATENT DOCUMENTS

| | | | | |
|---|---|---|---|---|
| 2,586,833 | A | 2/1952 | Kohler et al. | |
| 2,775,410 | A | 12/1956 | Schwartz et al. | |
| 2,830,775 | A | 4/1958 | Kiesel | |
| 3,013,367 | A | 12/1961 | La Sarre | |
| 3,325,889 | A | 6/1967 | Meli et al. | |
| 3,642,221 | A * | 2/1972 | Hellemans | 242/527.4 |
| 3,697,010 | A * | 10/1972 | Nystrand | 242/527.4 |
| 3,720,381 | A | 3/1973 | Rehme et al. | |
| 3,770,542 | A | 11/1973 | Hall et al. | |
| 3,776,482 | A | 12/1973 | Mras | |
| 3,823,887 | A | 7/1974 | Gerstein | |
| 3,871,595 | A * | 3/1975 | Smolderen | 242/527.4 |
| 4,171,780 | A | 10/1979 | Bugnone | |
| 4,422,586 | A * | 12/1983 | Tetro | 242/527.3 |
| 4,667,890 | A | 5/1987 | Gietman, Jr. | |
| 4,678,133 | A * | 7/1987 | Suzuki | 242/527.3 |
| 4,770,358 | A * | 9/1988 | Suzuki et al. | 242/527.3 |

(Continued)

OTHER PUBLICATIONS

PCT International Search Report corresponding to PCT Application PCT/US2010/001798 filed Jun. 22, 2010 (8 pages).

(Continued)

*Primary Examiner* — Sang Kim
(74) *Attorney, Agent, or Firm* — Wolff & Samson, PC

(57) ABSTRACT

In a winding assembly for winding web rolls, an enveloper assembly is used to initiate winding of a web stream onto a pre-formed core or to initiate winding of a core-forming substrate into an in-line core. The enveloper assembly comprises a first support arm operatively coupled to a second support arm; a third support arm operatively coupled to the second support arm; and an enveloper roller operatively coupled to the third support arm. The enveloper roller is movable along a cylindrical surface from a first position to a second position. The enveloper assembly accommodates a wide range of core diameters. For winding non-adhesive web streams, a tail tucker can be used in conjunction with the enveloper assembly to initiate winding. In conjunction with apparatus for inserting core-forming substrates or adhesive tabs onto a web, the winding assembly can perform high-volume, streaming production of wound web rolls.

8 Claims, 70 Drawing Sheets

VIEW B

(56) References Cited

U.S. PATENT DOCUMENTS

| | | | | |
|---|---|---|---|---|
| 4,790,491 | A | 12/1988 | Mundus et al. | |
| 4,807,825 | A | 2/1989 | Elsner et al. | |
| 5,305,963 | A | 4/1994 | Harvey, III et al. | |
| 5,344,091 | A | 9/1994 | Molison | |
| 5,385,317 | A | 1/1995 | Yamamoto et al. | |
| 5,387,284 | A | 2/1995 | Moody | |
| 5,402,960 | A | 4/1995 | Oliver et al. | |
| 5,453,070 | A | 9/1995 | Moody | |
| 5,505,402 | A | 4/1996 | Vigneau | |
| 5,518,200 | A | 5/1996 | Kaji et al. | |
| 5,538,199 | A | 7/1996 | Biagiotti | |
| 5,660,349 | A | 8/1997 | Miller et al. | |
| 5,690,296 | A | 11/1997 | Biagiotti | |
| 5,730,387 | A | 3/1998 | Yamazaki | |
| 5,746,379 | A | 5/1998 | Shimizu | |
| 5,895,008 | A | 4/1999 | Sanders | |
| 6,036,139 | A | 3/2000 | Ogg | |
| 6,159,564 | A | 12/2000 | Korhonen | |
| 6,273,356 | B1 * | 8/2001 | Burton | 242/527.3 |
| 6,276,624 | B1 | 8/2001 | Endo et al. | |
| 6,425,547 | B1 | 7/2002 | Singh | |
| 6,595,458 | B1 | 7/2003 | Biagiotti | |
| 6,866,213 | B2 | 3/2005 | Lake et al. | |
| 2004/0007642 | A1 | 1/2004 | Kashima | |

OTHER PUBLICATIONS

PCT Written Opinion of the International Searching Authority corresponding to PCT Application PCT/US2010/001798 filed Jun. 22, 2010 (10 pages).

* cited by examiner

VIEW B

VIEW B

VIEW B

VIEW B

VIEW B

VIEW B FIG. 5A
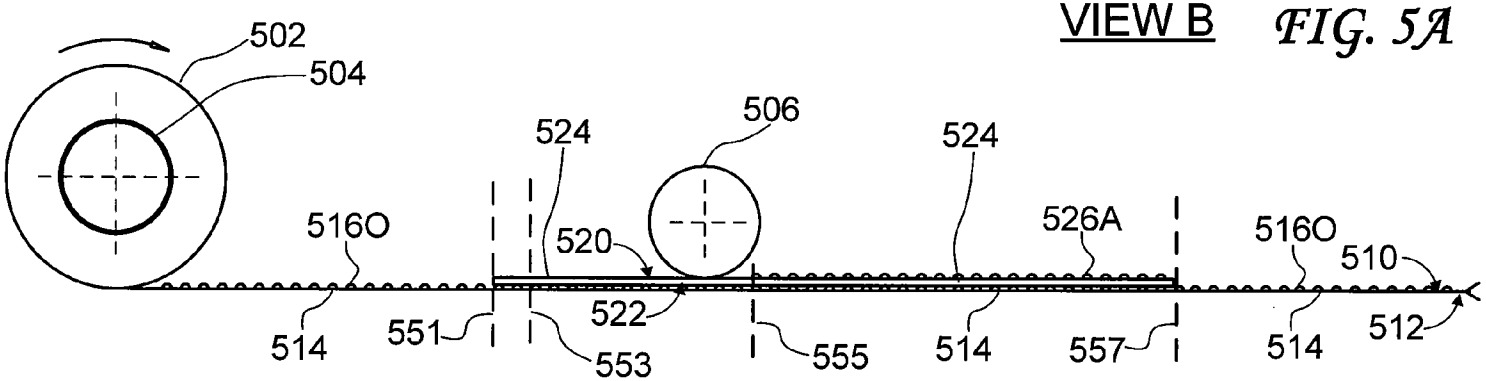
VIEW B FIG. 5B
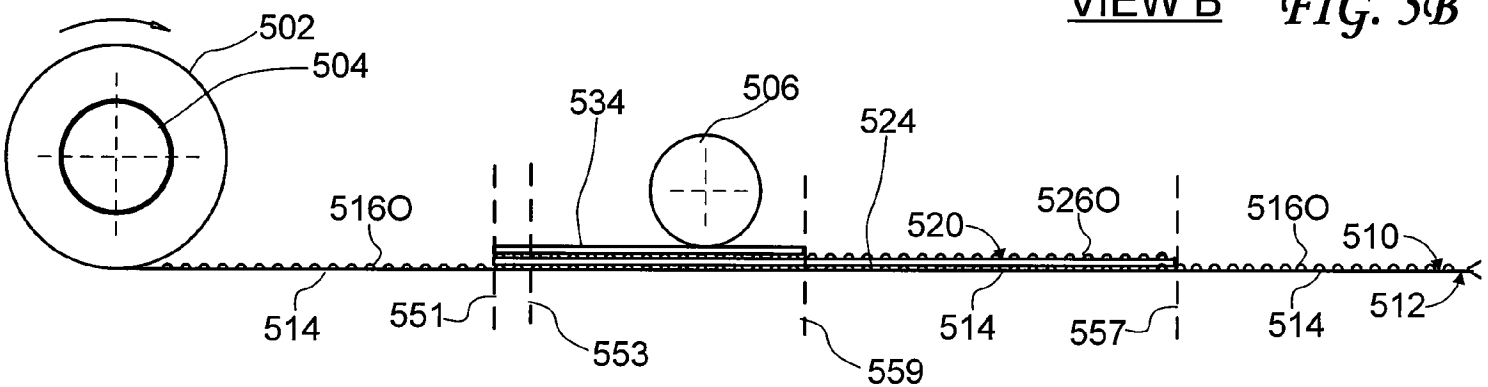

VIEW B FIG. 5E
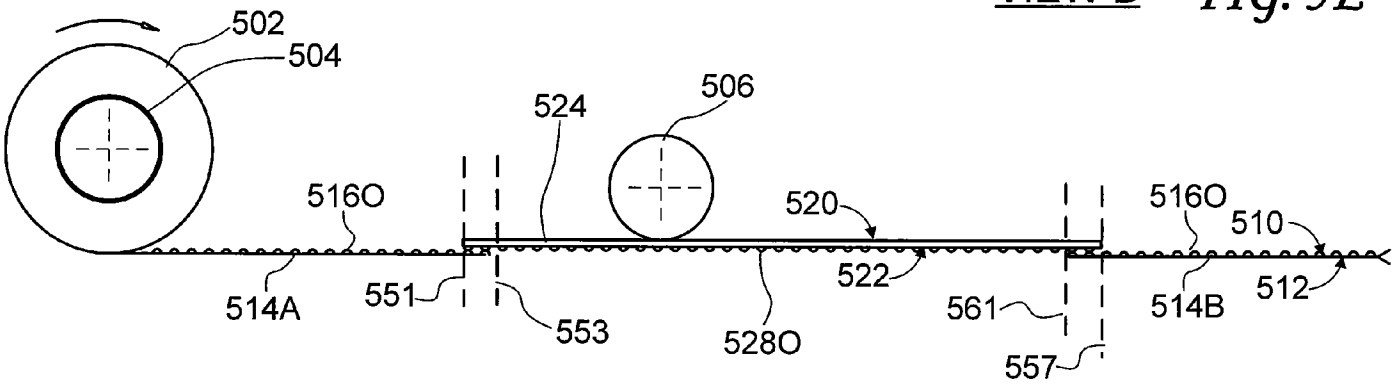
VIEW B FIG. 5F
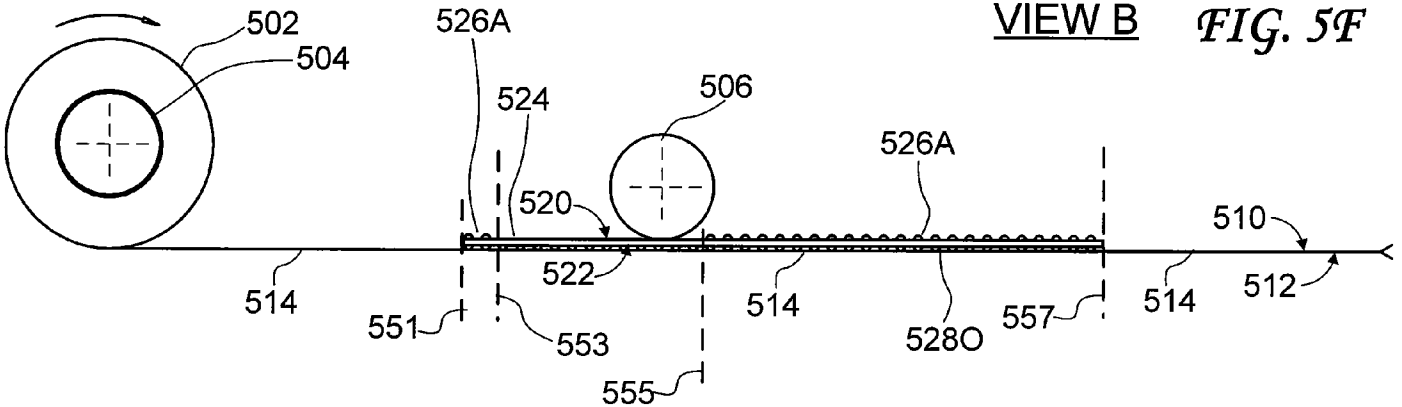

VIEW B FIG. 5G
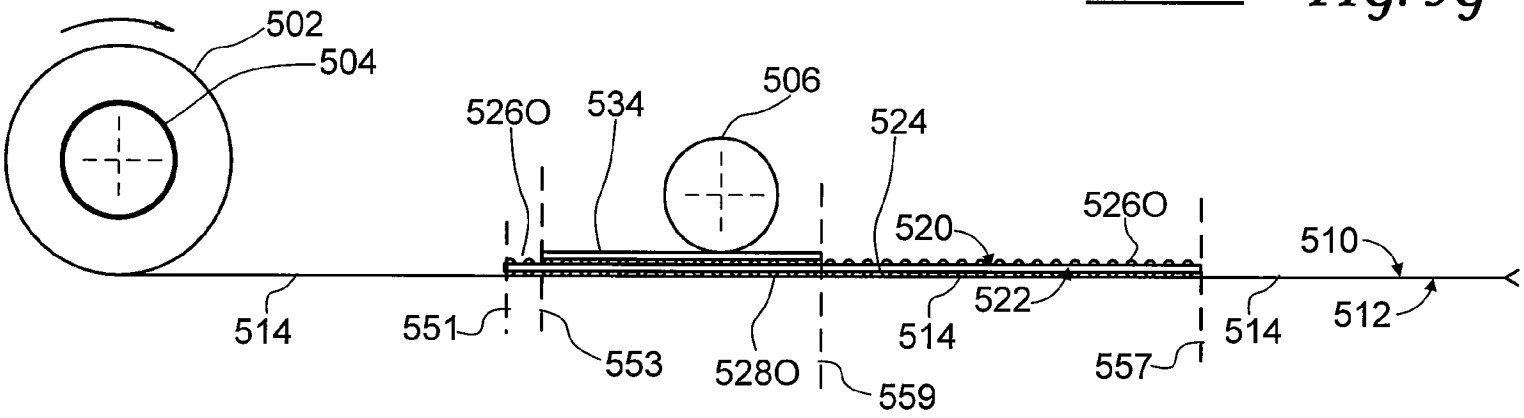
VIEW B FIG. 5H
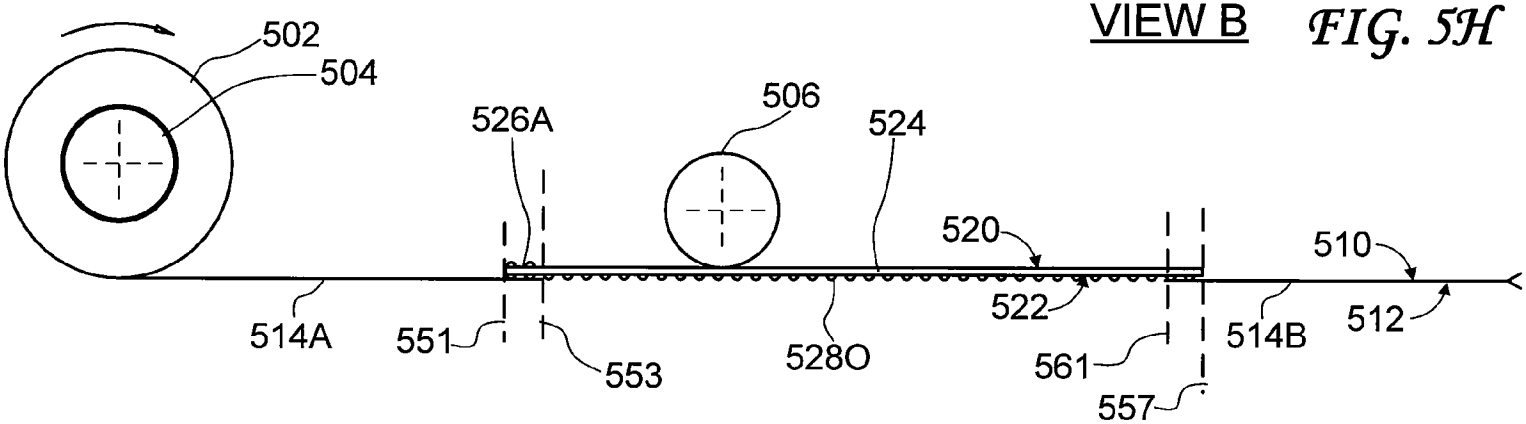

VIEW B

VIEW B

VIEW B

VIEW B

VIEW B

VIEW B

VIEW B

VIEW B

VIEW B

VIEW B

VIEW B

VIEW B

630

630

630

630

630

630

630

630

630

630

630

630

630

630

630

630

630

VIEW B

VIEW B

VIEW A
1220A
1210A-1
1210B-2

VIEW A
1220C
1210C
1210D
123
121

VIEW A
1220
1210A
1210B
1210C
1210D
1220A
1220B
1220C
1230A
1230B
1230C
1230D
1240A
1240B
1240C
1240D
VIEW B
VIEW A
121
ADHESIVE
1210A
1210B
1210C
1210D
1220A
1220B
1220C

VIEW B
1220

630

630

630

630

630

630

630

630

630

630

630

630

ENVELOPER ASSEMBLY FOR WINDING WEBS

This application claims the benefit of U.S. Provisional Application No. 61/219,428 filed Jun. 23, 2009, which is incorporated herein by reference.

CROSS-REFERENCE TO RELATED APPLICATION

This application is related to U.S. patent application Ser. No. 12/820,232, entitled In-Line Formed Core Supporting a Wound Web, which is being filed concurrently herewith and which is herein incorporated by reference in its entirety.

BACKGROUND OF THE INVENTION

The present invention relates generally to winding of webs, and more particularly to an enveloper assembly for winding webs in a streaming operation.

Many products are supplied as a flexible, elongated sheet referred to as a web. Examples of webs include sheet paper, sheet fabric, plastic film, and metal foil. Webs are commonly wound into a roll for storage, shipping, processing, and consumption. In typical practice, webs are wound onto a separate component, a pre-formed core formed from a rigid material such as cardboard, wood, plastic, or metal. The core serves as a support structure for initiating the winding process and for maintaining the structural integrity of the web during shipping and handling. The core also serves as a mechanism for dispensing the web during further processing and during end-user applications.

In some winding processes, an operator first manually attaches a web to a pre-formed core with tape. After the web has been fully wound, the operator then manually seals the finished roll with tape. These processes are labor intensive and not well suited for high-volume manufacturing. What are needed are methods and apparatus for streaming production of wound web rolls.

BRIEF SUMMARY OF THE INVENTION

In a winding assembly for winding web rolls, an enveloper assembly is used to initiate winding of a web stream onto a pre-formed core or to initiate winding of a core-forming substrate into an in-line core. The enveloper assembly comprises a first support arm operatively coupled to a second support arm; a third support arm operatively coupled to the second support arm; and an enveloper roller operatively coupled to the third support arm. The enveloper roller is movable along a cylindrical surface from a first position to a second position. The enveloper assembly accommodates a wide range of core diameters. In conjunction with apparatus for inserting core-forming substrates or adhesive tabs onto a web, the winding assembly can perform high-volume, streaming production of wound web rolls. The enveloper assembly can initiate winds with both adhesive and non-adhesive web streams. A tail tucker can also be used in conjunction with the enveloper assembly to process web streams.

These and other advantages of the invention will be apparent to those of ordinary skill in the art by reference to the following detailed description and the accompanying drawings.

BRIEF DESCRIPTION OF THE DRAWINGS

FIG. 5A-FIG. 5H show different configurations for attaching a core-forming substrate to a web;

DETAILED DESCRIPTION

In the conventional production of a wound web roll, a web is wound around a pre-formed core. U.S. patent application Ser. No. 12/820,232 describes methods and apparatus for winding a web onto an in-line formed core. Described herein are methods and apparatus for streaming production of wound web rolls with either pre-formed cores or in-line formed cores.

Production of wound web rolls with in-line formed cores proceeds as follows. An in-line core-forming substrate is attached to the leading edge of a web. At the start of the winding process, the in-line core-forming substrate is wound into a core. The web is then wound onto the in-line formed core (for simplicity, an in-line formed core is also referred to as an in-line core). Note that the term "substrate" is sometimes used as a synonym for "web". Herein, a "web" refers to the product of interest (such as paper towels, cloth strips, photographic film, masking tape, and metal foil). As discussed above, in general, a web refers to a flexible, elongated sheet. Web materials can be homogeneous or heterogeneous, including composites and laminates. Webs can have surface coatings, including adhesives. The body of a web can be uniform or can have geometrical features such as perforations and corrugations. The surface of a web can be smooth or textured, including features such as corrugations.

"Core-forming substrate" refers to a component used to produce an in-line formed core (as described in detail below). A wide range of materials can also be used for substrates, including paper, plastic, and metal. In some instances, the substrate material can be similar to the web material. For example, the web can be thin paper, and the substrate can be a heavier weight, stiffer paper. As another example, the web can be thin plastic film, and the substrate can be a thicker plastic film or a more rigid plastic film. Substrate materials can be homogeneous or heterogeneous, including composites and laminates. Substrates can have surface coatings, including adhesives. The body of a substrate can be uniform or can have geometrical features such as perforations and corrugations. The surface of a substrate can be smooth or textured, including features such as corrugations.

Figure 1A:
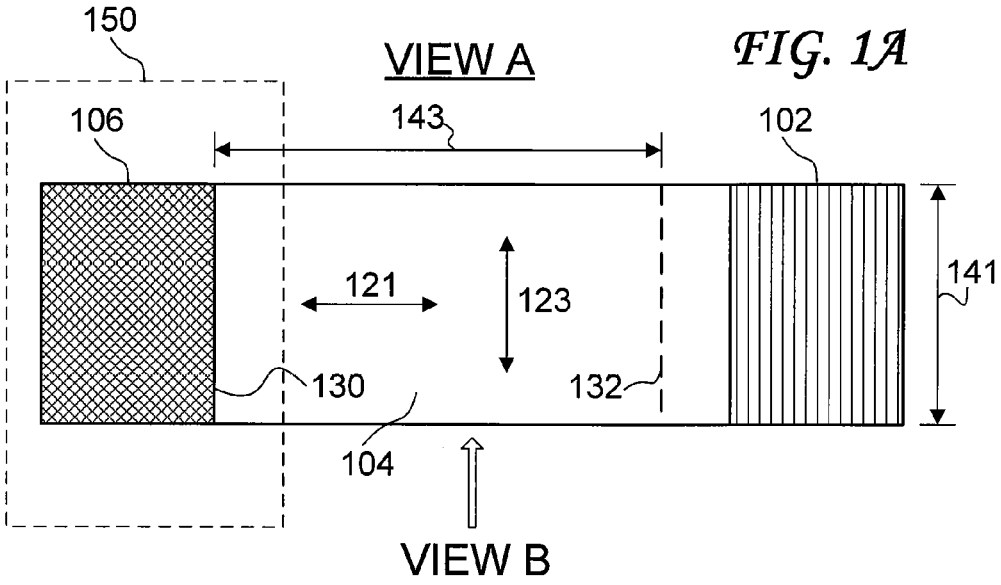
FIG. 1A and FIG. 1B show a reference geometry for a core-forming substrate attached to a web.
Figure 1B:
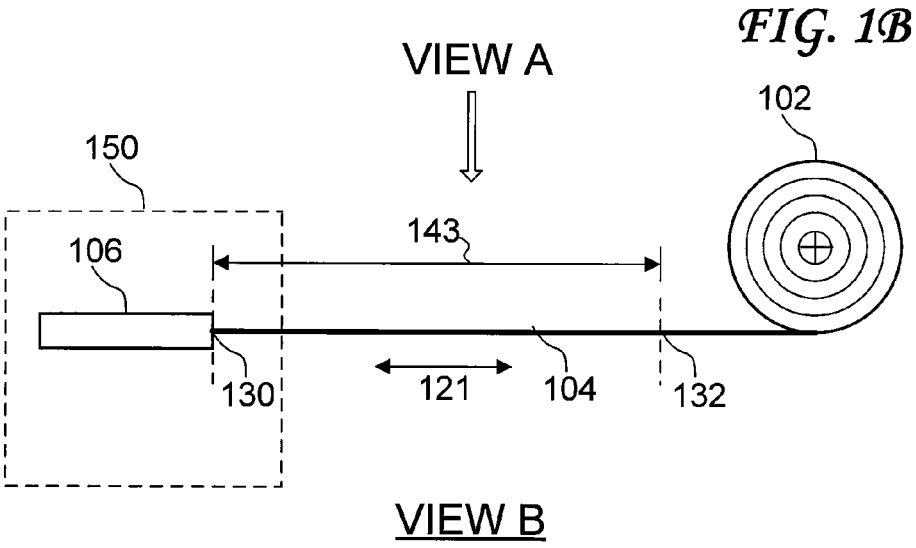

FIG. 1A (View A) and FIG. 1B (View B) show a reference geometry for winding operations. In the example shown, web 104, with a width 141 and a length 143, is unwound from a web supply roll 102. Note: To simplify the figures, a roll with multiple windings is depicted as a series of concentric circles; in actual practice, a web is wound as a continuous spiral. Web 104 is then rewound for further processing (such as slitting into narrower widths) or end-user application (such as retail rolls of masking tape). To simplify the terminology, "rewinding" is referred to as "winding". The final product is referred to as a wound web roll. Note that web 104 can also be supplied as an individual flat sheet, instead of being unwound from a web supply roll 102. Web 104 has a leading edge 130, a trailing edge 132, a longitudinal axis 121, and a transverse axis 123. Core-forming substrate 106 is attached to the leading edge 130 of web 104.

Figure 2A:
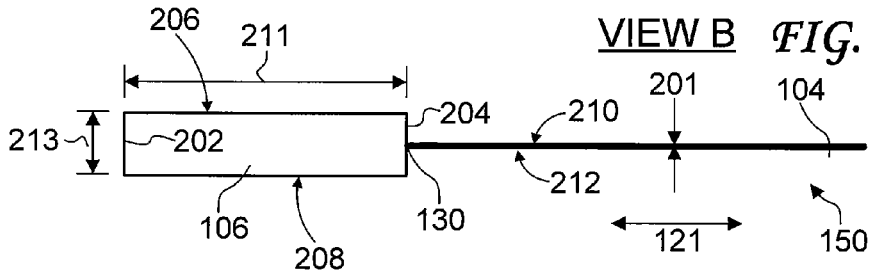
FIG. 2A-FIG. 2D show various configurations for attaching a core-forming substrate to a web.
Figure 2B:
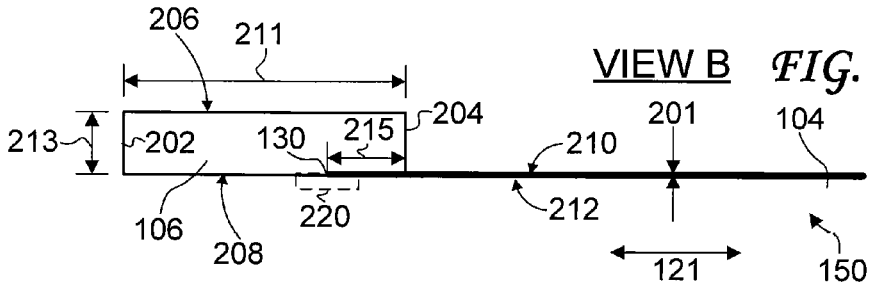
Figure 2C:
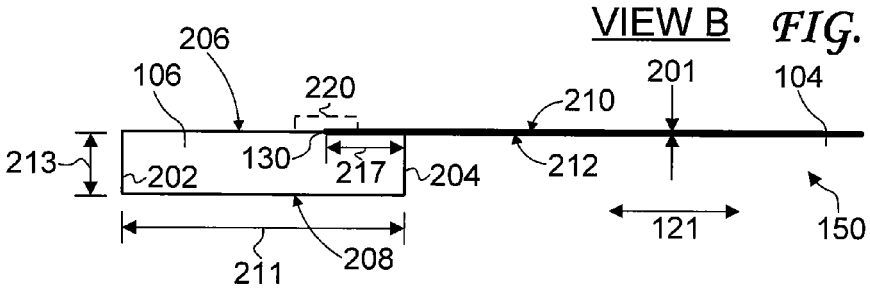
Figure 2D:
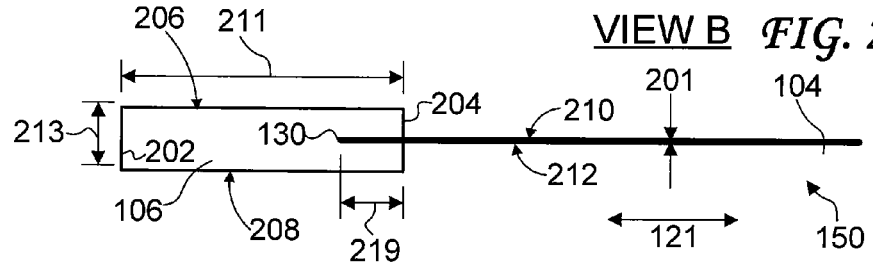

Details of the highlighted region 150 are shown in FIG. 2A-FIG. 2D (View B only) for several examples of attachment geometries. Shown is a portion of web 104 with leading edge 130. Web 104 has a surface 210 and a surface 212. Web 104 has a thickness 201. Core-forming substrate 106 has a leading edge 202, a trailing edge 204, a surface 206, and a surface 208. Core-forming substrate 106 has a length 211 and a thickness 213. In FIG. 2A, the leading edge 130 of web 104 is butted against the trailing edge 204 of core-forming substrate 106. In FIG. 2B, a portion of surface 208 of core-forming substrate 106 is facing a portion of surface 210 of web 104. The overlap distance 215 is the distance between the leading edge 130 of web 104 and the trailing edge 204 of core-forming substrate 106. The overlap distance 215 can range from 0 to length 211. In FIG. 2C, a portion of surface 212 of web 104 is facing a portion of surface 206 of core-forming substrate 106. The overlap distance 217 is the distance between the leading edge 130 of web 104 and the trailing edge 204 of core-forming substrate 106. The overlap distance 217 can range from 0 to length 211. In FIG. 2D, a portion of web 104 is inserted into a portion of core-forming substrate 106. The insertion distance 219 is the distance between the leading edge 130 of web 104 and the trailing edge 204 of core-forming substrate 106. The insertion distance 219 can range from 0 to length 211.

In some configurations, a third component can be used to attach core-forming substrate 106 to the leading edge 130 of web 104. For example, in the configuration shown in FIG. 2B, component 220 is disposed along leading edge 130 and contacts a portion of surface 208 of core-forming substrate 106 and a portion of surface 212 of web 104 in the proximity of leading edge 130. Similarly, in the configuration shown in FIG. 2C, component 220 is disposed along leading edge 130 and contacts a portion of surface 206 of core-forming substrate 106 and a portion of surface 210 of web 104 in the proximity of leading edge 130. In one example, component 220 is a strip of single-sided adhesive tape that sticks to both the core-forming substrate and the web. In another example, component 220 is a strip of thermoplastic that can be thermally fused to both the core-forming substrate and the web. More examples of attachment configurations are discussed below.

Herein, core-forming substrate 106 is attached to leading edge 130 of web 104 if core-forming substrate 106 is attached to at least one of leading edge 130, a portion of surface 210 of web 104 in the proximity of leading edge 130, and a portion of surface 212 of web 104 in the proximity of leading edge 130. Similarly, a core-forming substrate is attached to the trailing edge of the web if the core-forming substrate is attached to at least one of the trailing edge and a portion of at least one surface of the web in the proximity of the trailing edge.

Web 104 can be attached to core-forming substrate 106 by a variety of means. For example, they can be attached with an adhesive. The adhesive can be disposed on web 104, core-forming substrate 106, or both web 104 and core-forming substrate 106. The adhesive can be a thermally-activated adhesive. In another example, web 104 is attached to core-forming substrate 106 with double-sided adhesive tape disposed between web 104 and core-forming substrate 106. In another example, as discussed above, web 104 is attached to core-forming substrate 106 with single-sided adhesive tape. In another example, web 104 is attached to core-forming substrate 106 by thermal fusion. As discussed above with reference to FIG. 2B and FIG. 2C, web 104 can be thermally fused to core-forming substrate 106 with the use of a thermoplastic strip, component 220. Web 104 can also be thermally fused directly to core-forming substrate 106. One skilled in the art can devise other means for attaching web 104 to core-forming substrate 106, including mechanical crimping. More details of methods for attaching web 104 to core-forming substrate 106 are discussed below, with reference to FIG. 5A-FIG. 5H.

Figure 3A:
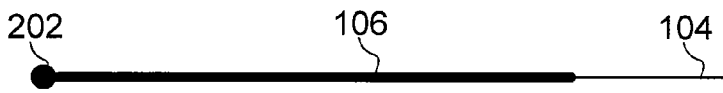
FIG. 3A-FIG. 3E show a sequence of steps for forming an in-line core.
Figure 3B:
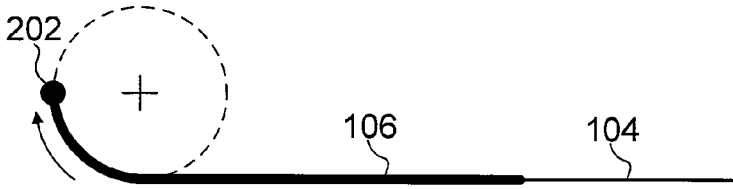
Figure 3C:
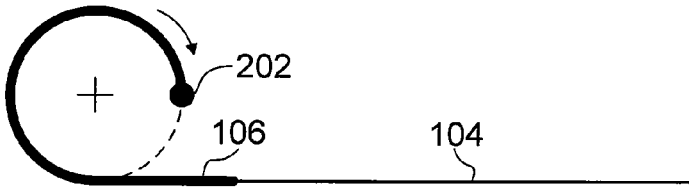
Figure 3D:
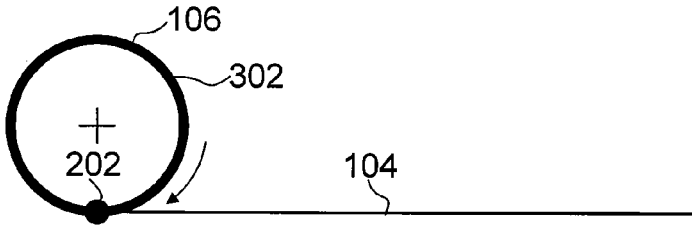
Figure 3E:
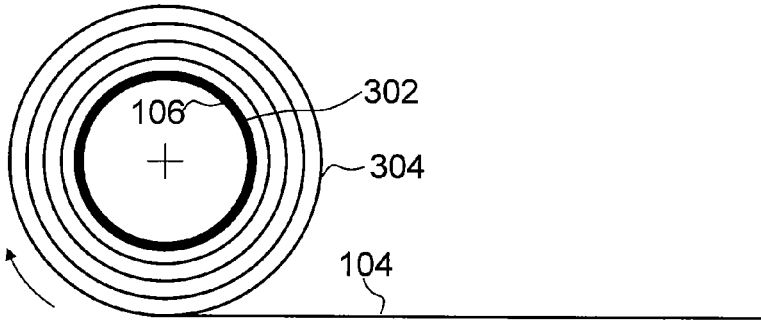

FIG. 3A-FIG. 3E (View B only) illustrate the basic process of forming an in-line core and winding a web onto the in-line core. FIG. 3A shows the initial stage with web 104 attached to core-forming substrate 106. The leading edge 202 of core-forming substrate 106 is depicted as a ball for illustration purposes only. In FIG. 3B, winding of core-forming substrate 106 is initiated. In FIG. 3C, winding of core-forming substrate 106 continues. In FIG. 3D, winding of core-forming substrate 106 is completed, and an in-line core 302 is formed. In FIG. 3E, web 104 is wound onto the in-line core 302 to form wound web roll 304.

In the example shown in FIG. 3D, the in-line core 302 is formed from one complete revolution of core-forming substrate 106. In general, an in-line core can be formed from part of a revolution, one revolution, or multiple revolutions of core-forming substrate 106.

Figures 4A, 4B, 4C:
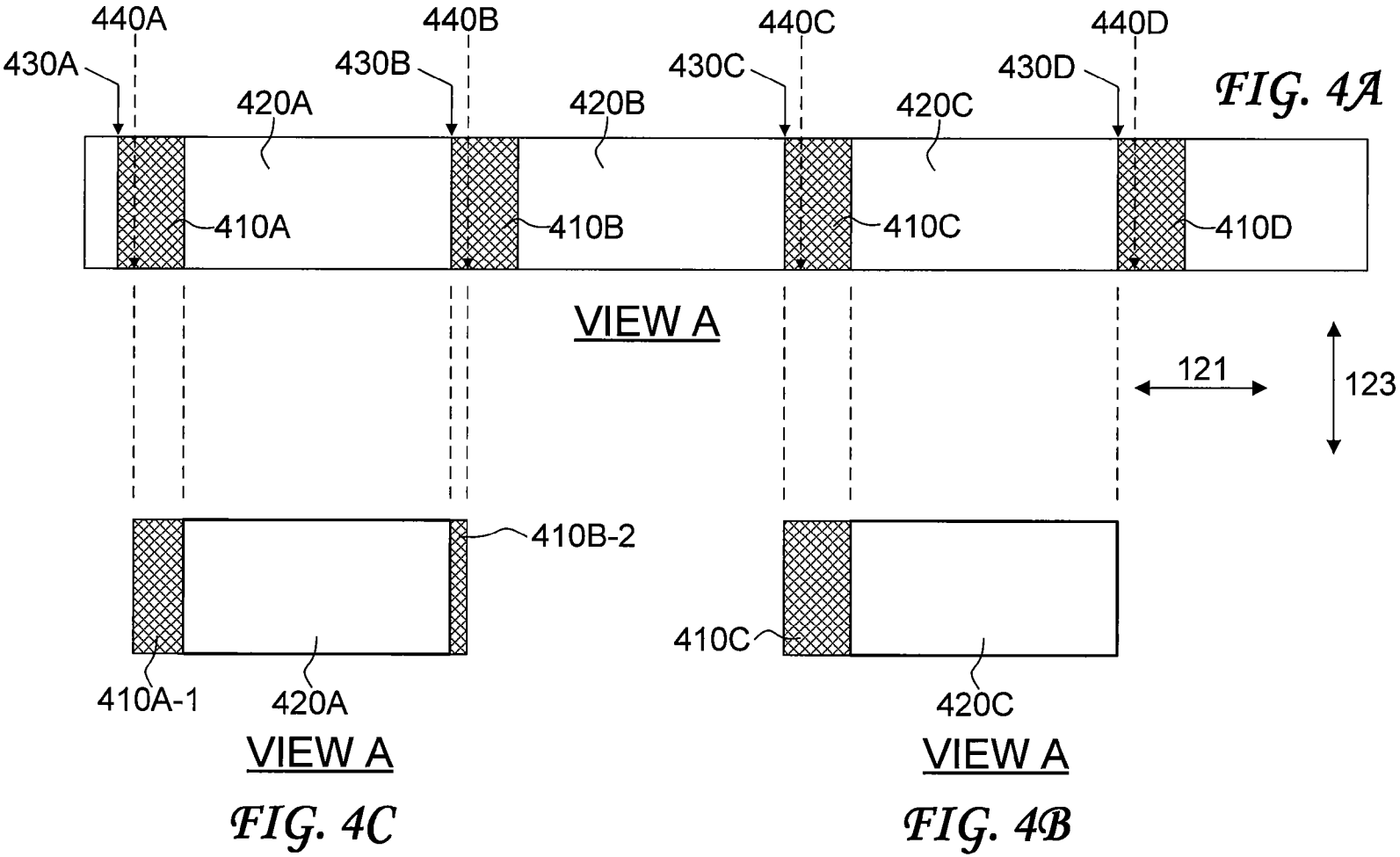
FIG. 4A-FIG. 4C show different segmentations of a core-forming substrate and a web.

FIG. 4A-FIG. 4C (View A only) illustrate geometrical configurations for streaming production of wound web rolls with in-line cores. In FIG. 4A, webs and core-forming substrates are attached in alternating sequence: core-forming substrate 410A, web 420A, core-forming substrate 410B, web 420B, core-forming substrate 410C, web 420C, core-forming substrate 410D, . . . . During later processing, segments are cut off. The segments can be cut off in different configurations. In a first configuration, the segments are cut off along cut line 430A—cut line 430D. In a second configuration, the segments are cut off along cut line 440A—cut line 440D.

FIG. 4B shows a representative segment according to the first configuration. Core-forming substrate 410C is attached to the leading edge of web 420C. FIG. 4C shows a representative segment according to the second configuration. Core-forming substrate 410A-1 is attached to the leading edge of web 420A, and core-forming substrate 410B-2 is attached to the trailing edge of web 420A.

Figure 9A:
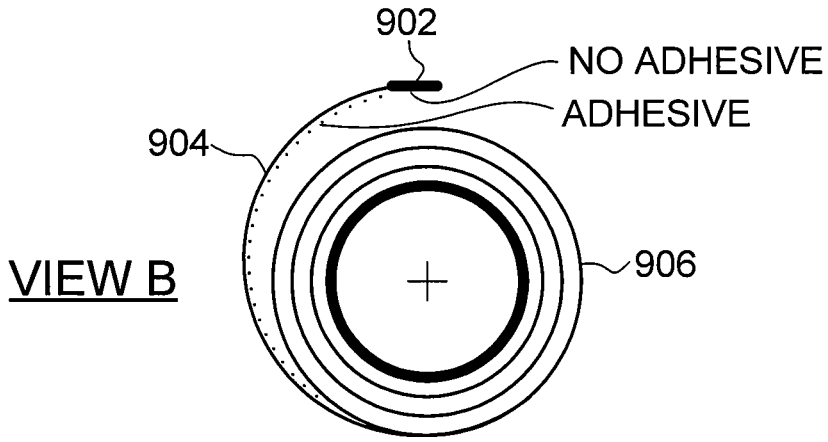
FIG. 9A and FIG. 9B show end tabs on finished wound web rolls.
Figure 9B:
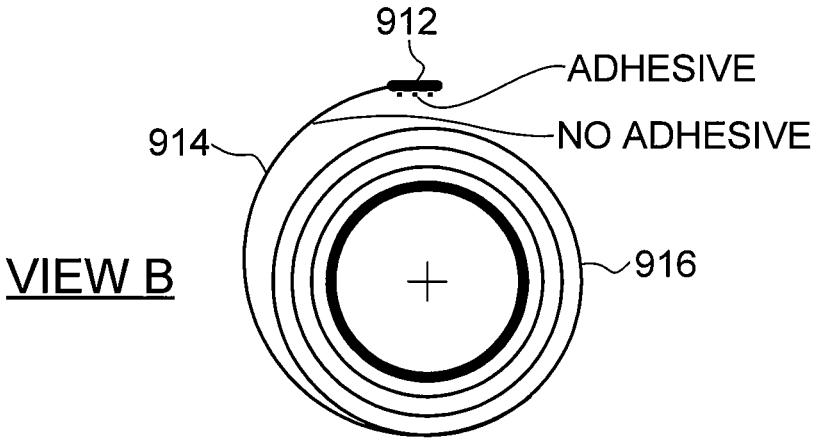

As shown in FIG. 9A and FIG. 9B (View B only), core-forming substrate 410B-2 can be used as finishing tabs on the finished wound web rolls. In FIG. 9A, core-forming substrate 410B-2 is used as a pull tab 902 to release an adhesive web 904 (such as adhesive tape) from a finished wound web roll 906. For illustration, web 904 is partially unwound from wound web roll 906. In FIG. 9B, core-forming substrate 410B-2 is used as a sealing tab 912 to seal a non-adhesive web 914 (such as plastic film) to prevent the finished wound web roll 916 from unwinding. For illustration, web 914 is partially unwound from wound web roll 916.

Figure 5C:
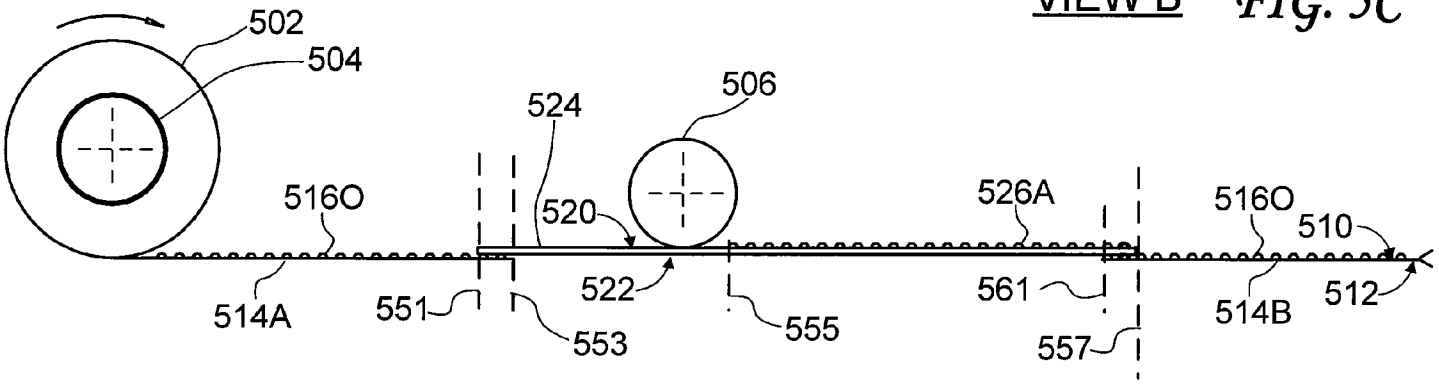

FIG. 5A-FIG. 5H (View B only) show different composite structures of a core-forming substrate attached to a web. The composite structures are pre-configured and pre-attached in upstream processes, as described below with reference to the substrate inserter assembly shown in FIG. 7A-FIG. 7S. The figures depict the stage in which a first wound web roll 502 with an in-line core 504 is being completed, and a second in-line core is being started. In FIG. 5A-FIG. E, web 514 is an open-adhesive web such as adhesive tape. Herein, an open adhesive refers to adhesive that is already present on the material as supplied. Web 514 has a surface 510 and a surface 512. As supplied, web 514 has open adhesive 516O disposed on surface 510. Core-forming substrate 524 has a surface 520 and a surface 522. Bare mandrel 506 corresponds to mandrel 804 described below with reference to the turret winder assembly shown in FIG. 8A-FIG. 8P.

In FIG. 5A, web 514 is continuous, and core-forming substrate 524 is applied in parallel with web 514. Core-forming substrate 524 extends from reference line 551 to reference line 557. Open adhesive 516O sticks surface 522 of core-forming web 524 to surface 510 of web 514. Applied adhesive 526A is applied on surface 520 of core-forming substrate 524 from reference line 555 to reference line 557. Herein, an applied adhesive is an adhesive that is applied to a material during processing; an applied adhesive is disposed on the surface on which it has been applied. Applied adhesive 526A can be applied either along the longitudinal axis or along the transverse axis. Applied adhesive 526A causes core-forming substrate 524 to adhere to itself as it is wound. No adhesive is applied on surface 520 between reference line 551 and reference line 555. The distance between reference line 551 and reference line 555 is approximately equal to the circumference of bare mandrel 506 so that the first wrap of the in-line core does not have exposed adhesive on the inner diameter. More details of the geometry of adhesive placement are described below with reference to FIG. 11A-FIG. 11E.

Reference line 557 is the demarcation line between the trailing edge of core-forming substrate 524 and the leading edge of web 514 for the next wound web roll. Reference line 553 is the cut line that demarcates the end of wound web roll 502 and the start of the in-line core for the next web roll. If a pull tab for wound web roll 502 is desired, reference line 553 is offset from reference line 551. If no pull tab is desired, reference line 553 coincides with reference line 551.

Figure 11A:
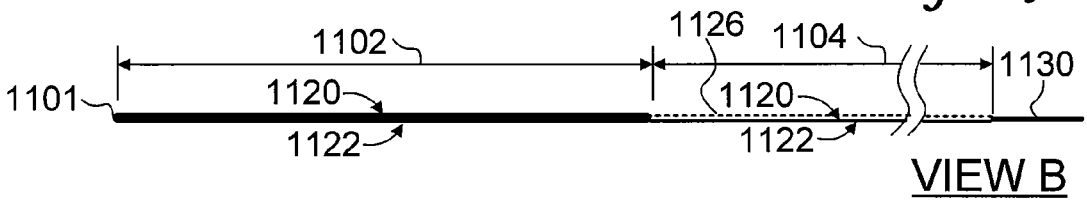
FIG. 11 shows the placement of adhesive to avoid adhesive on the inner surface of a wound web roll.

FIG. 11A-FIG. 11E show in more detail the geometry of adhesive placement. Refer to FIG. 11A. The core-forming substrate has a section 1102 and a section 1104. The surfaces of both sections are referenced as surface 1120 and surface 1122. There is no adhesive on either surface of section 1102. Adhesive 1126 is disposed on surface 1120 of section 1104. Section 1102 has leading edge 1101. Section 1104 is attached to the leading edge of web 1130.

Figure 11B:
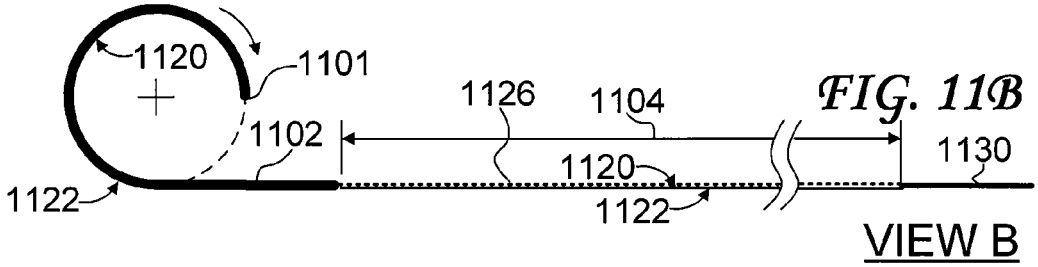
Figure 11C:
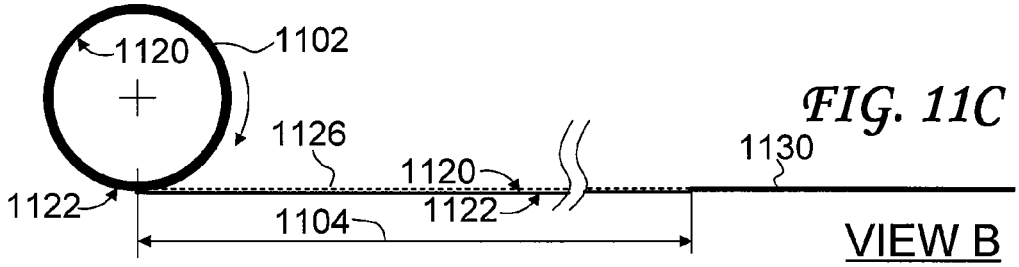
Figure 11D:
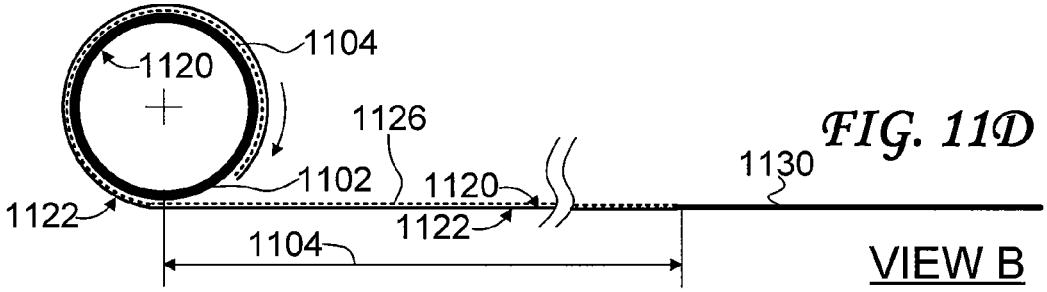
Figure 11E:
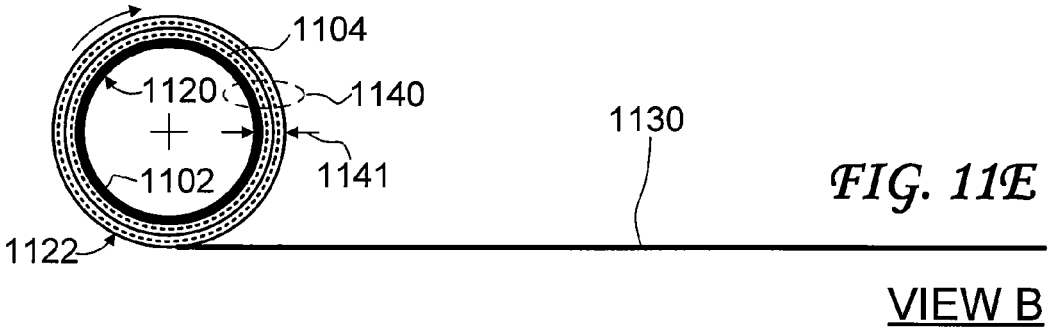

In FIG. 11B, winding of section 1102 is initiated. In FIG. 11C, winding of section 1102 is completed. The length of section 1102 is sufficient for at least one complete revolution. Note that the inside surface of the first wrap is surface 1120, which has no adhesive disposed on it. In FIG. 11D, winding of section 1104 is initiated. As section 1104 is wound onto section 1102, adhesive 1126 causes section 1104 to stick onto section 1102. In FIG. 11E, winding of section 1104 is completed. In the example shown, the length of section 1104 is sufficient for two revolutions. In general, multiple revolutions can be used. As section 1104 is wound, adhesive 1126 causes it to stick to a previously wound portion of section 1104.

In the example shown in FIG. 11E, the finished in-line core 1140 is a core formed from multiple wraps of a core-forming substrate bonded together with adhesive. One skilled in the art can develop other means for bonding, such as thermal fusion. The finished in-line core 1140 has a wall thickness 1141, which is the difference between the outside radius and the inside radius.

The inner wrap is formed from section 1120, which has no adhesive, and the outer wraps are formed from section 1104, which has adhesive disposed on one surface. The inside surface of the finished in-line core 1140 is therefore surface 1120, which has no adhesive disposed on it. In many applications, it is desirable to have no adhesive on the inside surface. For example, exposed adhesive would attract dirt, interfere with loading the finished wound web roll onto a dispensing spindle, and interfere with handling by a user (that is, exposed adhesive would stick to fingers). In FIG. 11E, winding of web 1130 onto the finished in-line core 1140 can then proceed, as previously shown in FIG. 3E.

The configuration shown in FIG. 5B is similar to that shown in FIG. 5A (core-forming substrate applied in parallel with web), except that core-forming substrate 524 has open adhesive 526O disposed on surface 520. Non-adhesive liner 534 is disposed on open adhesive 526O between reference line 551 and reference line 559. The length of non-adhesive liner 534 (distance between reference line 551 and reference line 559) is approximately equal to the circumference of bare mandrel 506 so that the first wrap of the in-line core does not have exposed adhesive on the inner diameter. Note that non-adhesive liner 534 can be applied to a portion of core-forming substrate 524 that is initially not covered by any non-adhesive liner. Alternatively, core-forming substrate 524 can initially be completely covered by a non-adhesive liner, and a portion of the non-adhesive liner can be stripped away and removed to leave behind non-adhesive liner 534. Non-adhesive liner 534 can be applied or stripped away along the longitudinal axis or along the transverse axis.

In the configuration shown in FIG. 5C, the web is discontinuous, and the core-forming substrate is applied in series with the web. The web includes two segments, web 514A and web 514B. Open adhesive 516O sticks surface 510 of web 514A to surface 522 of core-forming substrate 524 between reference line 551 and reference line 553. Open adhesive 516O sticks surface 510 of web 514B to surface 522 of core-forming substrate 524 between reference line 557 and reference line 561. As in the configuration shown previously in FIG. 5A, applied adhesive 526A is applied on surface 520 of core-forming substrate 524 between reference line 555 and reference line 557.

Figure 5D:
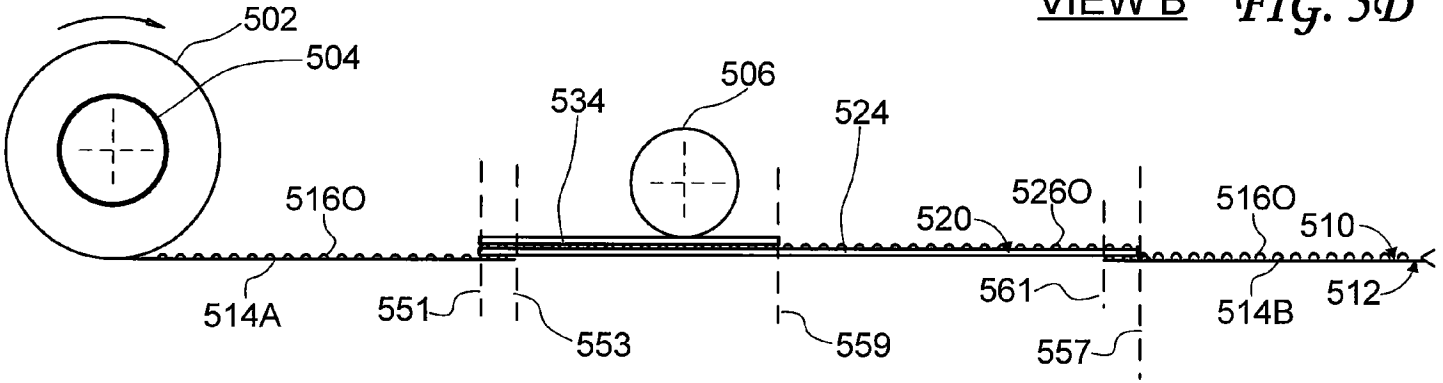

The configuration shown in FIG. 5D is similar to that shown in FIG. 5C (core-forming substrate applied in series with web), except that core-forming substrate 524 has open adhesive 526O disposed on surface 520. Non-adhesive liner 534 is disposed on open adhesive 526O between reference line 551 and reference line 559. The length of non-adhesive liner 534 (distance between reference line 551 and reference line 559) is approximately equal to the circumference of bare mandrel 506 so that the first wrap of the in-line core does not have exposed adhesive on the inner diameter.

The configuration shown in FIG. 5E is similar to the configuration shown in FIG. 5C (core-forming substrate applied in series with web), except core-forming substrate 524 has open adhesive 528O disposed on surface 522. Open adhesive 516O on surface 510 of web 514A and open adhesive 528O stick surface 510 of web 514A to surface 522 of core-forming substrate 524 between reference line 551 and reference line 553. Open adhesive 516O and open adhesive 528O stick surface 510 of web 514B to surface 522 of core-forming substrate 524 between reference line 557 and reference line 561. Note that, instead of having open adhesive 528O on surface 522, an applied adhesive can be applied to surface 522.

In FIG. 5F-FIG. 5H, web 514 is a non-adhesive web (for example, bare plastic film). In FIG. 5F and FIG. 5G, the web is continuous, and the core-forming substrate is applied in parallel with the web. In FIG. 5H, the web is discontinuous, and the core-forming substrate is applied in series with the web.

In the configuration shown in FIG. 5F, core-forming substrate 524 has open adhesive 528O on surface 522. Applied adhesive 526A is applied on surface 520 between reference line 555 and reference line 557. If a sealing tab on wound web roll 502 is desired, applied adhesive 526A is also applied on surface 520 between reference line 551 and reference line 553. Note that, instead of having open adhesive 528O on surface 522, an applied adhesive can be applied to surface 522.

The configuration shown in FIG. 5G is similar to the one shown in FIG. 5F, except core-forming substrate 524 has open adhesive 526O on surface 520 and open adhesive 528O on surface 522 (double-sided adhesive). Non-adhesive liner 534 is disposed on open adhesive 526O between reference line 553 and reference line 559. The length of non-adhesive liner 534 (distance between reference line 553 and reference line 559) is approximately equal to the circumference of bare mandrel 506 so that the first wrap of the in-line core does not have exposed adhesive on the inner diameter. If a sealing tab on wound web roll 502 is desired, reference line 553 is offset from reference line 551. If a sealing tab on wound roll 502 is not desired, reference line 553 coincides with reference line 551. Note that, instead of having open adhesive 528O on surface 522, an applied adhesive can be applied to surface 522.

In FIG. 5H, the web is discontinuous: the web includes two segments, web 514A and web 514B. Core-forming substrate 524 has open adhesive 528O on surface 522. Open adhesive 528O sticks surface 510 of web 514A to surface 522 of core-forming substrate 524 between reference line 551 and reference line 553. Open adhesive 528O sticks surface 510 of web 514B to surface 522 of core-forming substrate 524 between reference line 557 and reference line 561. If a sealing tab on wound roll 502 is desired, applied adhesive 526A is applied on surface 520 of core-forming substrate 524 between reference line 551 and reference line 553.

For streaming production, the sequence of core-forming substrate/web/core-forming substrate/web . . . is repeated. Herein, a composite substrate-web stream comprises an alternating sequence of attached core-forming substrate segments. Each core-forming substrate segment has a leading edge and a trailing edge, and each web segment has a leading edge and a trailing edge. To simplify geometrical descriptions herein, a core-forming substrate segment includes a core-forming substrate and any portion of web overlapping it or inserted into it.

For example, in FIG. 2B, a core-forming substrate segment includes core-forming substrate 106 and the portion of web 104 between leading edge 130 of web 104 and the trailing edge 204 of core-forming substrate 106. In FIG. 5A, core substrate 524 is attached in parallel to continuous web 512. A core-forming substrate segment then includes core-forming substrate 524 and the section of web 512 between the leading edge 551 and the trailing edge 557 of core-forming substrate 524. In FIG. 5D, core-forming substrate 524 is attached in series between web 514A and web 514B. A core-forming substrate segment then includes core-forming substrate 524, the section of web 514A between leading edge 551 of core-forming substrate 524 and the trailing edge 553 of web 514A, and the section of web 514B between trailing edge 557 of core-forming substrate 524 and leading edge 561 of web 512.

Under this geometrical terminology, a web segment is attached to a core-forming substrate segment. The trailing edge of a core-forming substrate segment also serves as the demarcation line for the leading edge of the attached web segment. FIG. 4A then can also be viewed as a composite substrate-web stream comprising an alternating sequence of core-forming substrate segments 410A-410D and web segments 420A-420C.

Figure 6:
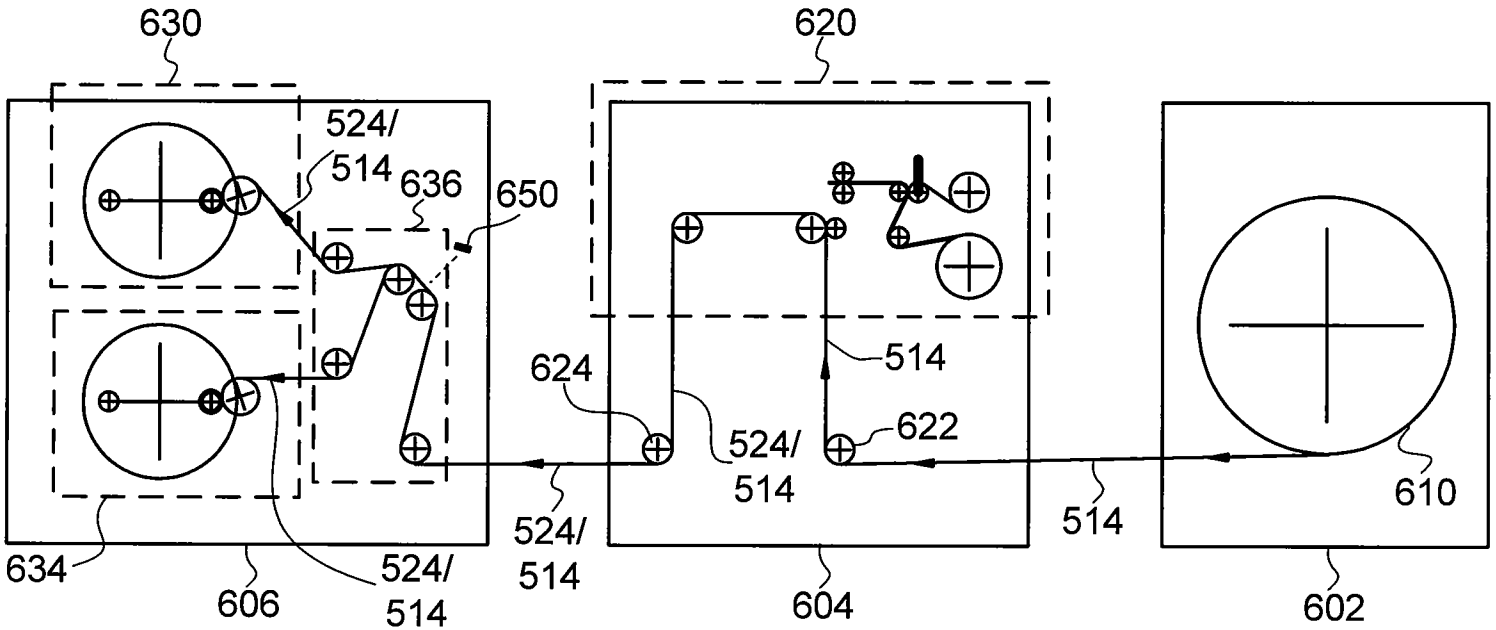
FIG. 6 shows a schematic of a manufacturing system for streaming production of wound web rolls with in-line cores.

FIG. 6 (View B only) illustrates an example of a manufacturing system (streaming winding system) for streaming production of wound web rolls with in-line cores. The streaming winding system includes three main modules: web supplier module 602, substrate inserter module 604, and winder module 606. Web 514 is unwound from web supply roll 610 mounted in web supplier module 602. Web 514 is fed into substrate inserter module 604, passed around roller 622, and fed into substrate inserter assembly 620, which inserts core-forming substrate 524 onto web 514 (either in parallel or in series). A continuous sequence of core-forming substrate 524/web 514 is outputted from substrate inserter assembly 620, passed around roller 624, and fed into roller assembly 636 in winder module 606.

One skilled in the art can assemble the modules in various physical configurations. For example, all modules can be housed in a single frame. In another example, the winder module and the substrate inserter module can be housed in one frame, and the web supplier module can be housed in a second frame. In another example, the three modules can each be housed in individual frames. One skilled in the art can also group functions in various configurations. For example, the slitting operation (described below) can be grouped with the winding module or with the substrate module; the slitting operation can also be performed in an independent module.

Various components such as rollers and turrets are driven by drive systems such as electrical motors. The drive systems and the overall sequence of operations are controlled in response to commands issued by a control unit. The control unit, for example, can be a computerized control unit or a programmable logic controller control unit.

In the example shown in FIG. 6, winder module 606 operates in a duplex mode, with twin turret winder assemblies, turret winder assembly 630 and turret winder assembly 634 (which is a duplicate of turret winder assembly 630). In another example, winder module 606 operates in a simplex mode, with a single turret winder assembly 630. Duplex and simplex operation are discussed in more detail below.

Figure 7A:
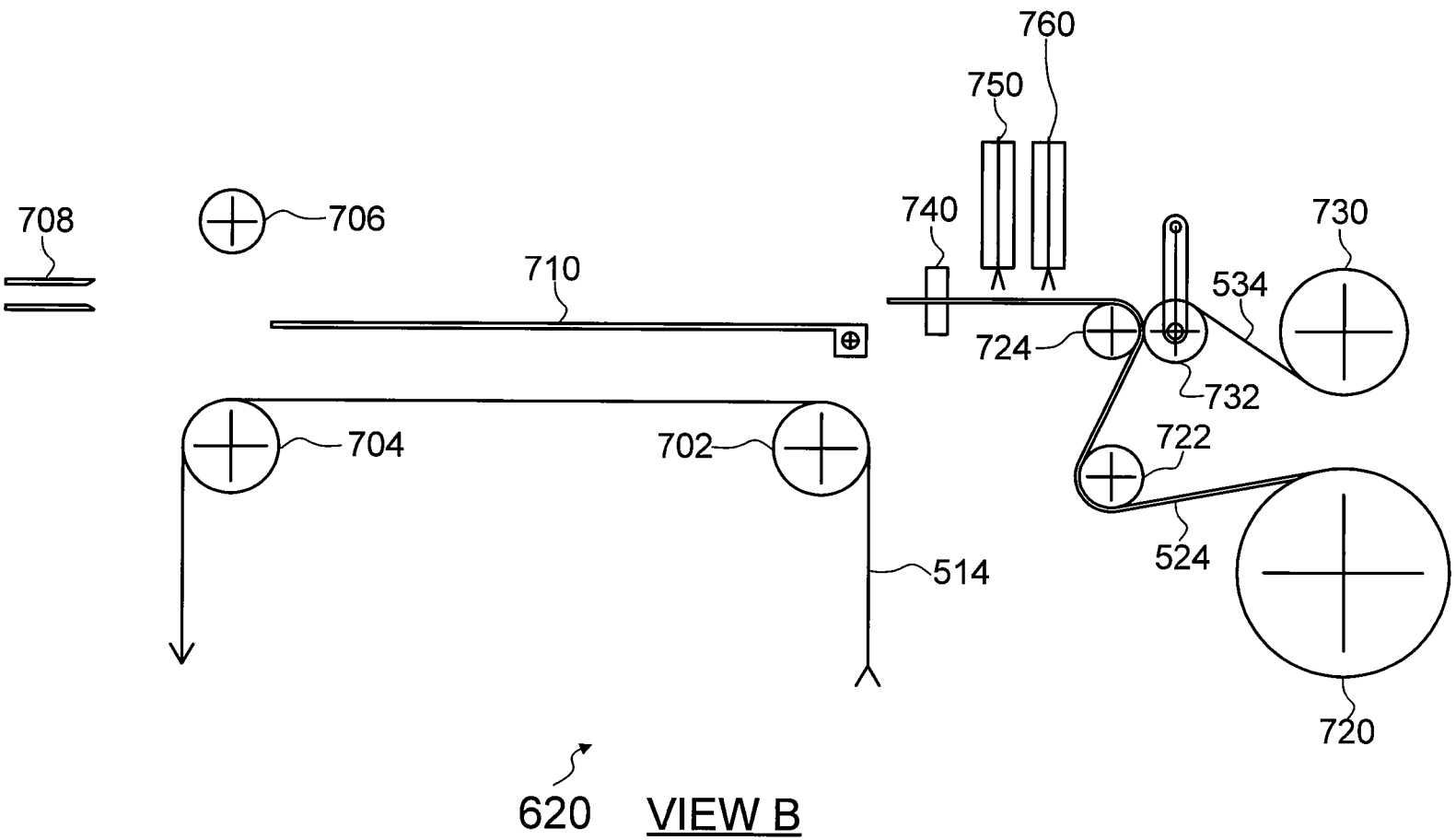
FIG. 7A-FIG. 7S show schematics of steps for producing a sequence of webs and core-forming substrates.
Figure 7B:
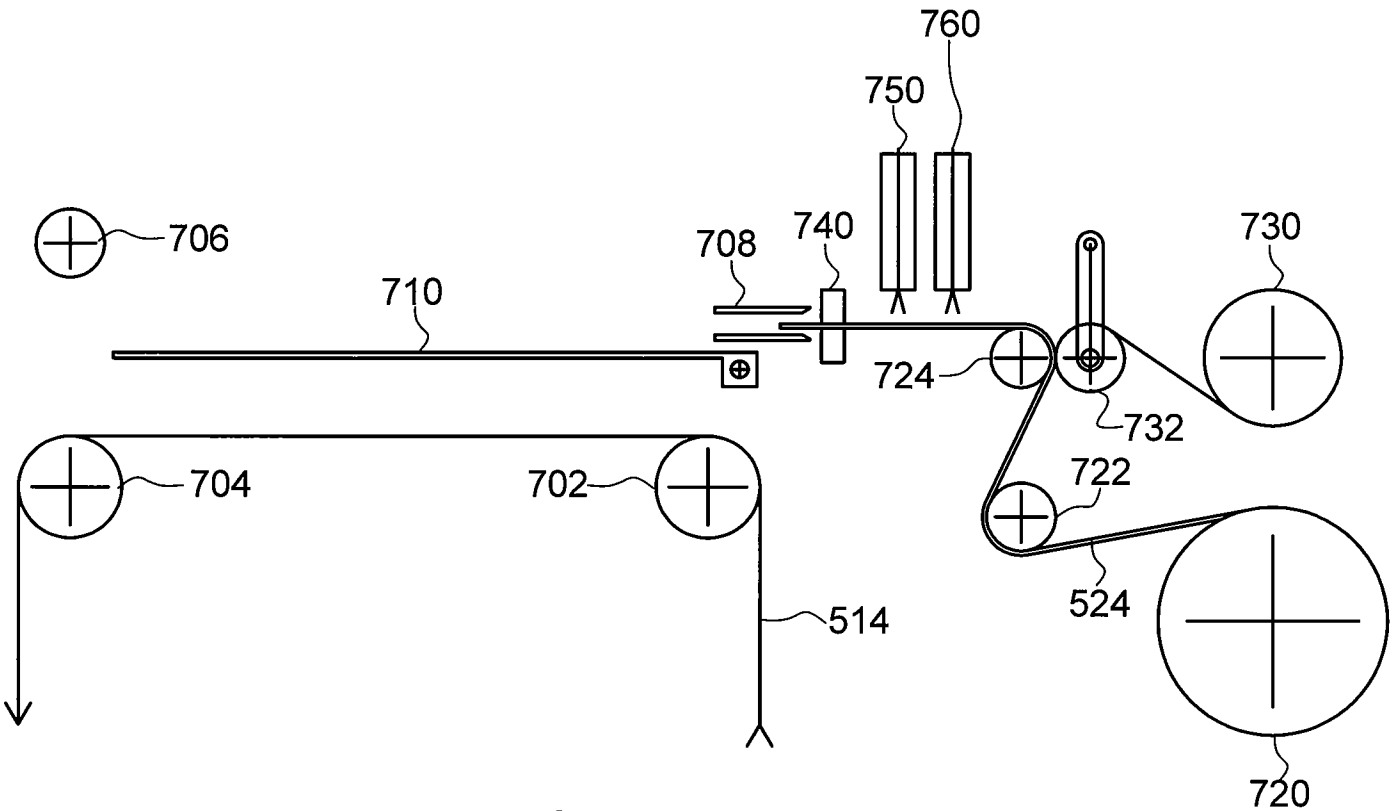
Figure 7C:
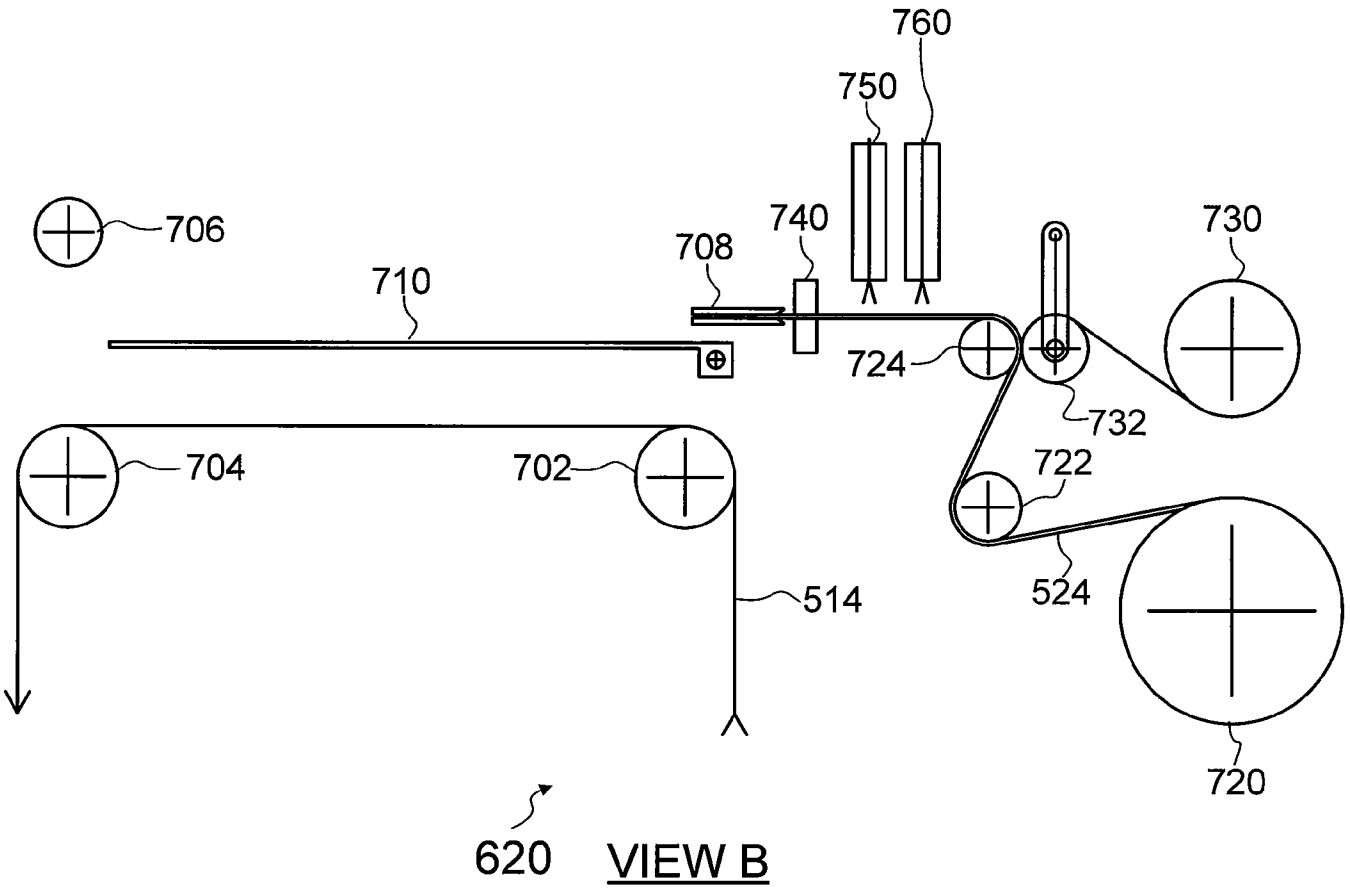
Figure 7D:
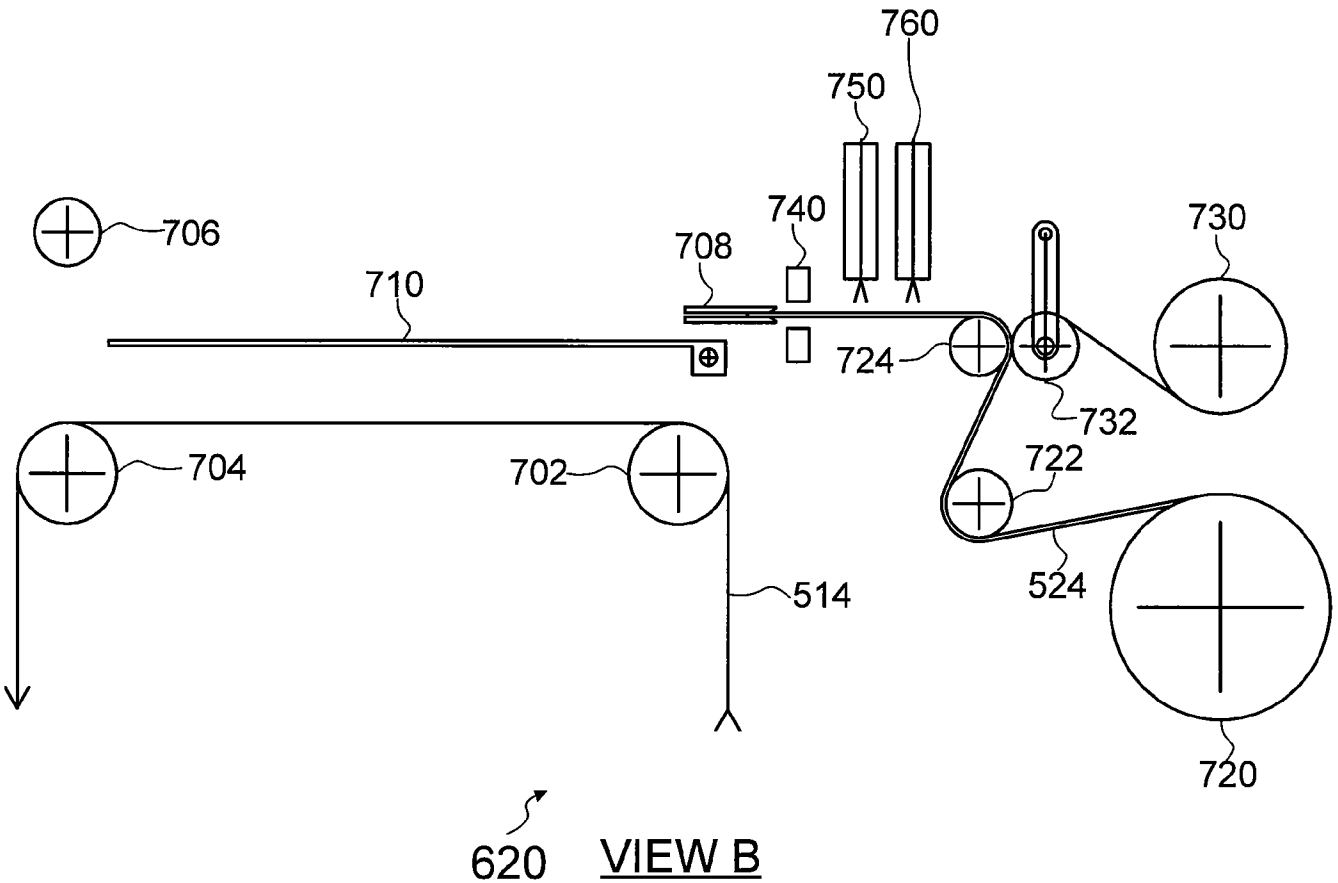
Figure 7E:
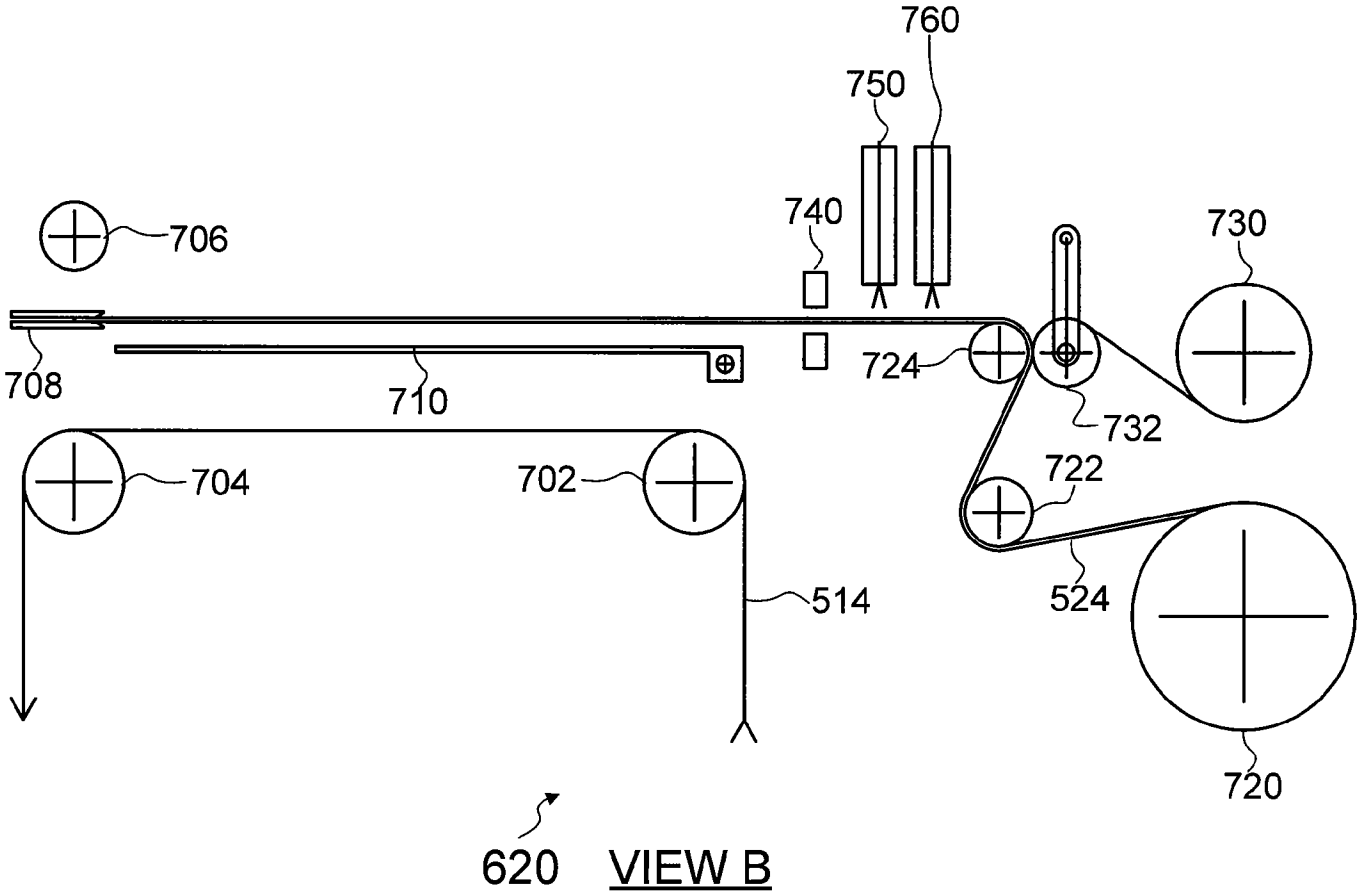
Figure 7F:
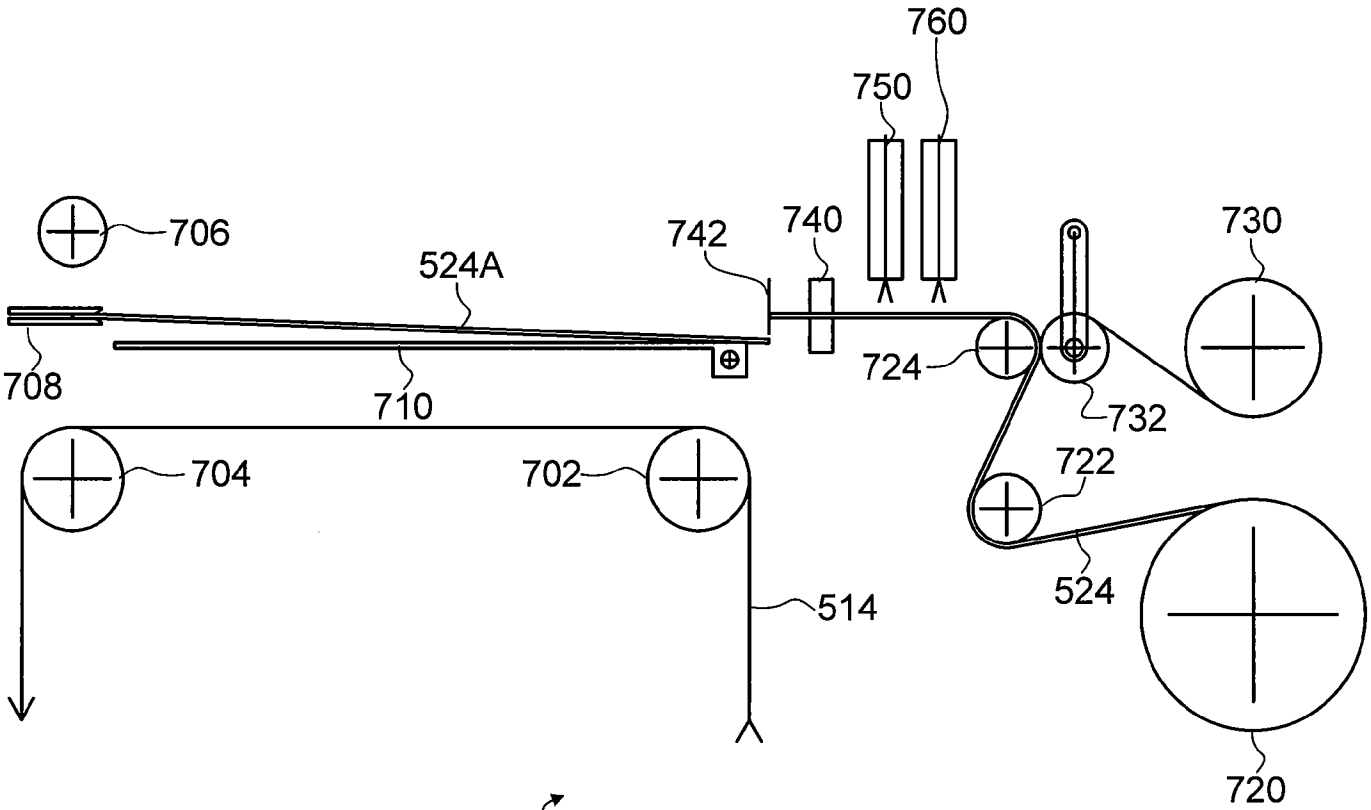
Figure 7G:
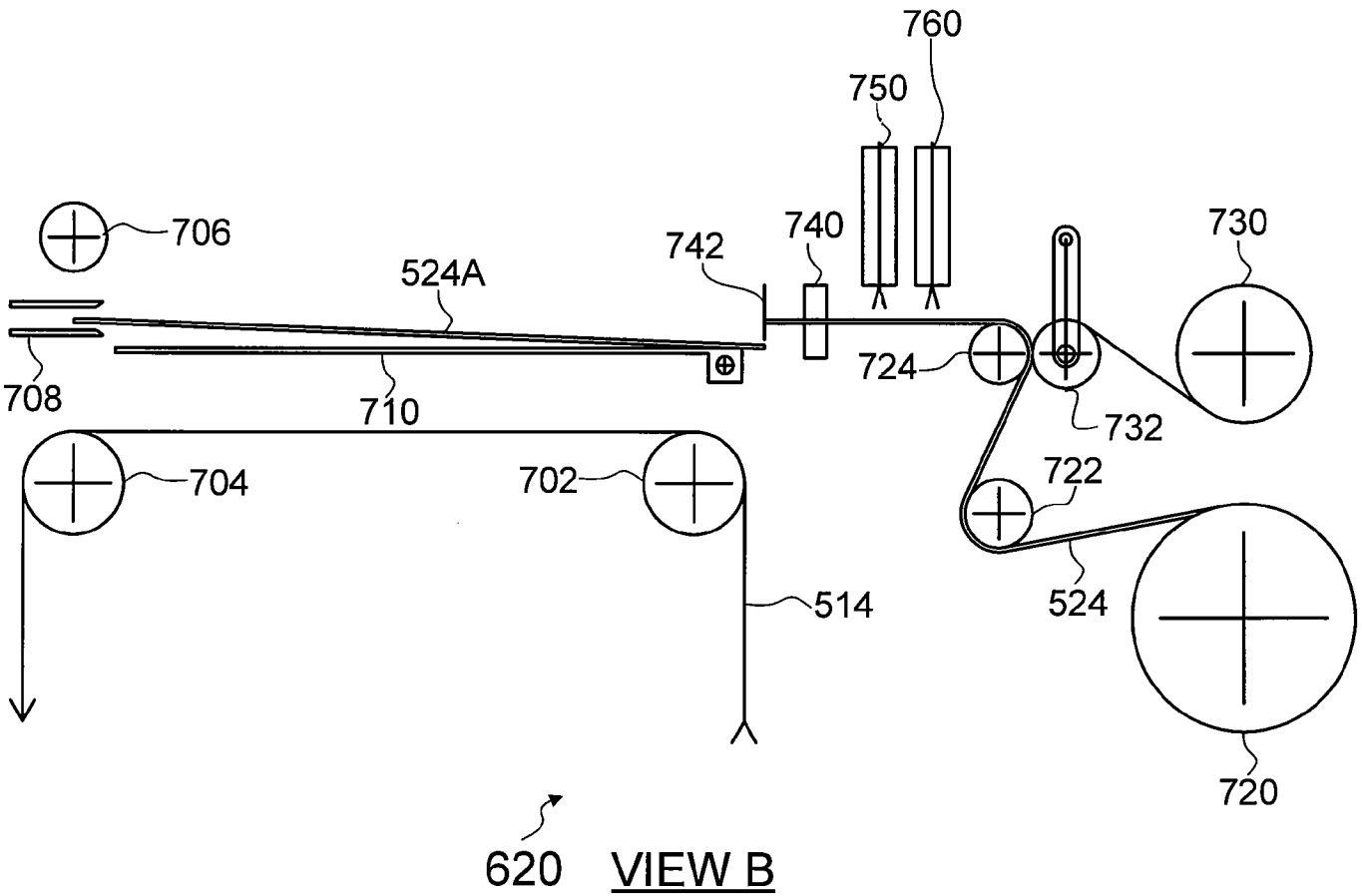
Figure 7H:
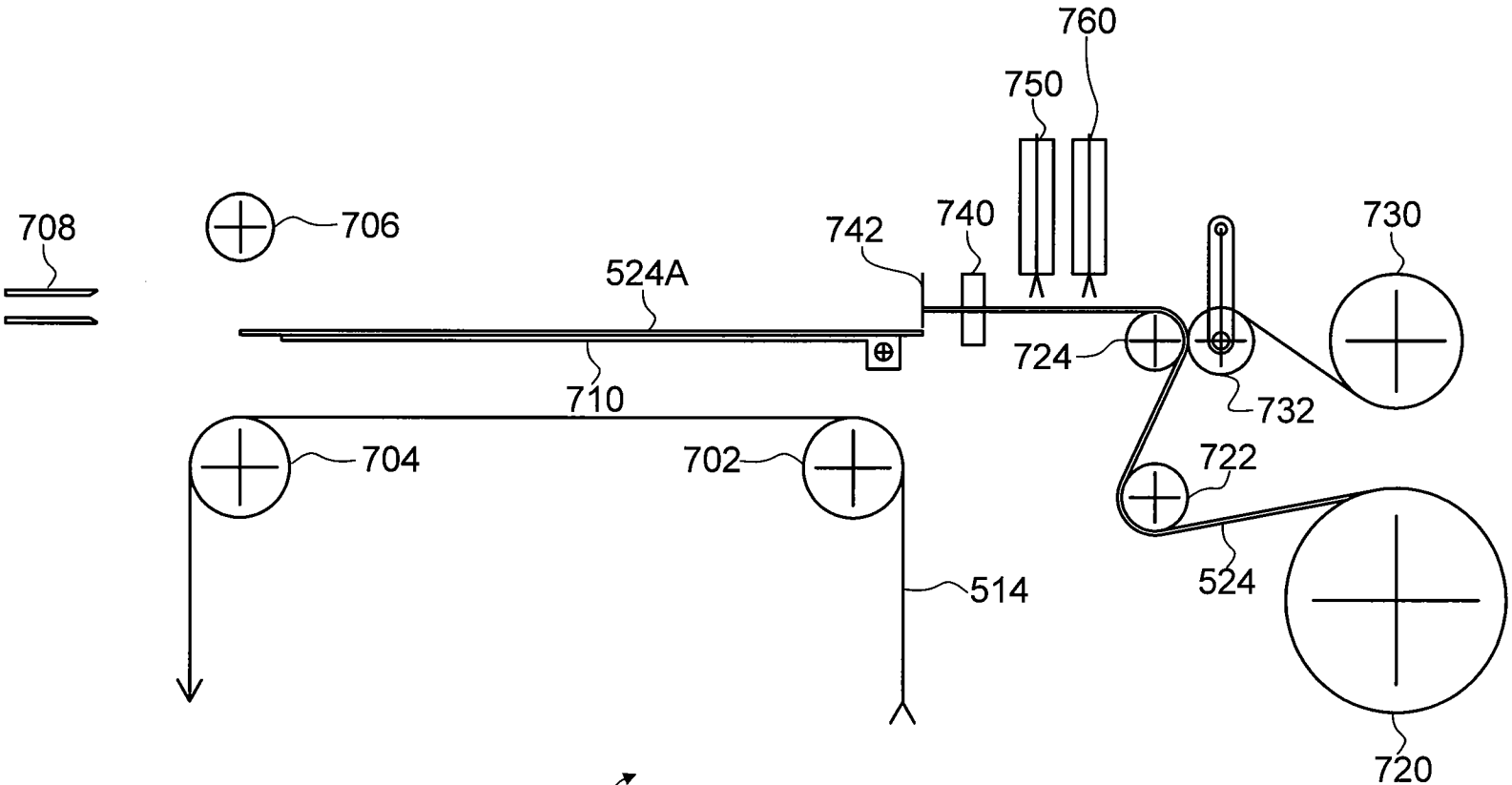
Figure 7I:
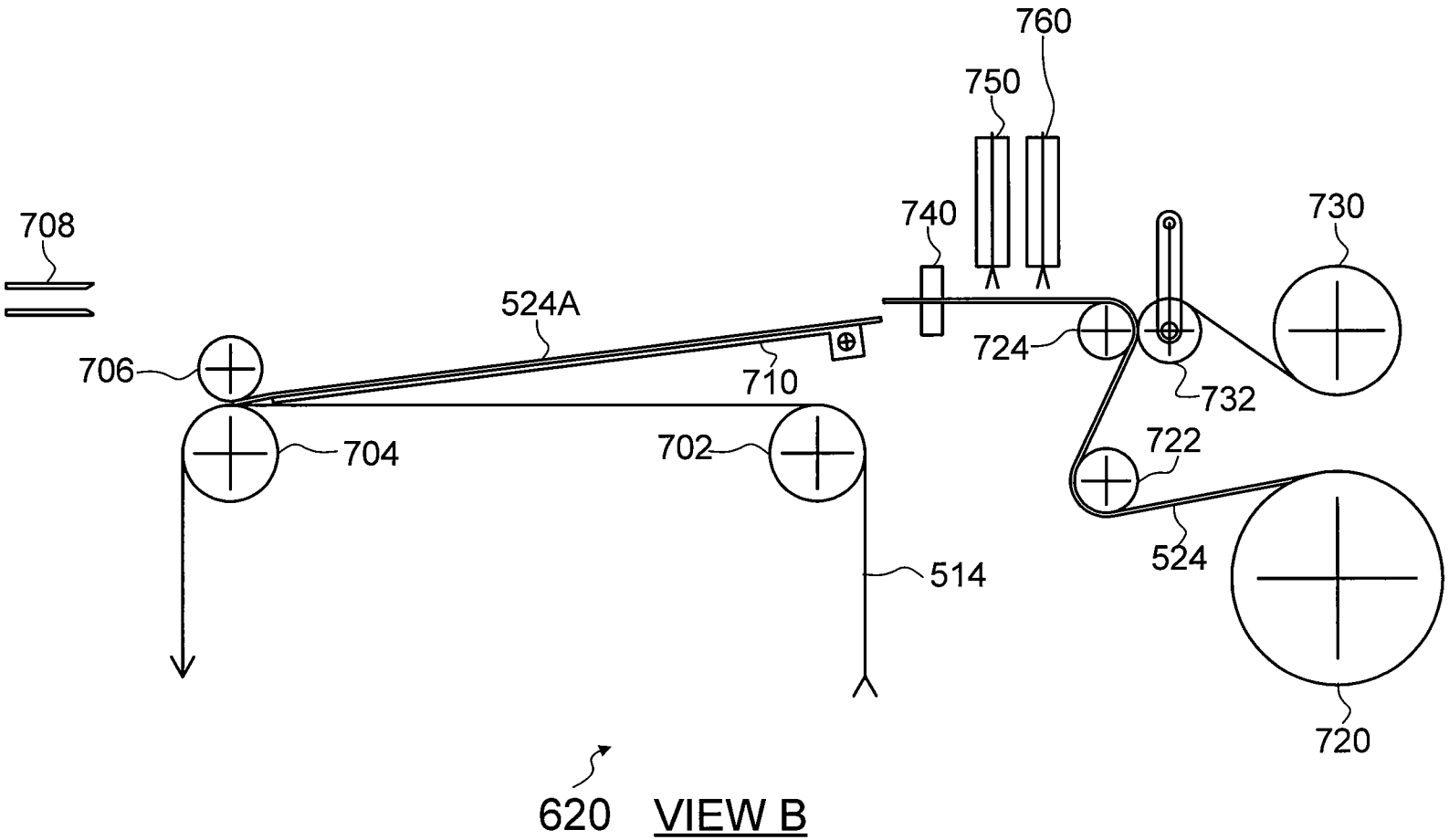
Figure 7J:
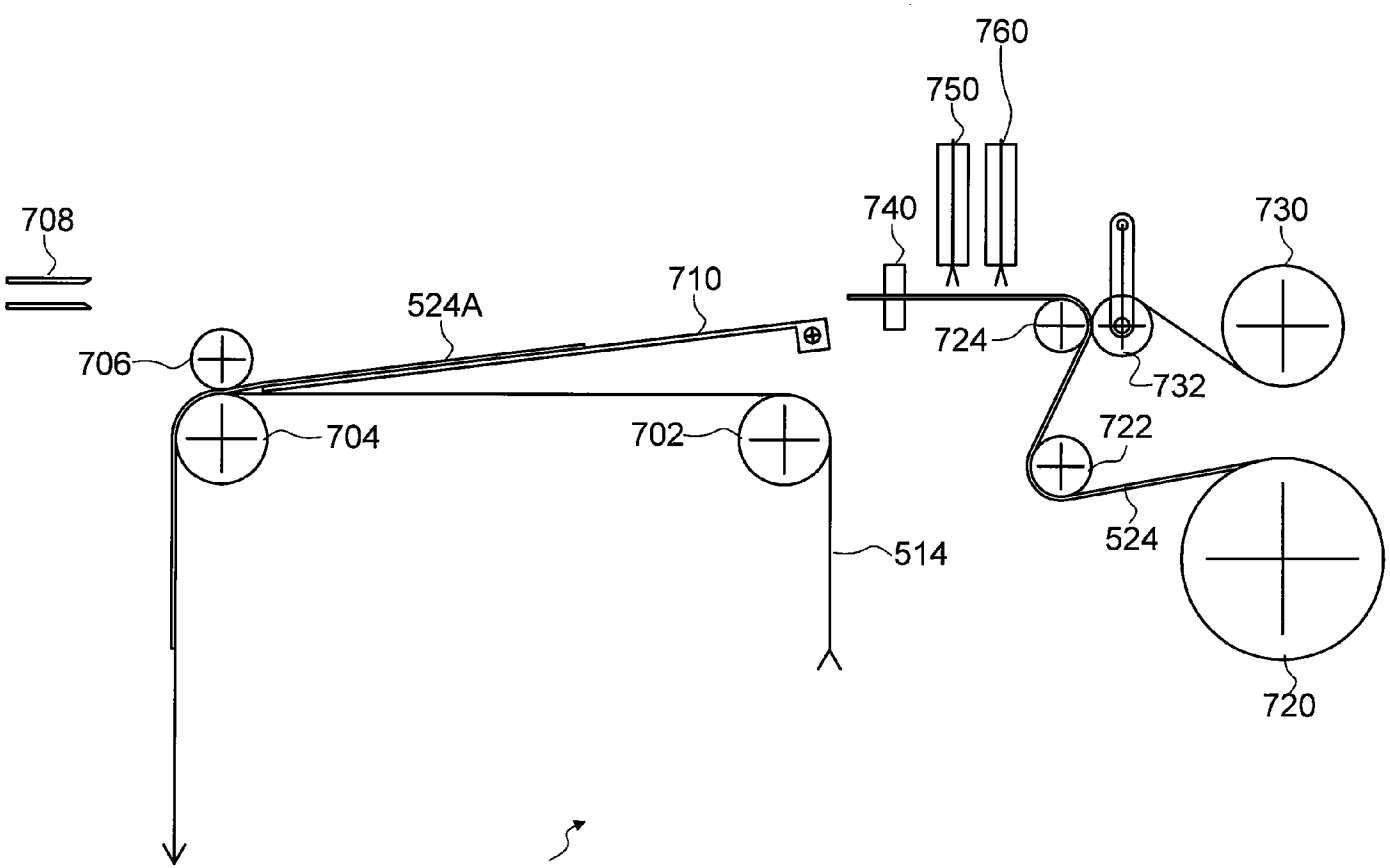
Figure 7K:
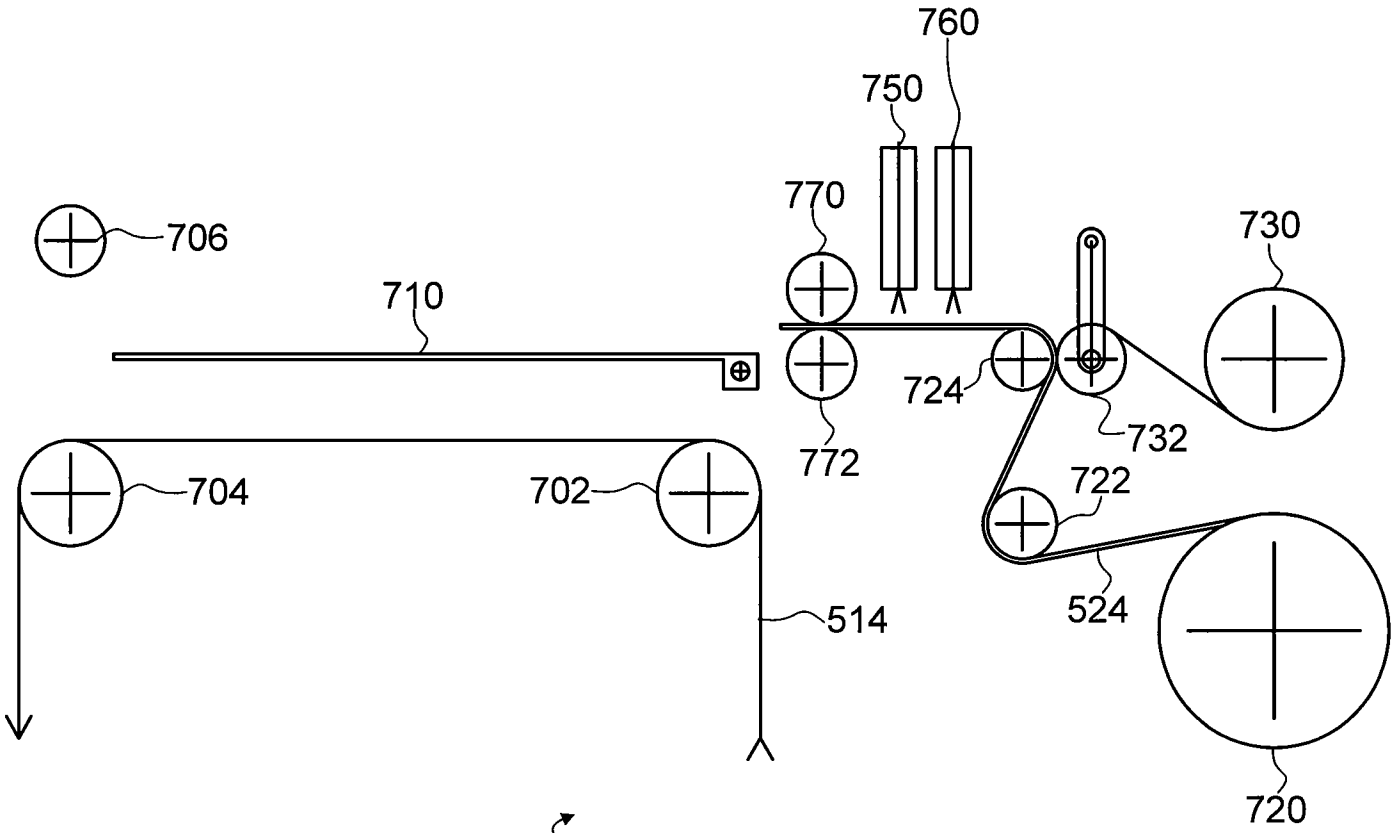
Figure 7L:
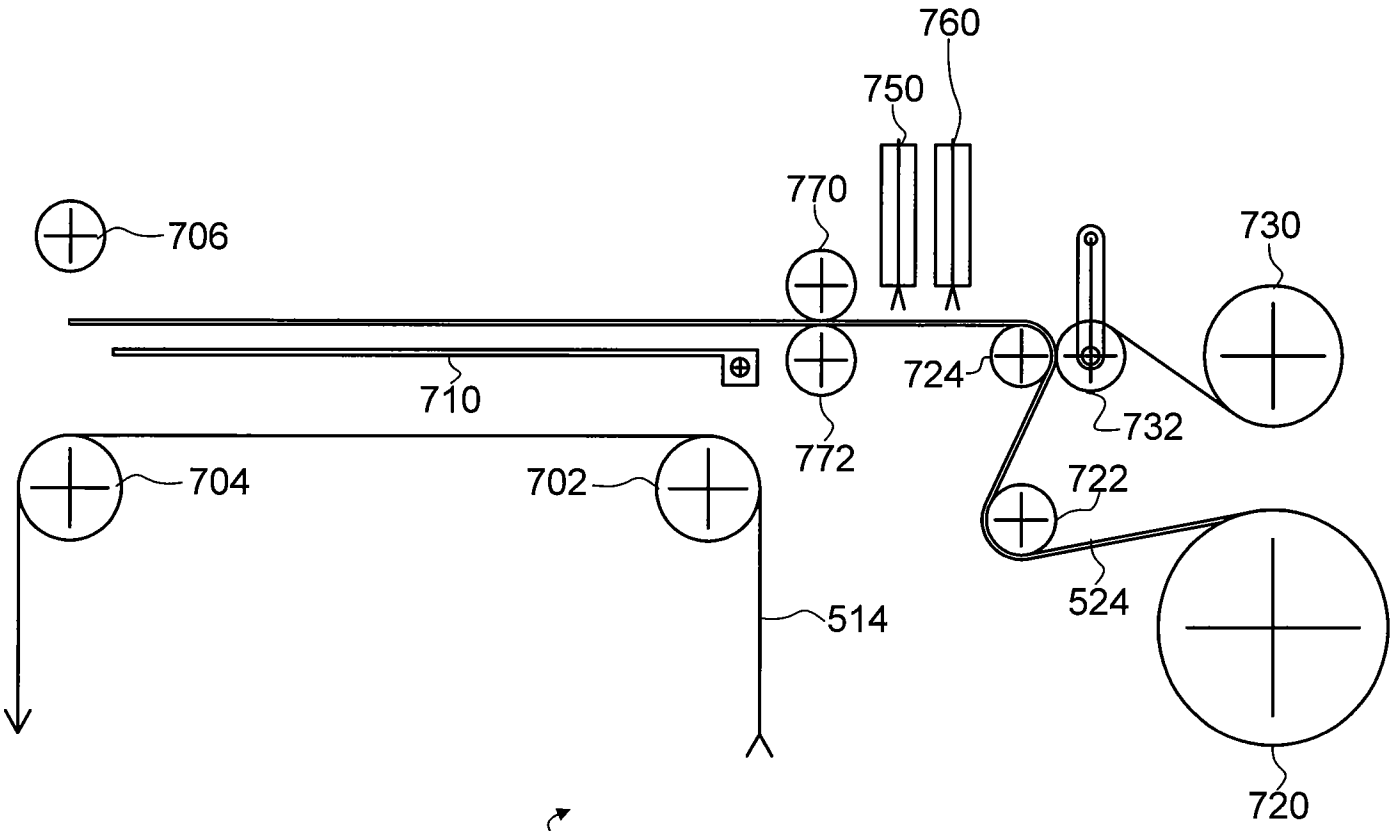
Figure 7M:
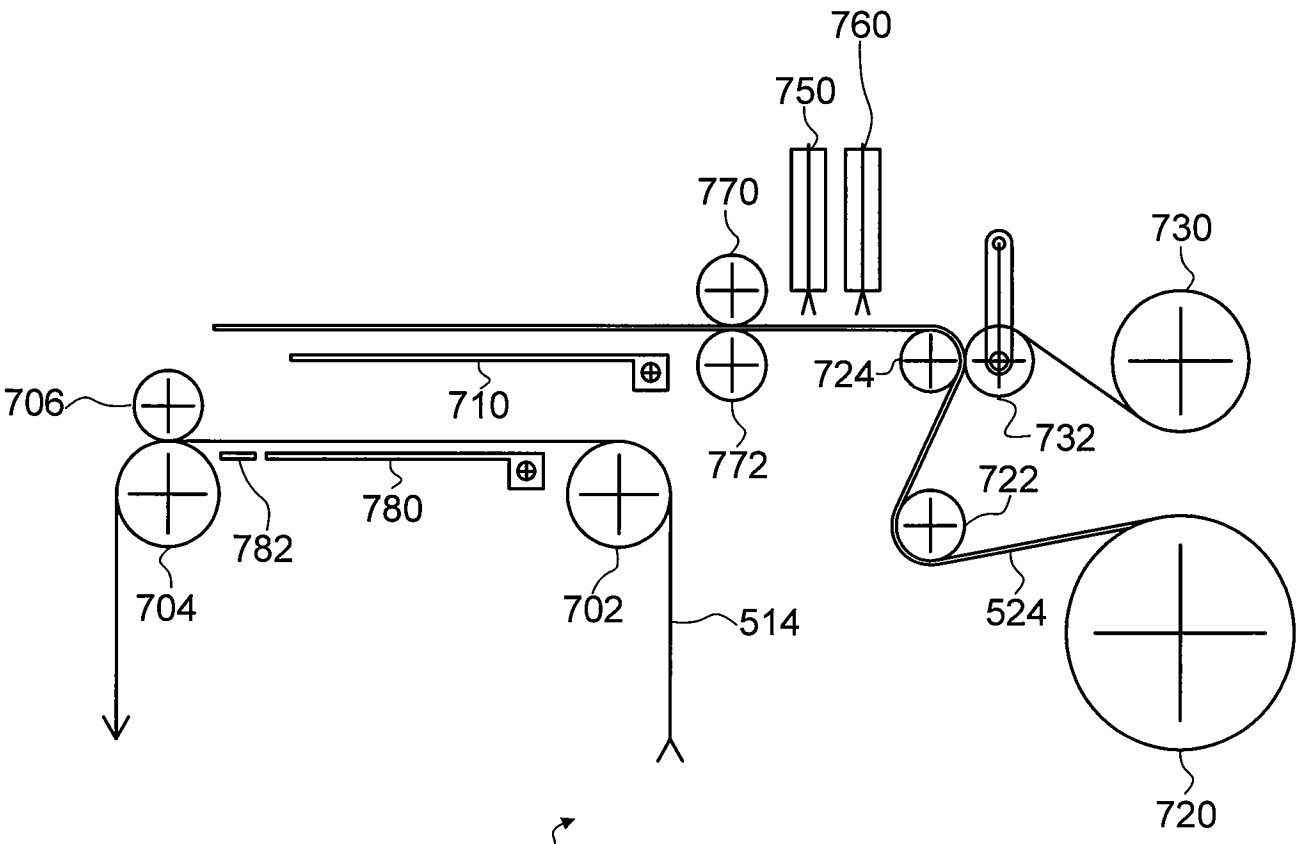
Figure 7N:
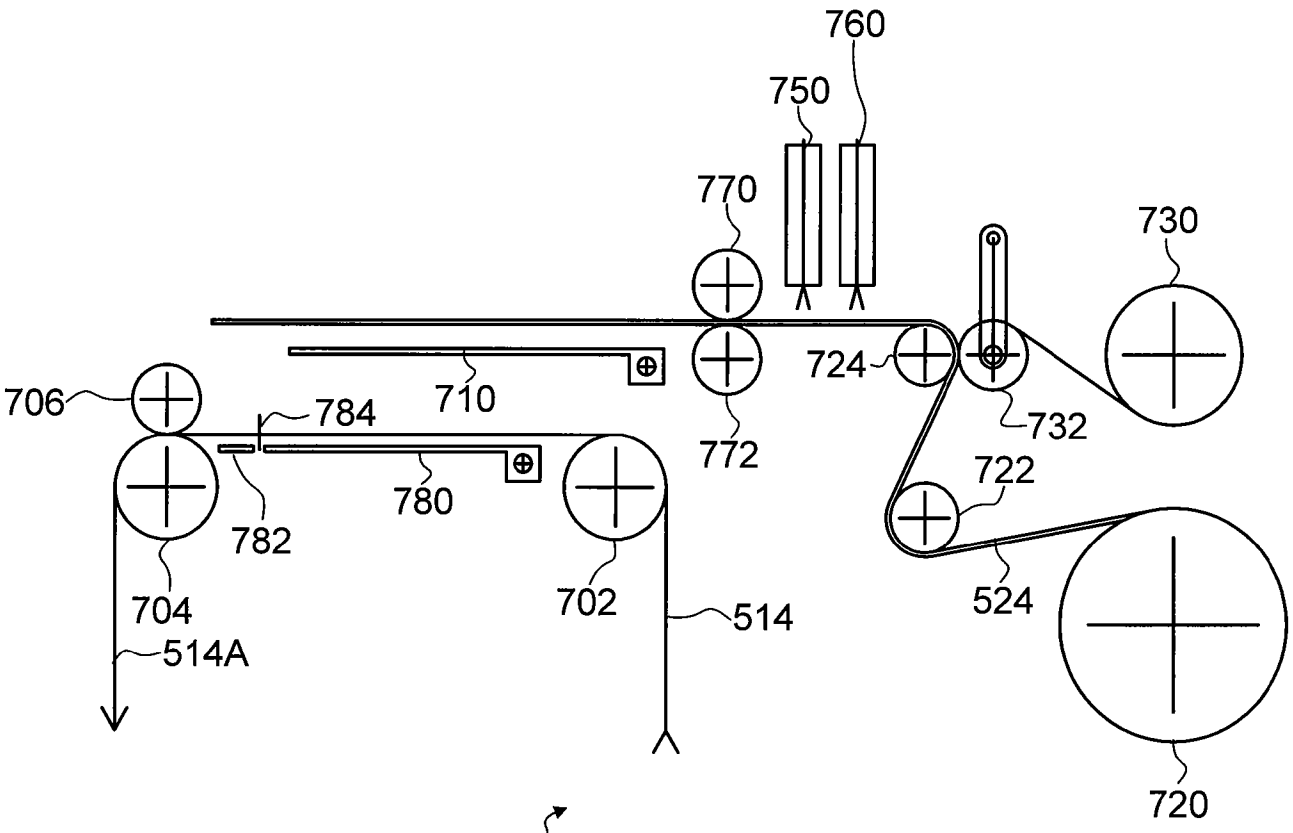
Figure 7O:
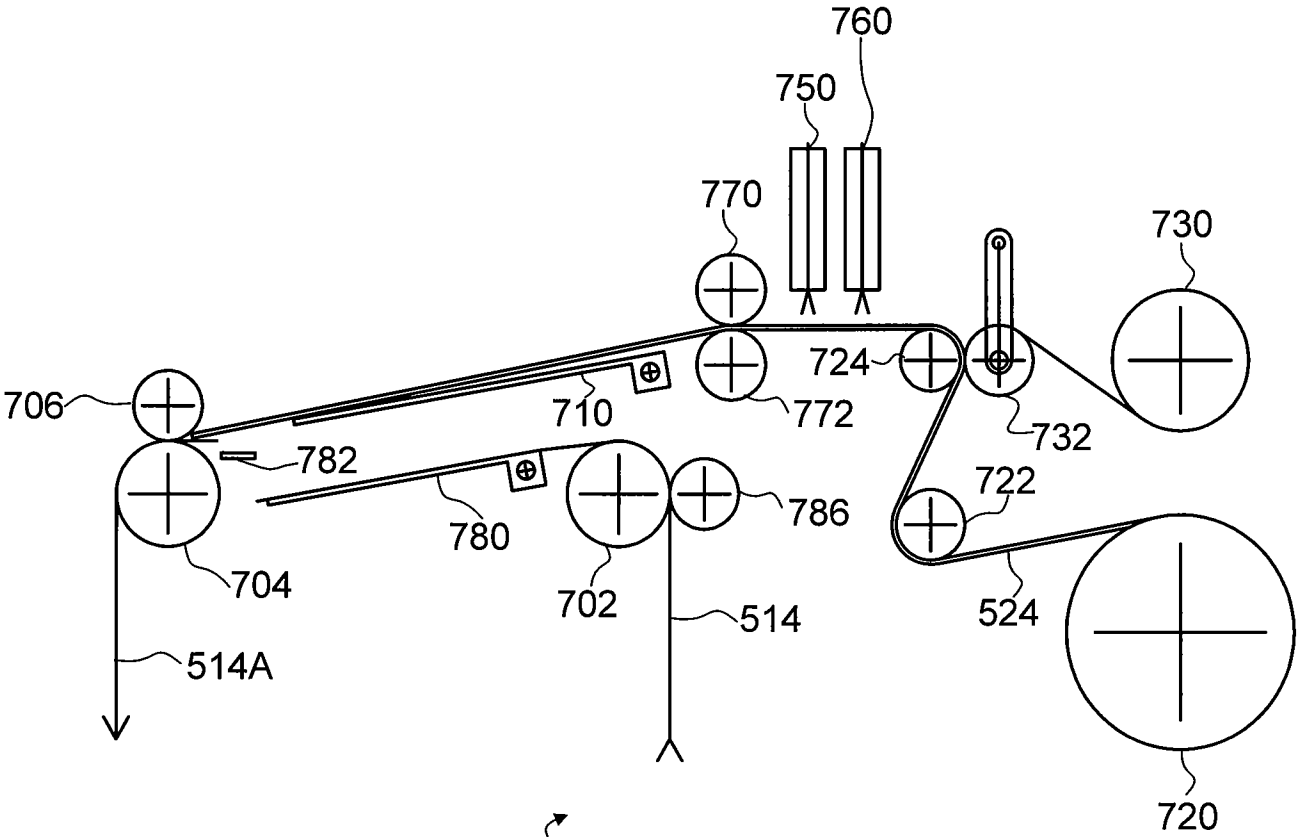
Figure 7P:
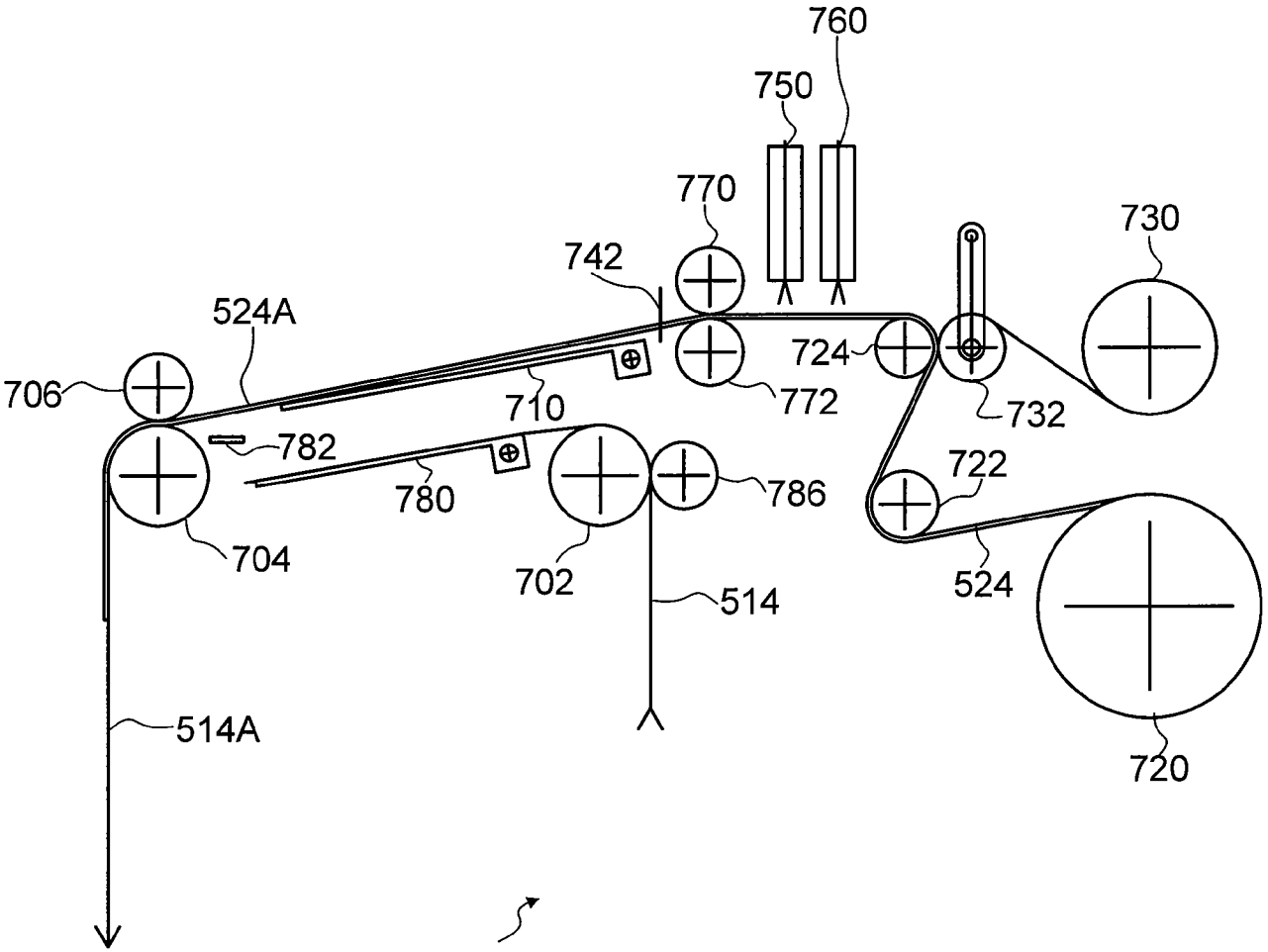
Figure 7Q:
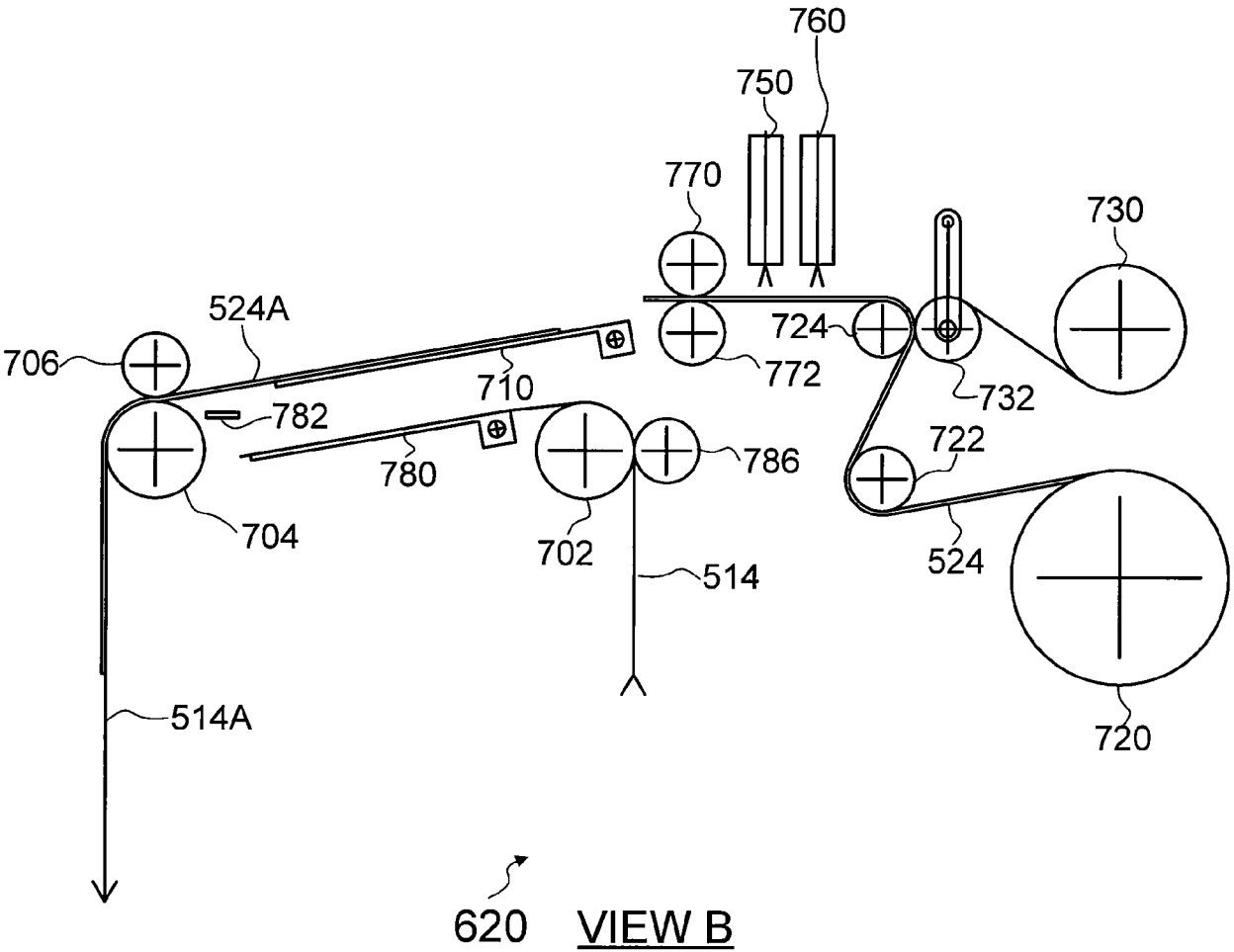
Figure 7R:
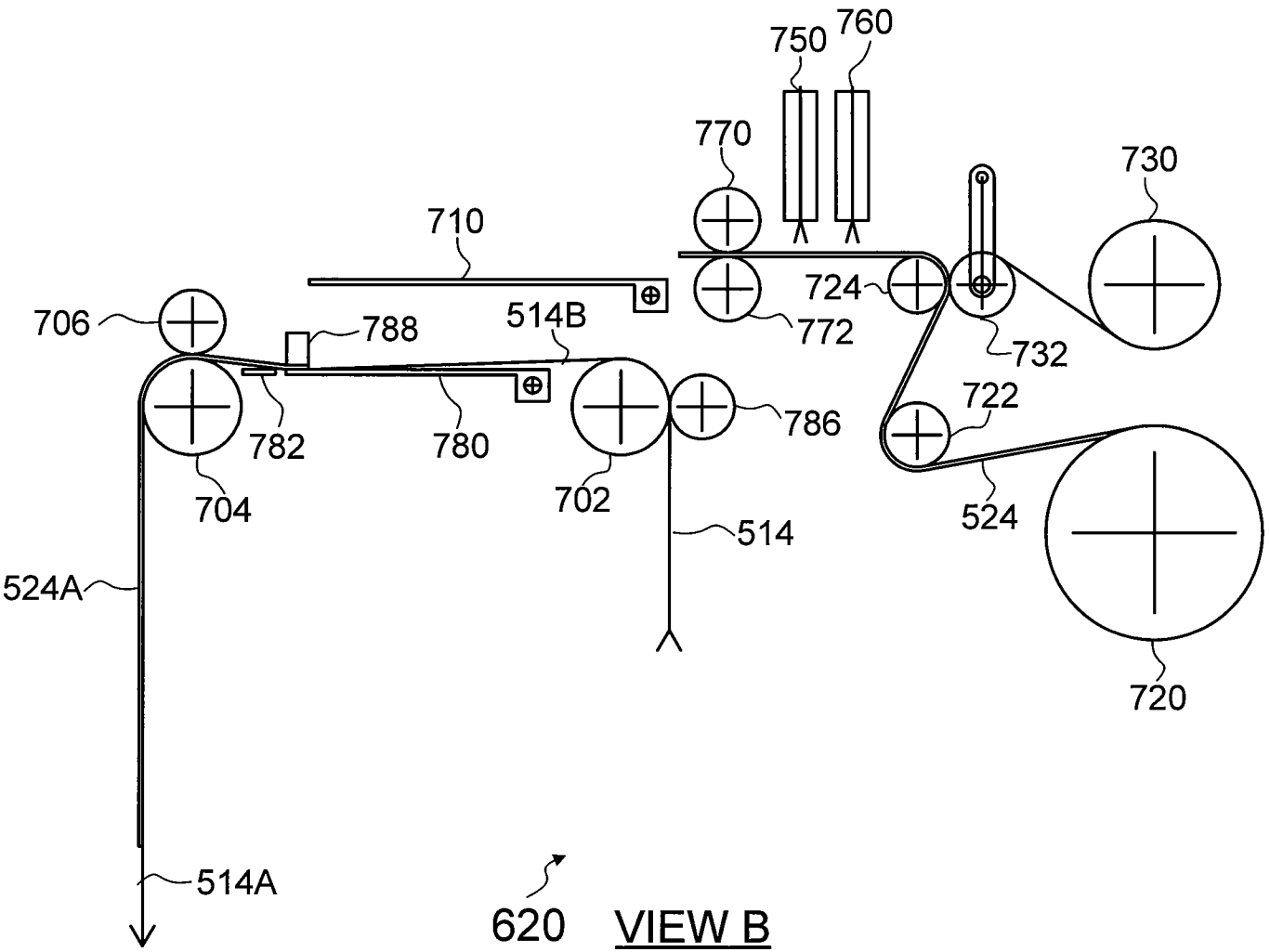
Figure 7S:
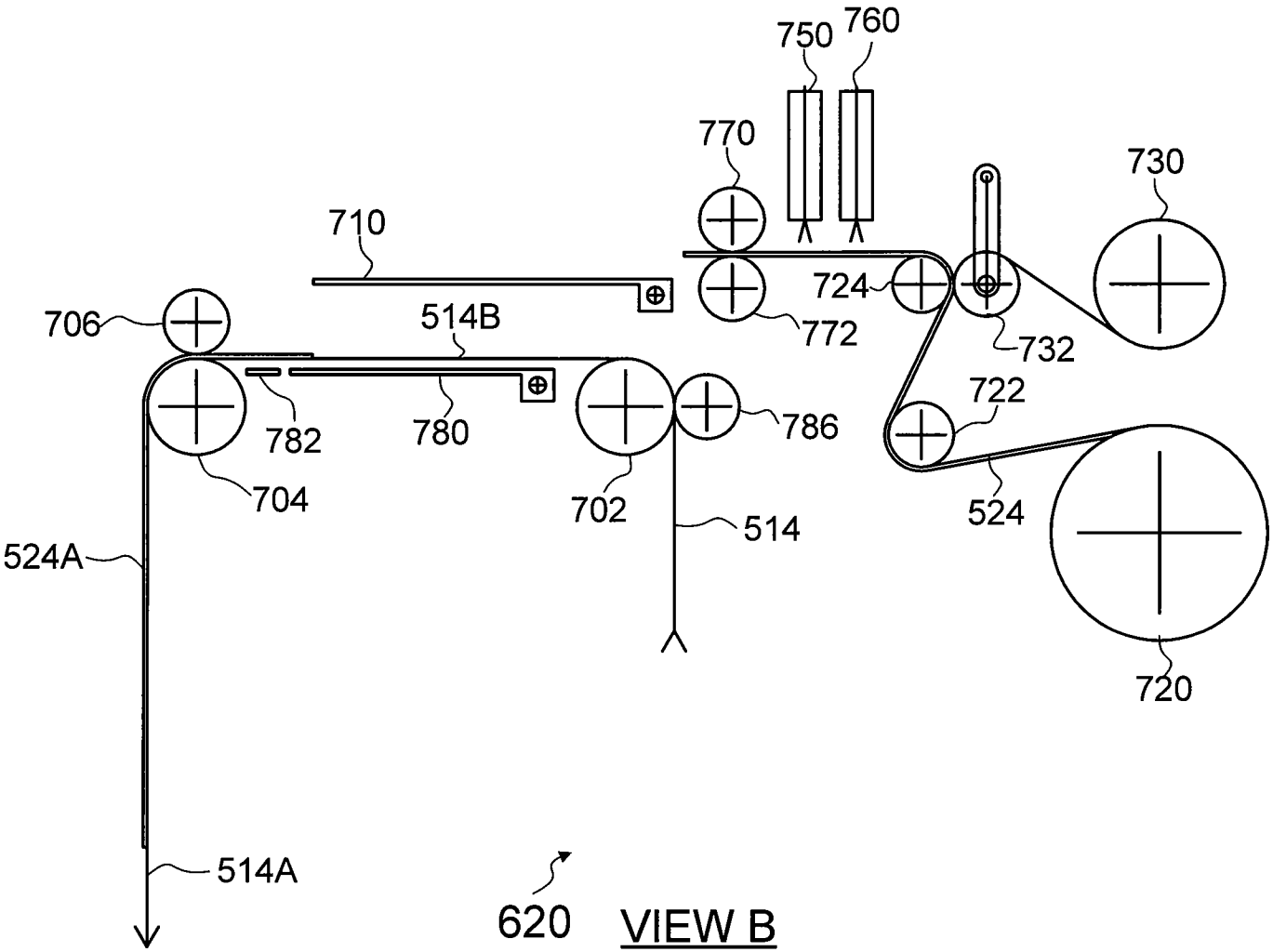
Figure 8A:
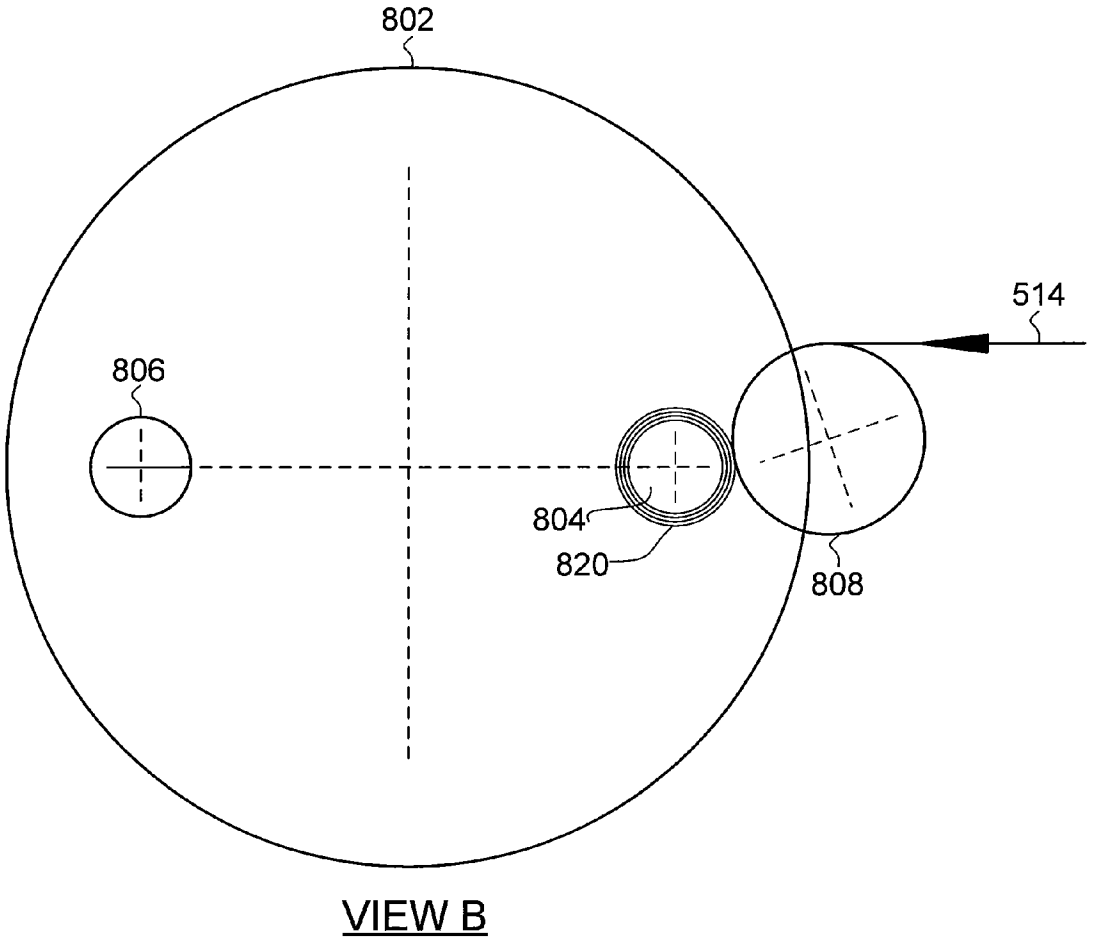
FIG. 8A-FIG. 8S show schematics of steps for producing wound web rolls with in-line cores.

More details of substrate inserter assembly 620 are shown in FIG. 7A-FIG. 7S below. More details of turret winder assembly 630 are shown in FIG. 8A-FIG. 8Q below.

FIG. 7A-FIG. 7S (View B only) show a sequence of operations in substrate inserter assembly 620. FIG. 7A-FIG. 7L show a sequence of operations for applying a core-forming substrate in parallel to a web. FIG. 7A shows a schematic of the basic setup. Web 514 is fed from roller 622 (see FIG. 6) and is fed around drive roller 702 and drive roller 704. Core-forming substrate 524 is fed from core-forming substrate supply roll 720 and is fed around roller 722 and roller 724. The free end of core-forming substrate 524 is initially held in place by clamp 740. In applications in which a non-adhesive liner is used, non-adhesive liner 534 is guided by liner peel-off roller 732 and rewound onto liner rewinder 730. In this example, non-adhesive liner is stripped away from core-forming substrate. In applications in which an adhesive is applied, glue head 750 is installed. In applications in which graphics are printed on the core-forming substrate 524, print head 760 is installed. Printing is described in further detail below with reference to FIG. 10. The functions of gripper 708, nip roller 706, and table 710 are described below. Additional components can be installed; for example, a heat source for activating thermally-activated adhesive or a heat source for fusing a core-forming substrate onto a web.

In FIG. 7B, the jaws of gripper 708 are opened and positioned around the free end of core-forming substrate 524. In FIG. 7C, the jaws of gripper 708 are closed onto the free end of core-forming substrate 524. In FIG. 7D, clamp 740 is opened. In FIG. 7E, gripper 708 pulls a user-specified length of core-forming substrate 524 over table 710. In FIG. 7F, clamp 740 closes, and cut-off knife 742 cuts off a section 524A of core-forming substrate 524. In addition to a knife, other means for cutting can be used; for example, a laser. The length of core-forming substrate 524A can be varied to produce a user-specified wall thickness of the subsequent in-line formed core. In FIG. 7G, the jaws of gripper 708 are opened. In FIG. 7H, gripper 708 is retracted, and core-forming substrate 524A lies on table 710. In FIG. 7I, table 710 is inclined to position the leading edge of core-forming substrate 524A onto web 514 at drive roller 704. Nip roller 706 is lowered to nip the leading edge of core-forming substrate 524A onto web 514. In FIG. 7J, web 514 and core-forming substrate 524A are fed through drive roller 704 and nip roller 706 to form an adhesive bond between core-forming substrate 524A and web 514. Core-forming substrate 524A is attached in parallel to web 514.

FIG. 7K and FIG. 7L show an alternate feeding mechanism for the core-forming substrate 524. Refer to FIG. 7K. Instead of the gripper 708 and clamp 740 shown in FIG. 7A, the free end of core-forming substrate 524 is gripped by nipped drive rollers 770 and 772. In FIG. 7L, nipped drive rollers 770 and 772 feed a user-specified length of core-forming substrate 524 over table 710. A section 524A of core-forming substrate 524 is cut off (not shown), and the process then continues as in FIG. 7I and FIG. 7J.

FIG. 7M-FIG. 7S show a sequence of operations for applying a core-forming substrate in series with a web. The basic setup is shown in FIG. 7M. Components common to FIG. 7A-FIG. 7L are labelled the same. Core-forming substrate 524 is fed by nipped drive rollers 770 and 772. Web 514 is fed by drive roller 704 and nip roller 706. Web 514 is supported by hinged table 780 and fixed table 782.

In FIG. 7N, cut-off knife 784 cuts a section 514A from web 514. Fixed table 782 helps support web 514A during and after the cutting operation. In FIG. 7O, table 780 is inclined to provide clearance, and web 514 is held against drive roller 702 by nip roller 786. Table 710 is inclined, and the leading edge of core-forming substrate 524 is fed onto the trailing edge of web 514A between drive roller 704 and nip roller 706. Fixed table 782 helps direct the leading edge of core-forming substrate 524 into the proper position. In FIG. 7P, cut-off knife 742 cuts a section 524A from core-forming substrate 524. The length of core-forming substrate 524A can be varied to produce a user-specified wall thickness of the subsequent in-line formed core.

In FIG. 7Q, core-forming substrate 524A continues to be fed through drive roller 704 and nip roller 706. In FIG. 7R, table 710 and table 780 are returned to horizontal. The trailing edge of core-forming substrate 524A is positioned on top of the leading edge of web 514B (new section) and clamped by clamp 788 to form an adhesive bond. Fixed table 782 helps support the trailing edge of core-forming substrate 524A during the bonding operation. In FIG. 7S, clamp 788 is released. Core-forming substrate 524A is thus attached in series to web 514A and web 514B.

In the configuration of the substrate inserter assembly 620 shown in FIG. 7A-FIG. 7S, the core-forming substrate is fed along the longitudinal axis of the web. In another configuration, the core-forming substrate is fed along the transverse axis.

Figure 8B:
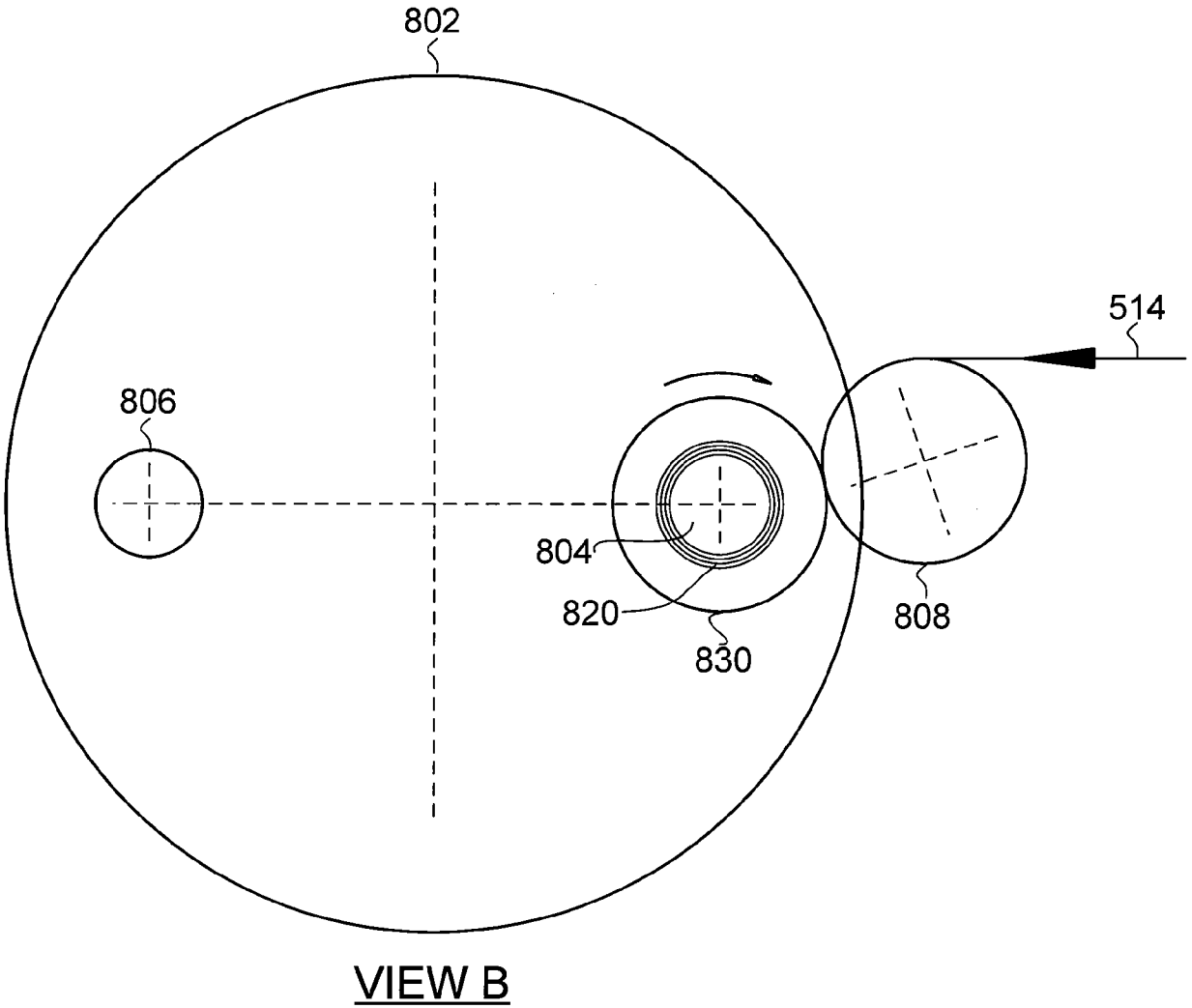
Figure 8C:
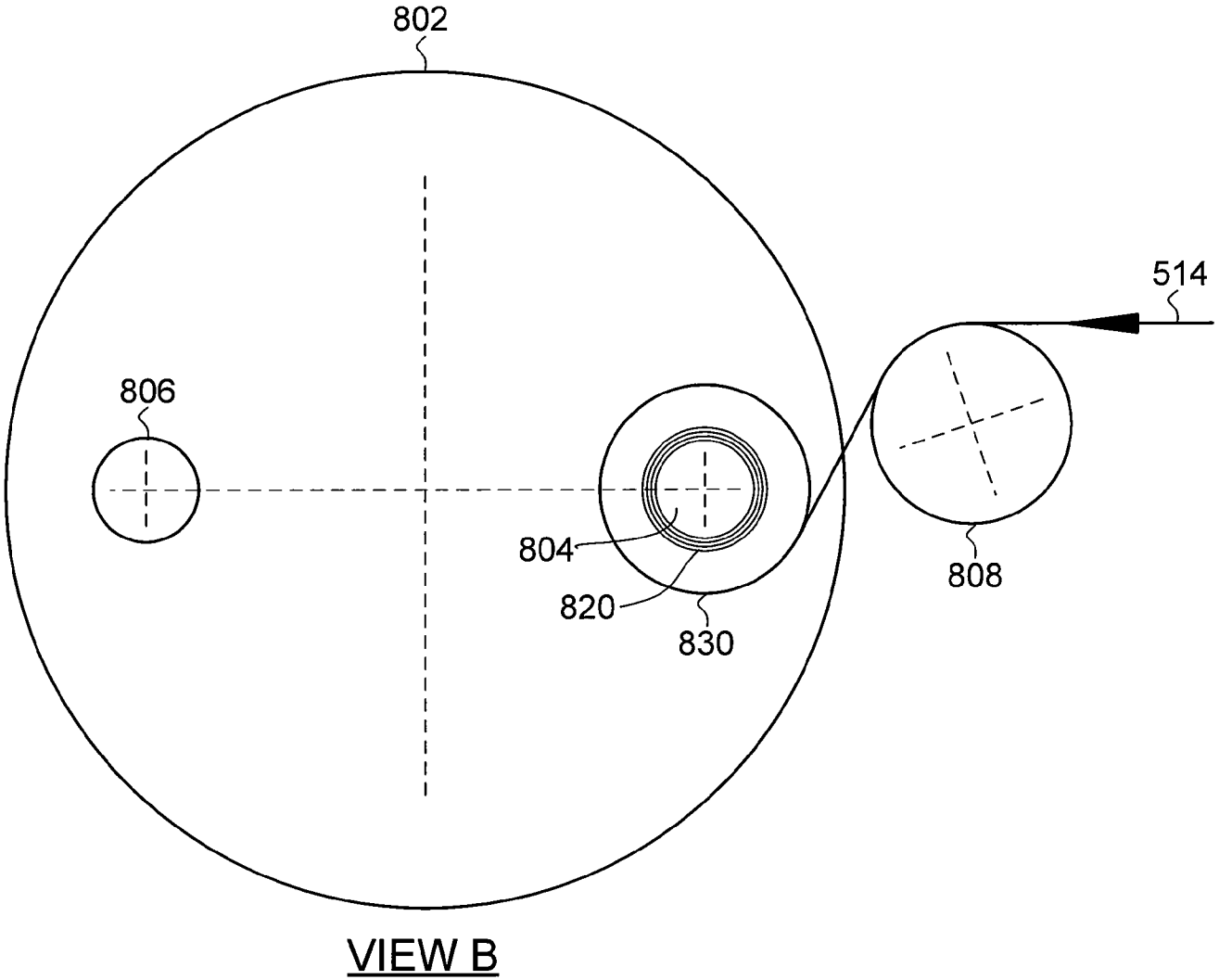
Figure 8D:
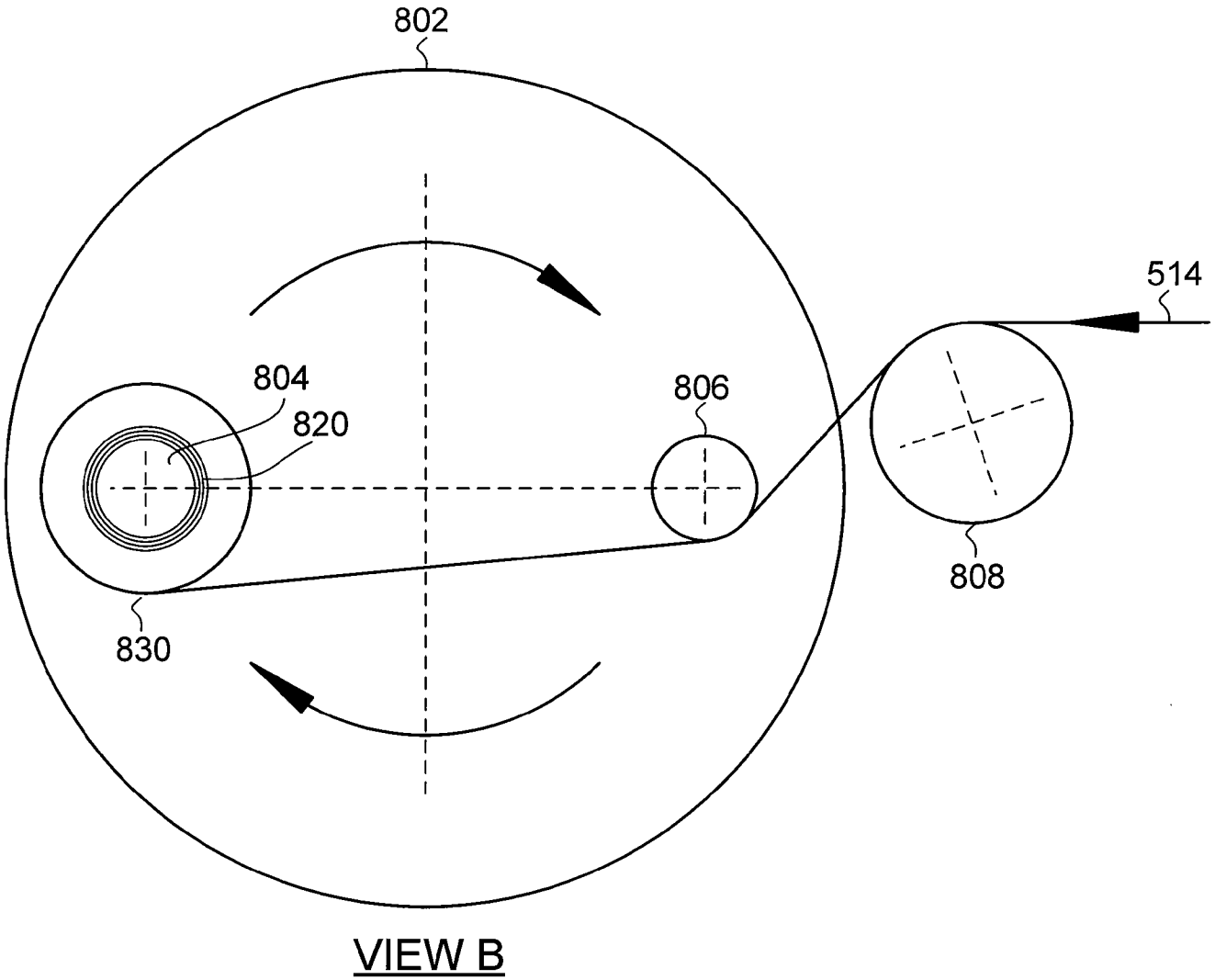
Figure 8E:
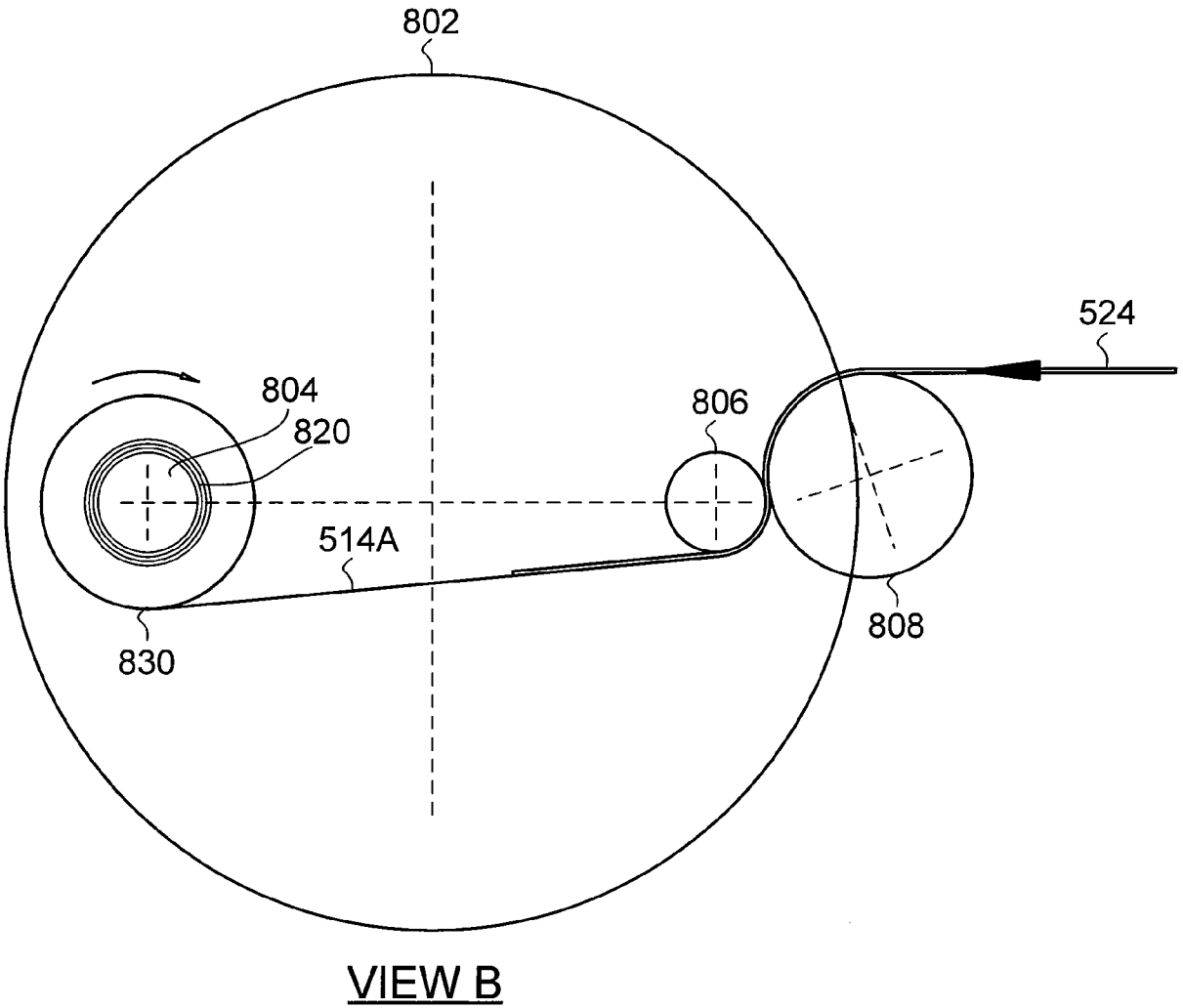
Figure 8F:
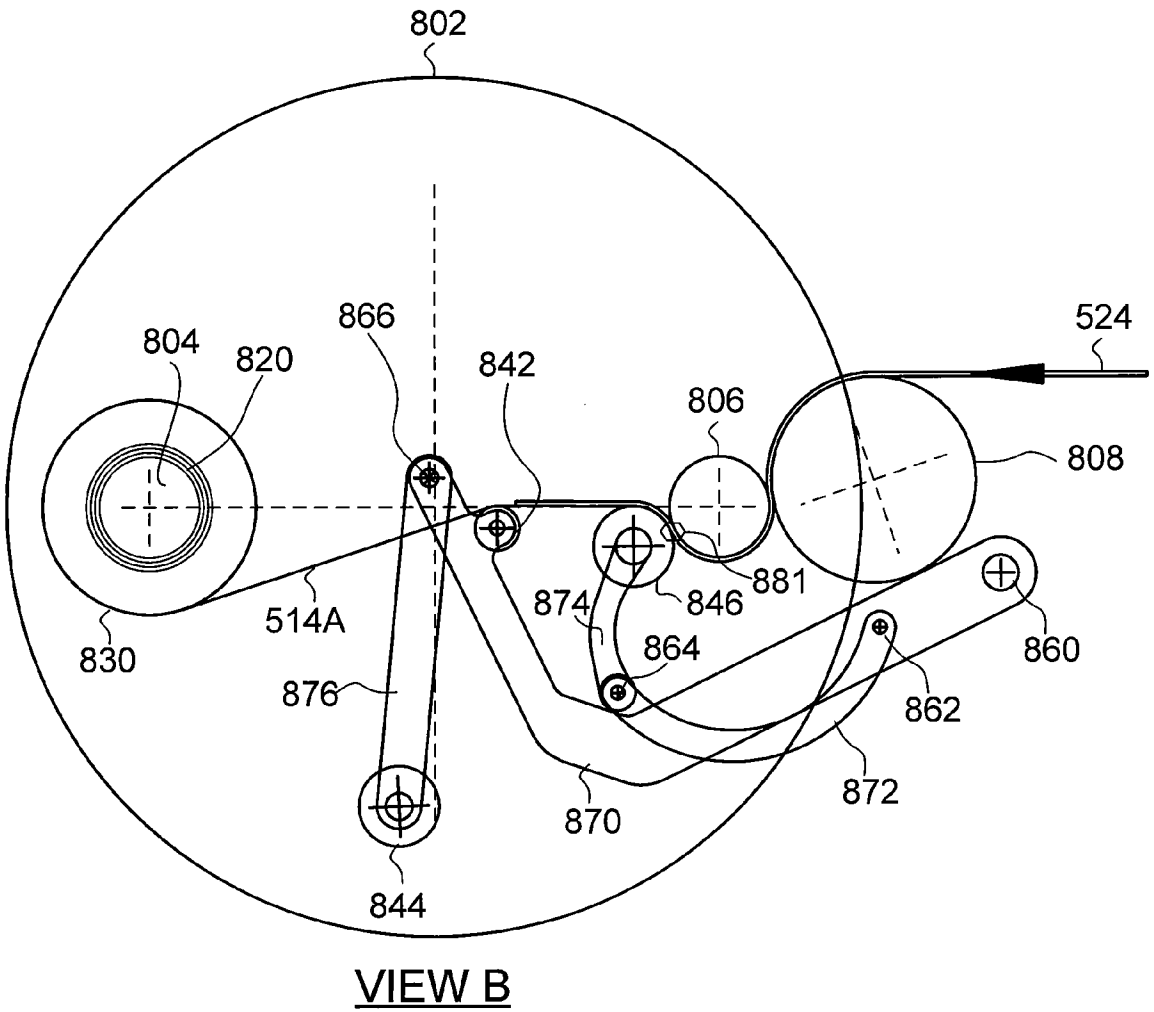
Figure 8G:
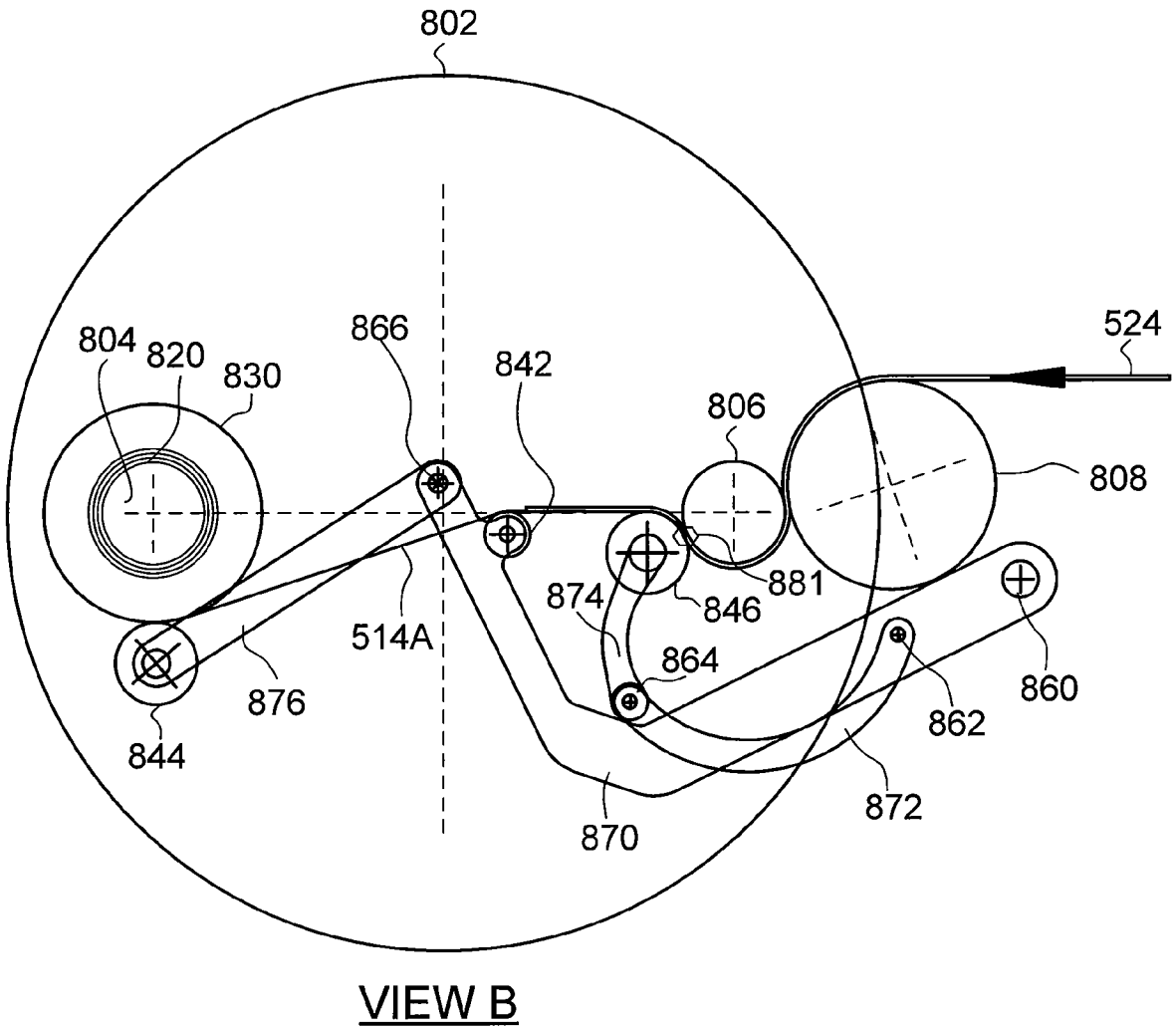
Figure 8H:
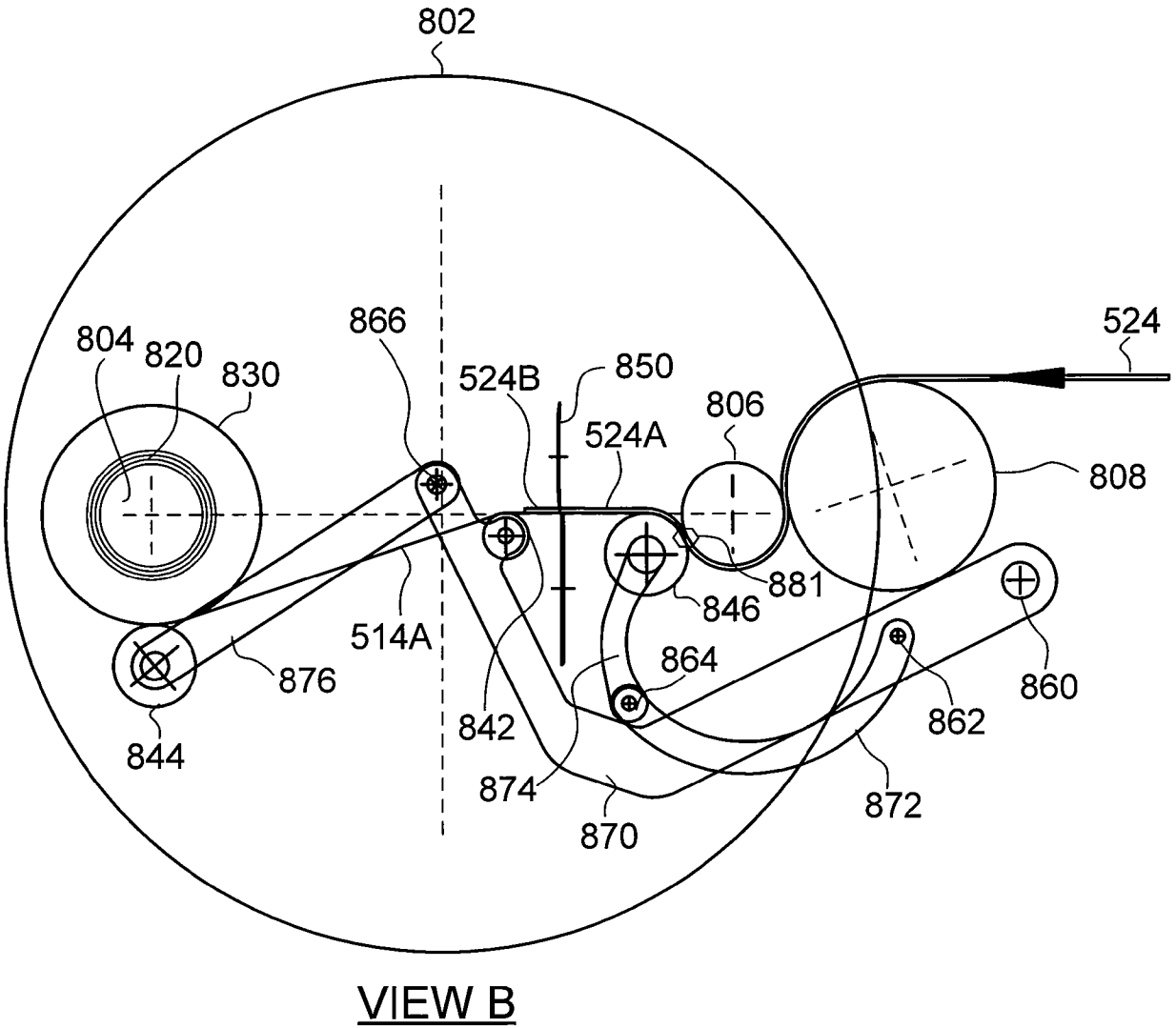
Figure 8I:
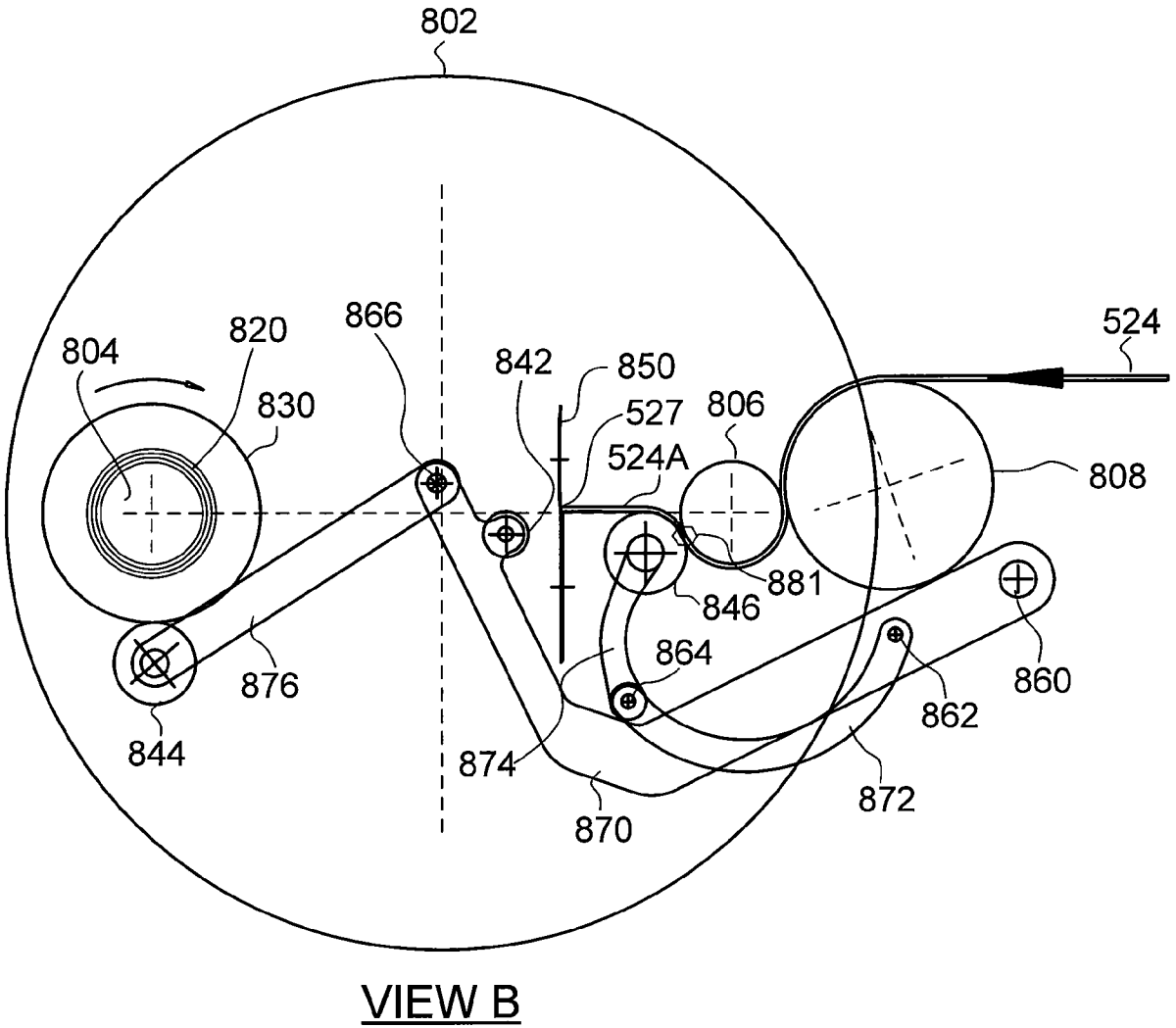
Figure 8J:
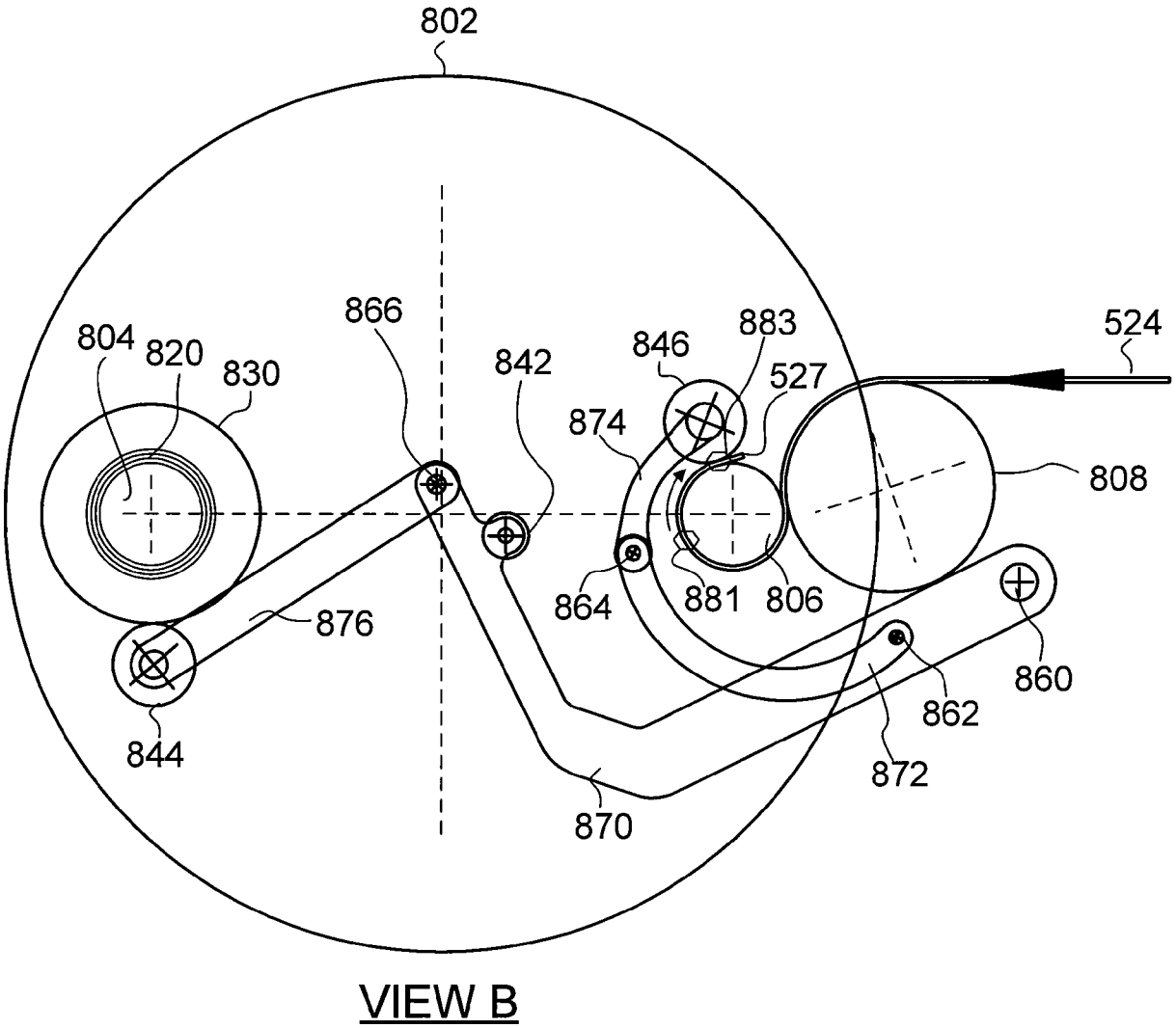
Figure 8K:
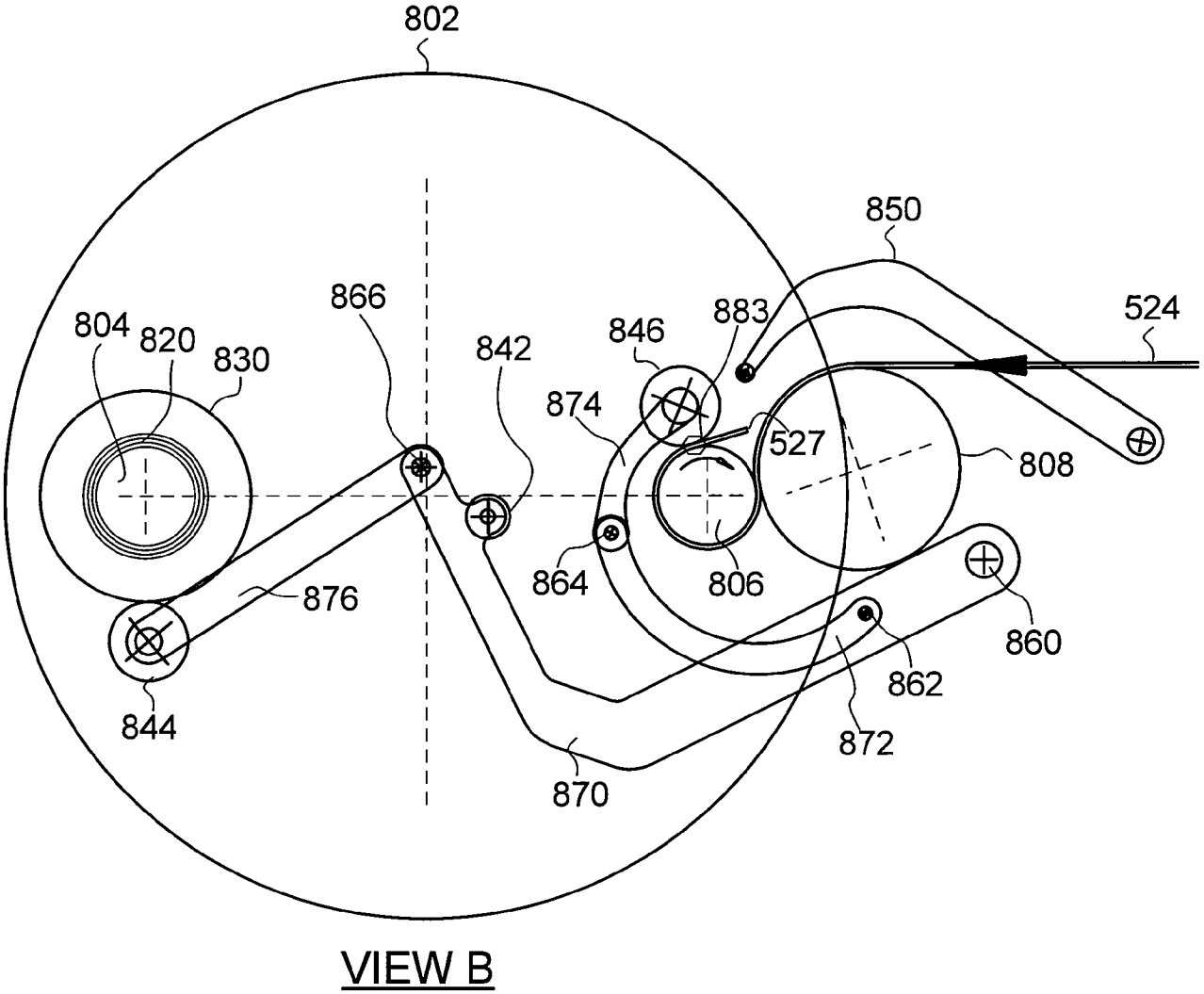
Figure 8L:
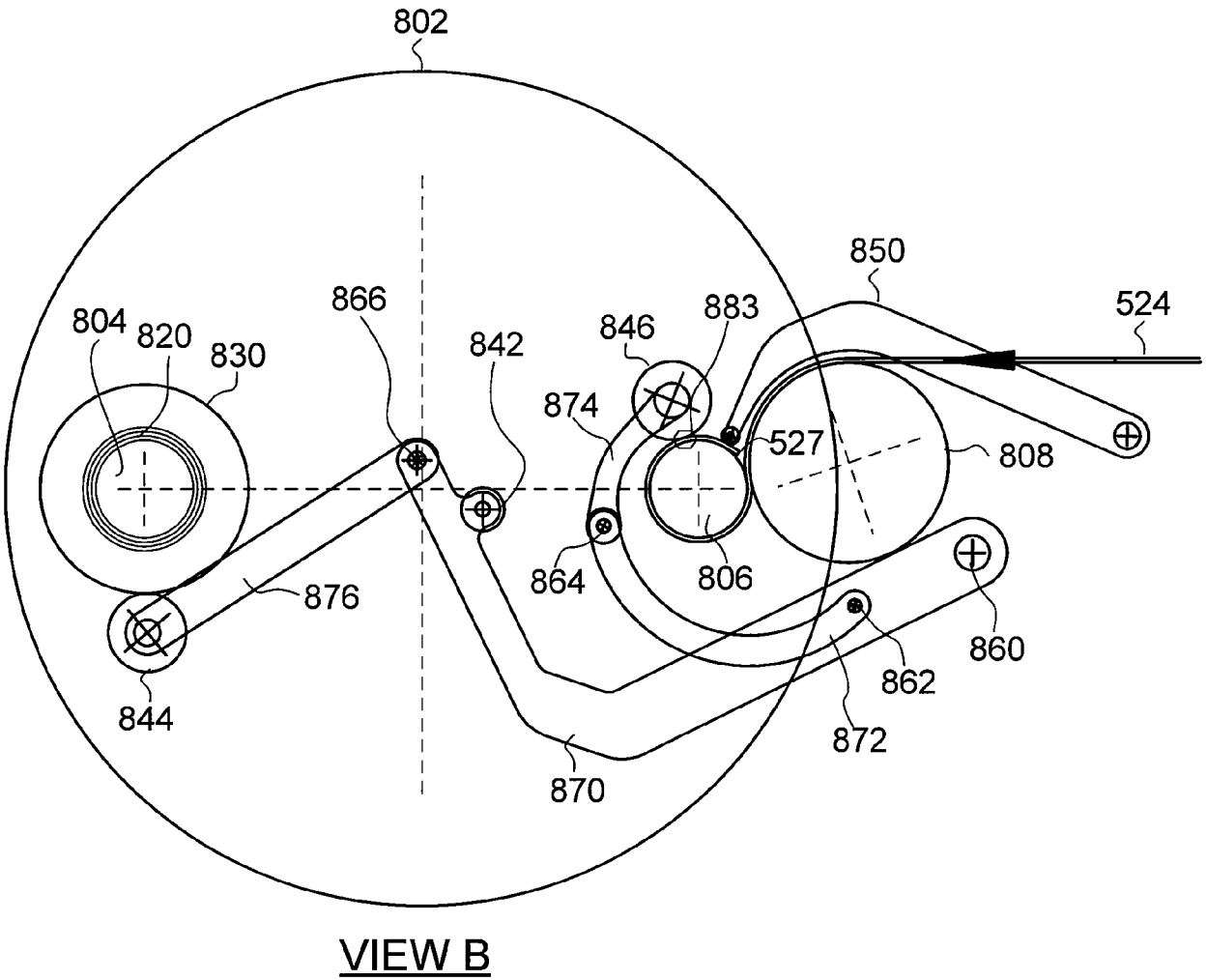
Figure 8M:
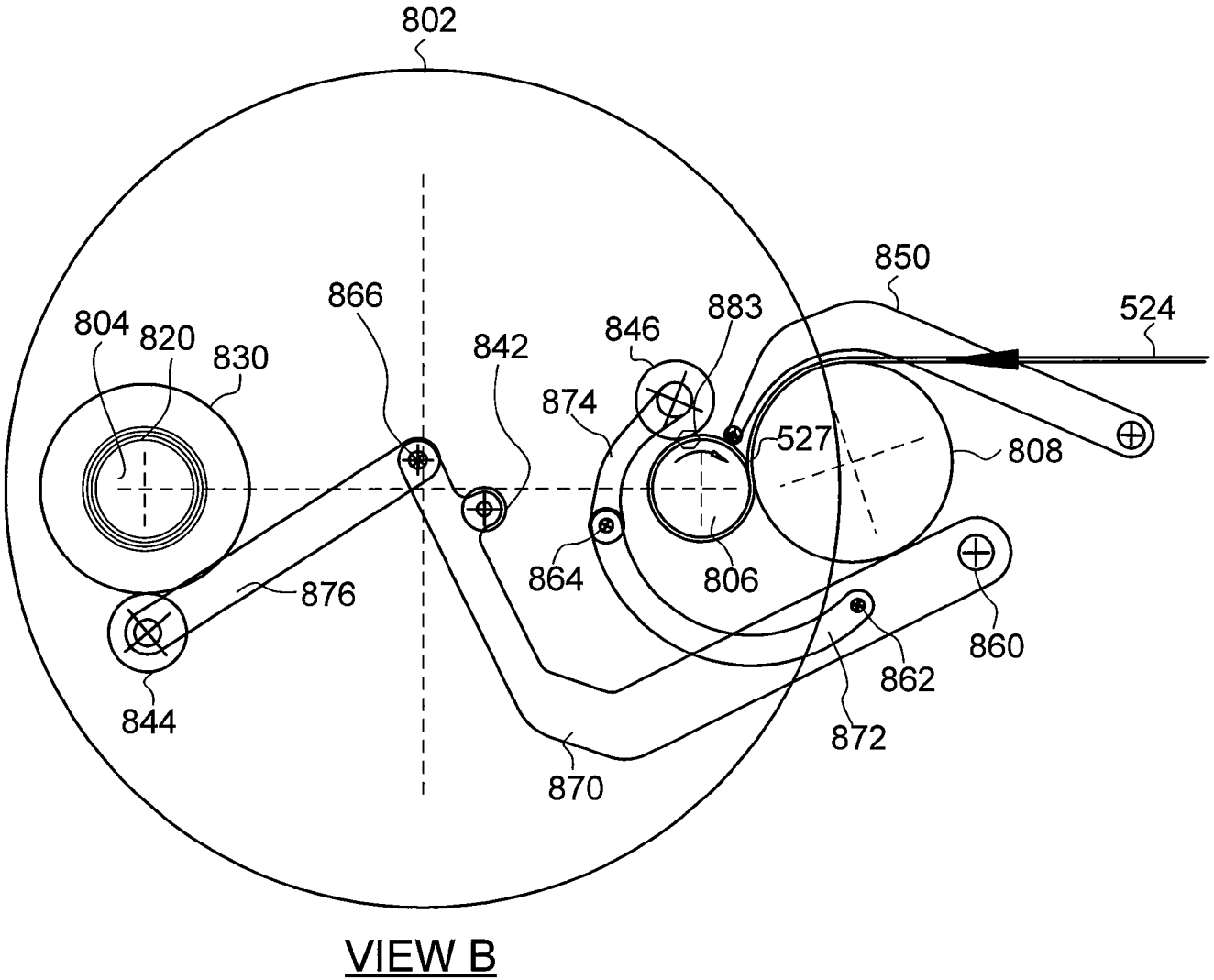
Figure 8N:
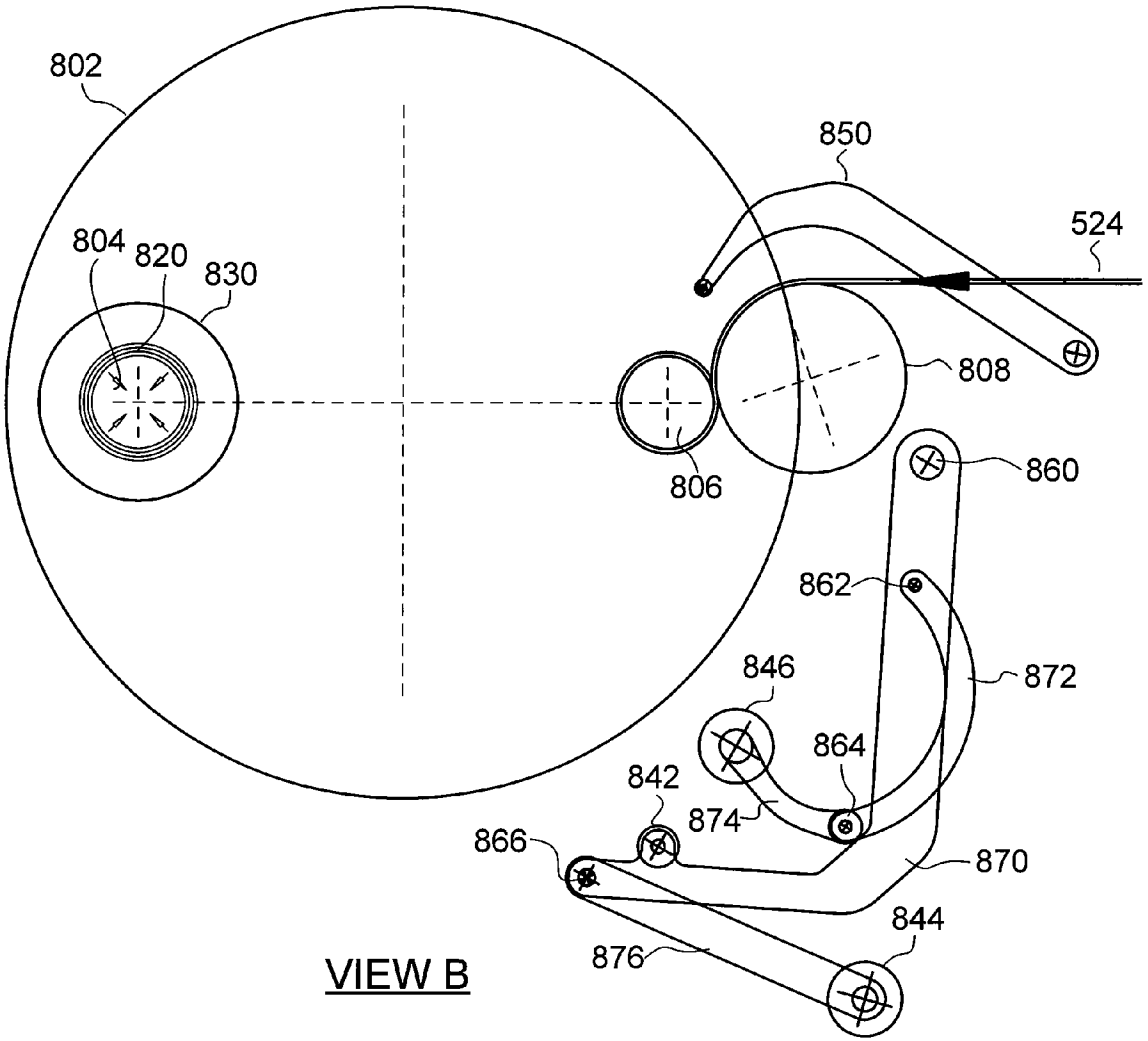
Figure 8O:
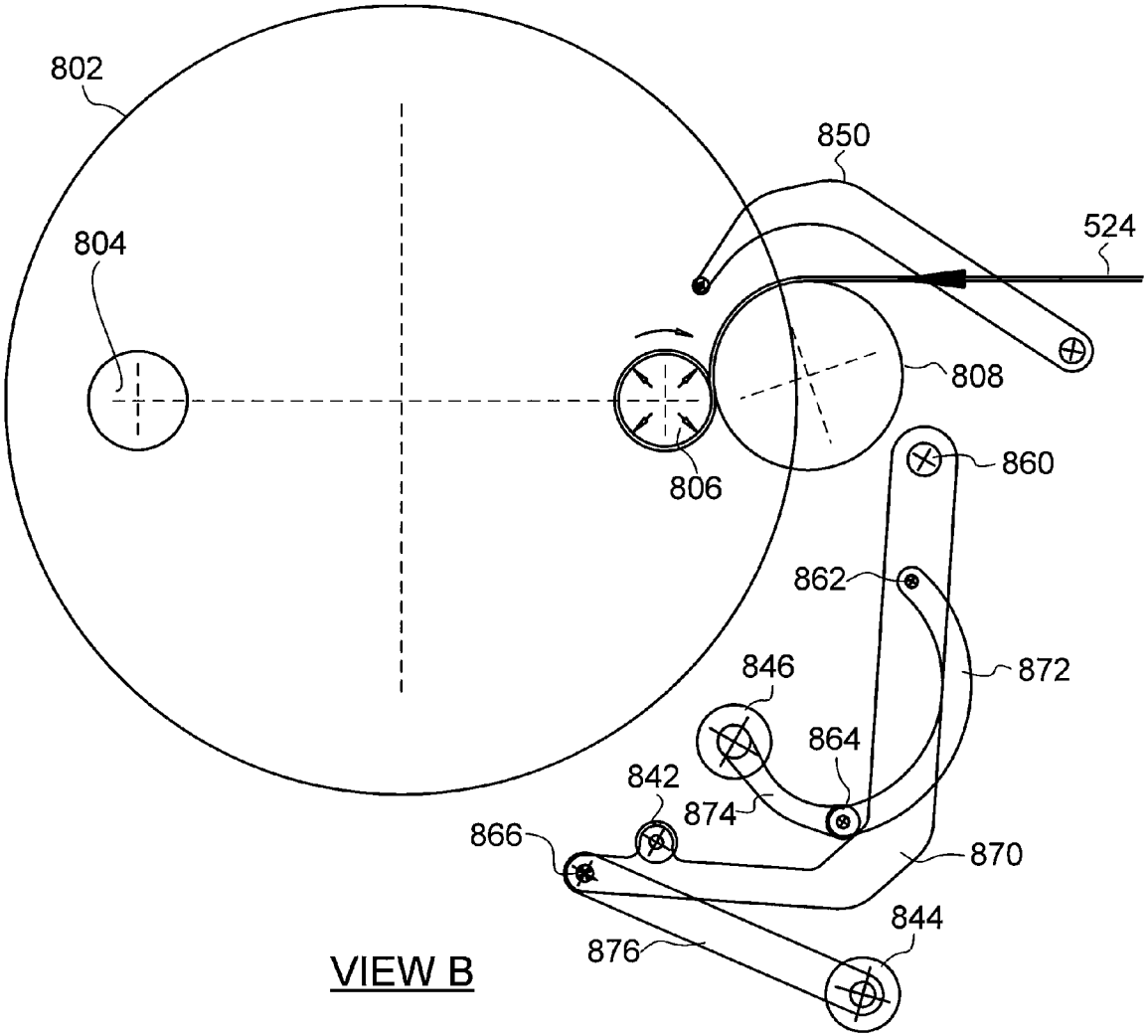
Figure 8P:
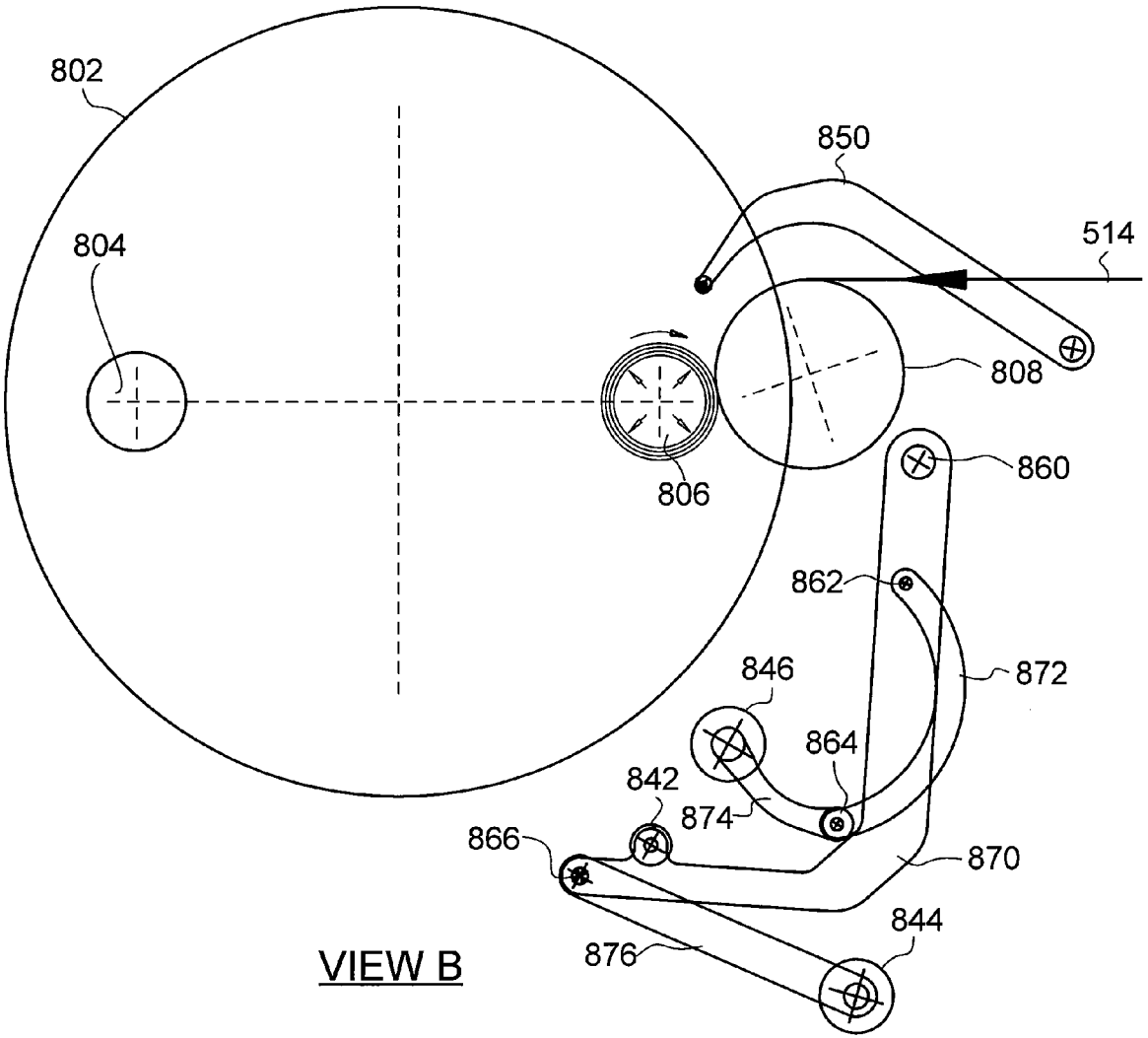
Figure 8Q:
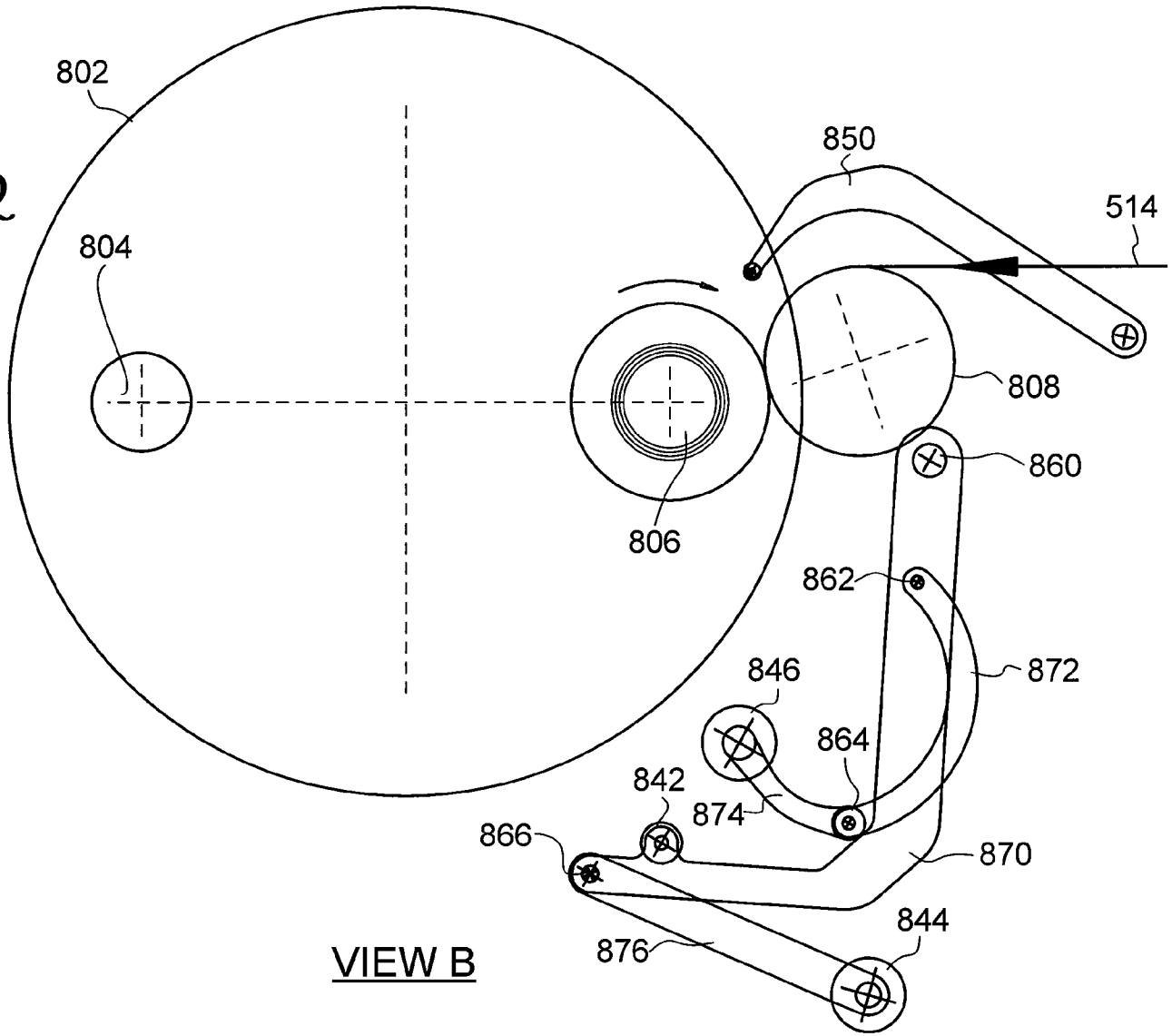
Figure 8S:
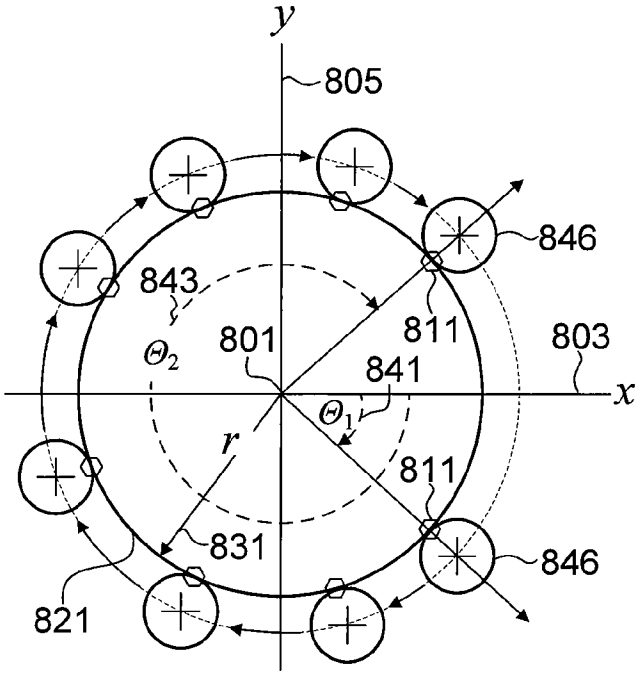
Figure 8R:
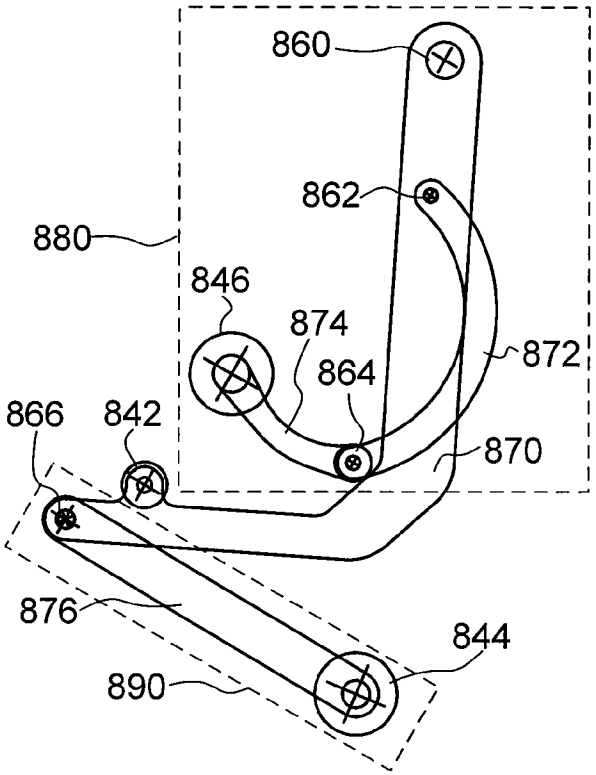

FIG. 8A-FIG. 8R (View B only) show a sequence of operations in turret winder assembly 630 (see FIG. 6). FIG. 8A shows a turret 802 on which are mounted two mandrels: mandrel 806 and mandrel 804. As discussed below, the diameter of a mandrel can increase and decrease. For example, a mandrel can contain an air bladder that can be inflated to increase the diameter and deflated to decrease the diameter. Other means for increasing and decreasing the diameter can be used. At this stage, mandrel 806 is bare, and an in-line core 820 (formed from a core-forming substrate) has been wound on mandrel 804. The process for forming in-line core 820 is described in detail below. Web 514 is fed from roller assembly 636 (see FIG. 6). Lay-on roller 808 nips web 514 to in-line core 820.

In FIG. 8B, mandrel 804 rotates. A user-specified length of web 514 is wound onto in-line core 820 to produce wound web roll 830. In FIG. 8C, lay-on roller 808 retracts. In FIG. 8D, turret 802 is indexed 180 degrees clockwise. Wound web roll 830 is transferred to the unload position, and mandrel 806 is transferred to the wind position. In FIG. 8E, core-forming substrate 524 is fed from roller assembly 636 (as described above, substrate inserter module 604 feeds a continuous sequence of core-forming substrate/web/core-forming substrate/web . . . to winder module 606). Lay-on roller 808 nips core-forming substrate 524 to mandrel 806. Winding of web 514A (a segment of web 514) resumes until core-forming substrate 524 advances to a user-specified position.

In FIG. 8F, support arm 870 is swung around articulated joint 860 into operational position. Articulated joint 860 is coupled to a support infrastructure (not shown). Refer to FIG. 8R. Enveloper assembly 880 includes support arm 870, support arm 872 coupled to support arm 870 by articulated joint 862, support arm 874 coupled to support arm 872 by articulated joint 864, and enveloper roller 846 coupled to support arm 874. Also coupled to support arm 870 are wipedown assembly 890 and web support bar 842. Wipedown assembly 890 includes support arm 876 coupled to support arm 870 by articulated joint 866 and wipedown roller 844 coupled to support arm 876. To simplify the drawings, in FIG. 8F-FIG. 8Q, the dashed rectangle representing enveloper assembly 880 and the dashed rectangle representing wipedown assembly 890 are not shown; however, the individual components of enveloper assembly 880 and wipedown assembly 890 are called out.

In FIG. 8F, enveloper roller 846 nips core-forming substrate 524 against mandrel 806 at nip position 881. In FIG. 8G, wipedown roller 844 nips against wound web roll 830. In FIG. 8H, cut-off knife 850 severs core-forming substrate 524 at a user-specified position into segment 524A and segment 524B. If a pull tab or sealing tab (see FIG. 9A and FIG. 9B) is desired, a segment 524B of core-forming substrate is left attached to the trailing edge of web 514A. If a pull tab or sealing tab is not desired, cut-off knife 850 severs core-forming substrate 524 at the leading edge of core-forming substrate 524 (no segment 524B). In FIG. 8I, web 514A and segment 524B are wound onto wound web roll 830, which is now completely finished. Leading edge 527 is now the new leading edge of core-forming substrate 524.

In FIG. 8J, enveloper roller 846 sweeps core-forming substrate 524 around mandrel 806. Enveloper roller 846 nips core-forming 524 against mandrel 806; the nip position follows the surface of mandrel 806 from nip position 881 to nip position 883. In FIG. 8K, mandrel 806 rotates until a user-specified length of core-forming substrate 524 is wound for the tucking operation. Tail tucker 850 is brought into position. In FIG. 8L, tail tucker 850 nips core-forming substrate 524 against mandrel 806 in close proximity to lay-on roller 808. In FIG. 8M, mandrel 806 rotates, and leading edge 527 of core-forming substrate 524 is guided into the nip between mandrel 806 and lay-on roller 808. For large diameter cores, a double-jointed tail tucker can be used (see description below in reference to FIG. 13N).

In FIG. 8N, tail tucker 850 and support arm 870 retract from their operational positions. Mandrel 804 deflates to allow wound web roll 830 to be removed. In FIG. 8O, wound web roll 830 has been removed, and mandrel 804 is now bare. Mandrel 806 expands to hold core-forming substrate 524 as winding begins, and a new in-line core is started. In FIG. 8P, core forming is complete when the trailing edge of core-forming substrate 524 is wound onto mandrel 806. A pre-attached leading edge of web 514 follows and roll formation begins. This is the stage previously shown in FIG. 8A with mandrel 804 as the winding mandrel. In FIG. 8Q, the winding process continues until the desired roll size is achieved. This is the stage previously shown in FIG. 8B with mandrel 804 as the winding mandrel. The sequence described above then repeats.

Figure 10:
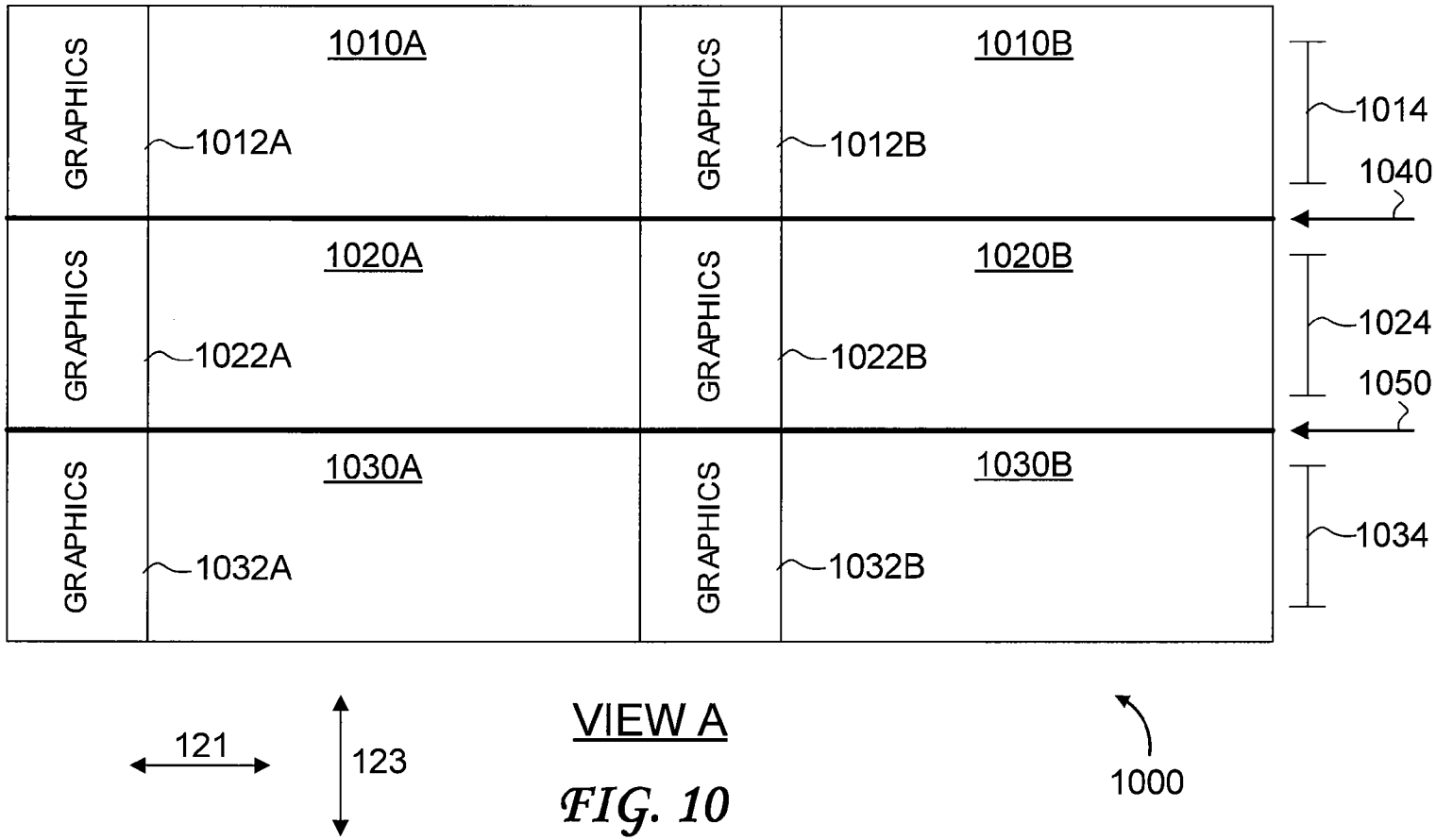
FIG. 10 shows strips of web segments and core-forming substrate segments with graphics imprinted on the core-forming substrate segments.

In the example shown in FIG. 8A-FIG. 8Q, a single wound web roll was produced on a single mandrel. In general, multiple web rolls can be produced in parallel on a single mandrel. FIG. 10 shows a section of a composite substrate-web stream 1000 which has been slit along longitudinal slit line 1040 and longitudinal slit line 1050 to produce three composite substrate-web stream strips: composite substrate-web stream strip 1014, composite substrate-web stream strip 1024, and composite substrate-web stream strip 1034. Each composite substrate-web stream strip comprises an alternating sequence of attached core-forming substrate segment strips and web segment strips. Composite substrate-web stream strip 1014 includes core-forming substrate segment strip 1012A, web segment strip 1010A, core-forming substrate segment strip 1012B, and web segment strip 1010B. Composite substrate-web stream strip 1024 includes core-forming substrate segment strip 1022A, web segment strip 1020A, core-forming substrate segment strip 1022B, and web segment strip 1000B. Composite substrate-web stream strip 1034 includes core-forming substrate segment strip 1032A, web segment strip 1030A, core-forming substrate segment strip 1032B, and web segment strip 1030B. In general, the number of composite substrate-web stream strips that can be slit from a single composite substrate-web stream is user-specified.

Multiple wound web rolls can be produced in parallel on a single mandrel in a single turret winder assembly 630 (see FIG. 6). A composite substrate-web stream 524/514 is received by winder module 606 from substrate inserter module 604. Composite substrate-web stream 524/514 is fed by roller system 636, details of which are not discussed. Slitting knife 650 can be brought into position to slit composite substrate-web stream 524/514 into two composite substrate-web stream strips. In general, multiple slitting knives can be used in parallel to slit a composite substrate-web stream into a user-specified number of composite substrate-web stream strips. In addition to a slitting knife, other means for slitting can be used; for example, a laser. In general, the slitting operation can be performed at a user-specified position after the substrate insertion operation and before the winding operation.

Refer to FIG. 8A-FIG. 8Q. Multiple composite substrate-web stream strips can be wound in parallel on a single mandrel. Enveloper roller 846 can be a single full-width roller that processes multiple composite substrate-web stream strips; multiple shorter enveloper rollers mounted on a common axis can also be used. Similarly, tail tucker 850 can have a single roller or multiple rollers mounted at the end of a single pair of arms.

In one configuration, winder module 606 can outfitted with a single turret winder assembly, such as turret winder assembly 630 (simplex mode). All composite substrate-web stream strips are processed in parallel on mandrel 804 and mandrel 806 (see FIG. 8A). In the configuration shown in FIG. 6, winder module 606 is outfitted with dual turret winder assemblies (duplex mode). Turret winding assembly 630 and turret winding assembly 640 are duplicates. In duplex mode, multiple composite substrate-web stream strips are fed alternately to turret winding assembly 630 and turret winding assembly 640. For example, assume that composite substrate-web stream 524/514 is slit into four composite substrate-web stream strips, labelled strip 1, strip 2, strip 3, strip 4. Then strip 1 and strip 3 are fed to turret winding assembly 630, and strip 2 and strip 4 are fed to turret winding assembly 640. In the simplex mode, the multiple strips loaded onto a single mandrel are close together. In some instances, one strip can interfere with the winding of an adjacent strip (for example, if they rub against each other). In the duplex mode, the multiple strips loaded onto a single mandrel are spaced further apart.

As discussed above, auxiliary operations such as printing can be performed during the substrate insertion operation in substrate inserter module 604. In FIG. 10, graphics, including text and images are applied to the core-forming substrate segment strips (1012A, 1012B, 1022A, 1022B, 1032A, and 1032B). Examples of graphics include manufacturer's name and logo, product name, product identification number, lot number, manufacturing date, and bar code. In the finished in-line core, the graphics would be visible on the inner surface (surface 1120 in FIG. 11E). The graphics can be applied by printing directly onto the core-forming substrate via a print head (such as print head 760 in FIG. 7A). Graphics can also be applied by other means; for example, sticking a printed label onto a core-forming substrate.

The description above focussed on methods and apparatus for winding a core-forming substrate into an in-line core and winding a web, pre-attached to the core-forming substrate, around the in-line core. In particular, streaming operation was described in detail. Embodiments of methods and apparatus for streaming operation can also be used for streaming operation of winding webs onto separate pre-formed cores (such as conventional cores used in the industry). In some prior art processes, an operator manually attaches (for example, with adhesive tape) the leading edge of a web to a pre-formed core before the winding operation. After the winding operation has been completed, the operator then manually attaches the trailing edge of the web to the wound web roll. Such prior-art processes are labor intensive and not suited for streaming operation.

As discussed above, webs can be non-adhesive or adhesive (in which in open adhesive is disposed on a surface of the web). For a non-adhesive web, in one embodiment, the leading edge of the web can be attached to a pre-formed core prior to the winding operation; in another embodiment, the web can be wound around a pre-formed core without attaching the leading edge to the pre-formed core. If desired, a sealing tab can also be attached to the trailing edge of the web to keep the finished wound web roll from unravelling (see FIG. 9B). Other embodiments can be used for winding adhesive webs around pre-formed cores in a streaming process.

Figures 12A, 12B, 12C, 12D:
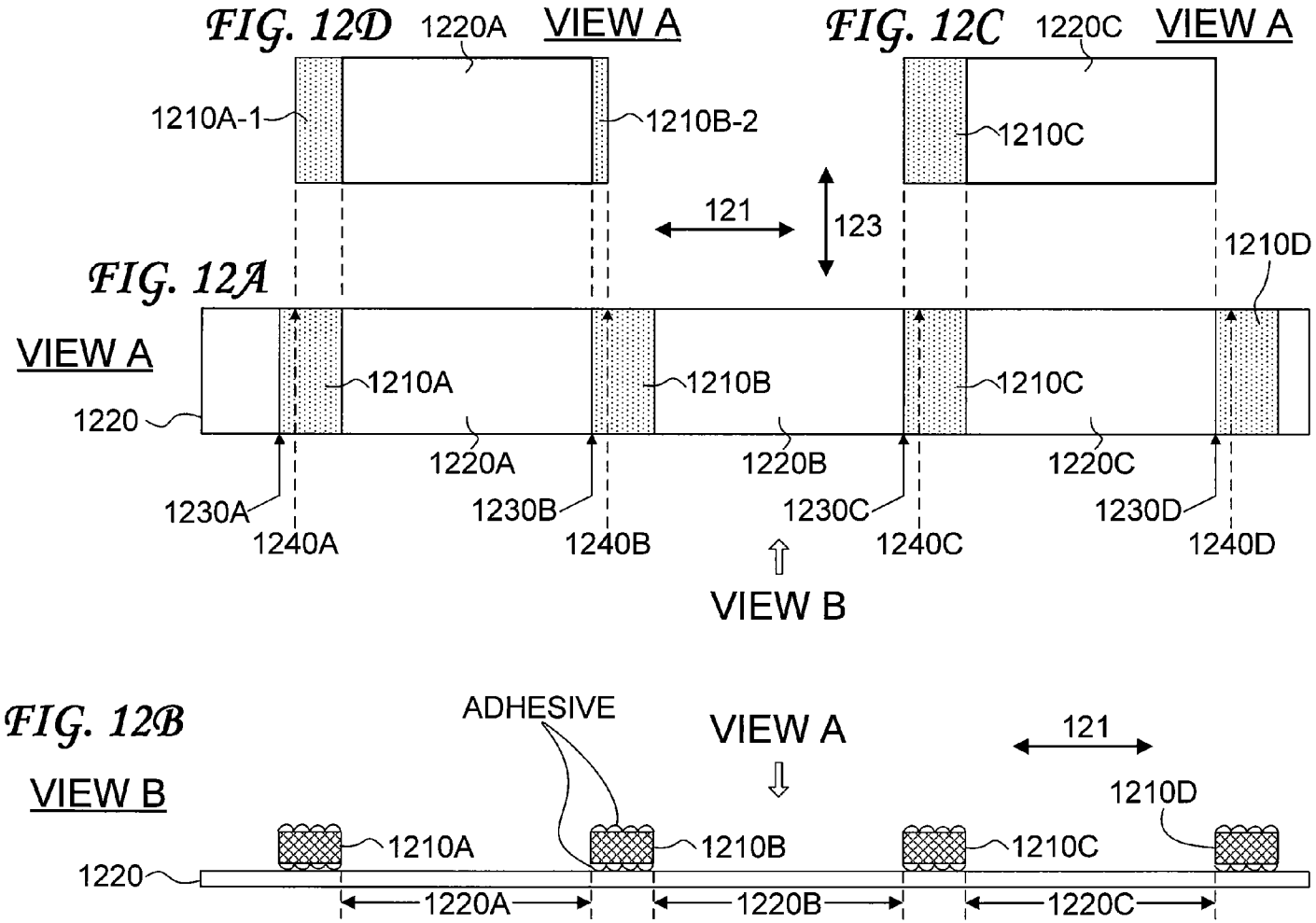
FIG. 12A-FIG. 12D show geometrical configurations of tabs attached to a web.

FIG. 12A-FIG. 12D illustrate an embodiment for preparing a non-adhesive web for streaming production of wound web rolls with pre-formed cores. FIG. 12A-FIG. 12D are similar to FIG. 4A-FIG. 4C. FIG. 12A shows a plan view (View A); FIG. 12B shows a side view (View B). In this embodiment, web 1220 is a continuous non-adhesive web. Instead of core-forming substrates, tabs are attached to the web. In the example shown, tab 1210A-tab 1210D are attached to a surface of web 1220. The segments of web 1220 between the tabs are referenced as web 1220A, web 1220B, and web 1220C. A wide range of materials can be used for tabs, including paper, plastic, and metal. In the embodiment shown, a tab is formed from double-sided adhesive tape (see FIG. 12B).

During later processing, segments are cut off. The segments can be cut off in different configurations. In a first configuration, the segments are cut off along the leading edges of the tabs, indicated by cut line 1230A-cut line 1230D. In a second configuration, the segments are cut off between the leading edge and the trailing edge of the tabs, indicated by cut line 1240A-cut line 1240D. In a third configuration (not shown), the segments are cut off along the trailing edges of the tabs.

FIG. 12C shows a representative segment according to the first configuration. Tab 1210C is attached to the leading edge of web 1220C. FIG. 12D shows a representative segment according to the second configuration. Tab 1210A-1 is attached to the leading edge of web 1220A, and tab 1210B-2 is attached to the trailing edge of web 1220A. As previously discussed, the first configuration is used if a sealing tab at the end of the wound web roll is not desired, and the second configuration (see FIG. 9B) is used if a sealing tab at the end of the wound web roll is desired (see further details below).

In the third configuration (not shown), there is no tab attached to the leading edge of a web; a tab is attached only to the trailing edge of the web. The third configuration is used for applications in which an adhesive tab is not used for attaching a web to a pre-formed core, but an adhesive tab is used to seal the finished wound web roll. An adhesive tab is not attached to the leading edge of the web if the application calls for the entire length of the web to be readily detached from the pre-formed core (the portion of the web attached to a pre-formed core is often discarded). An adhesive tab is also not attached to the leading edge of the web if the outer surface of the pre-formed core is coated with adhesive to attach the web at the start of the winding cycle.

Methods and apparatus for attaching tabs to a web are similar to those described above for attaching core-forming substrates to a web. In particular, tabs can be attached in parallel to a continuous web or in series to separate web segments; tabs can be inserted along the longitudinal axis or along the transverse axis of the web; and a tab inserter module similar to substrate inserter 604 (see FIG. 6) can be used. One skilled in the art can develop other configurations for a tab inserter module. For example, a tab inserter module can be incorporated into winder module 606 or web supplier module 602.

Following terminology similar to that used above for core-forming substrates, a sequence of tab/web/tab/web . . . is repeated. Herein, a composite tab-web stream comprises an alternating sequence of attached tab segments and web segments. Each tab segment has a leading edge and a trailing edge, and each web segment has a leading edge and a trailing edge. To simplify geometrical descriptions herein, a tab segment includes a tab and any portion of web overlapping it or inserted into it. A composite tab-web stream can be slit into multiple composite tab-web stream strips, which can be wound in parallel onto multiple pre-formed cores mounted on a single mandrel. A winder module 606 equipped with either a single turret assembly or a dual turret assembly (see FIG. 6) can be used.

FIG. 13A-FIG. 13L (View B only) show a sequence of operations for streaming production of wound web rolls on pre-formed cores. The composite tab-web stream shown previously in FIG. 12A-FIG. 12D is used as an example. Operations are described for simplex operation with reference to turret assembly 630.

Figure 13A:
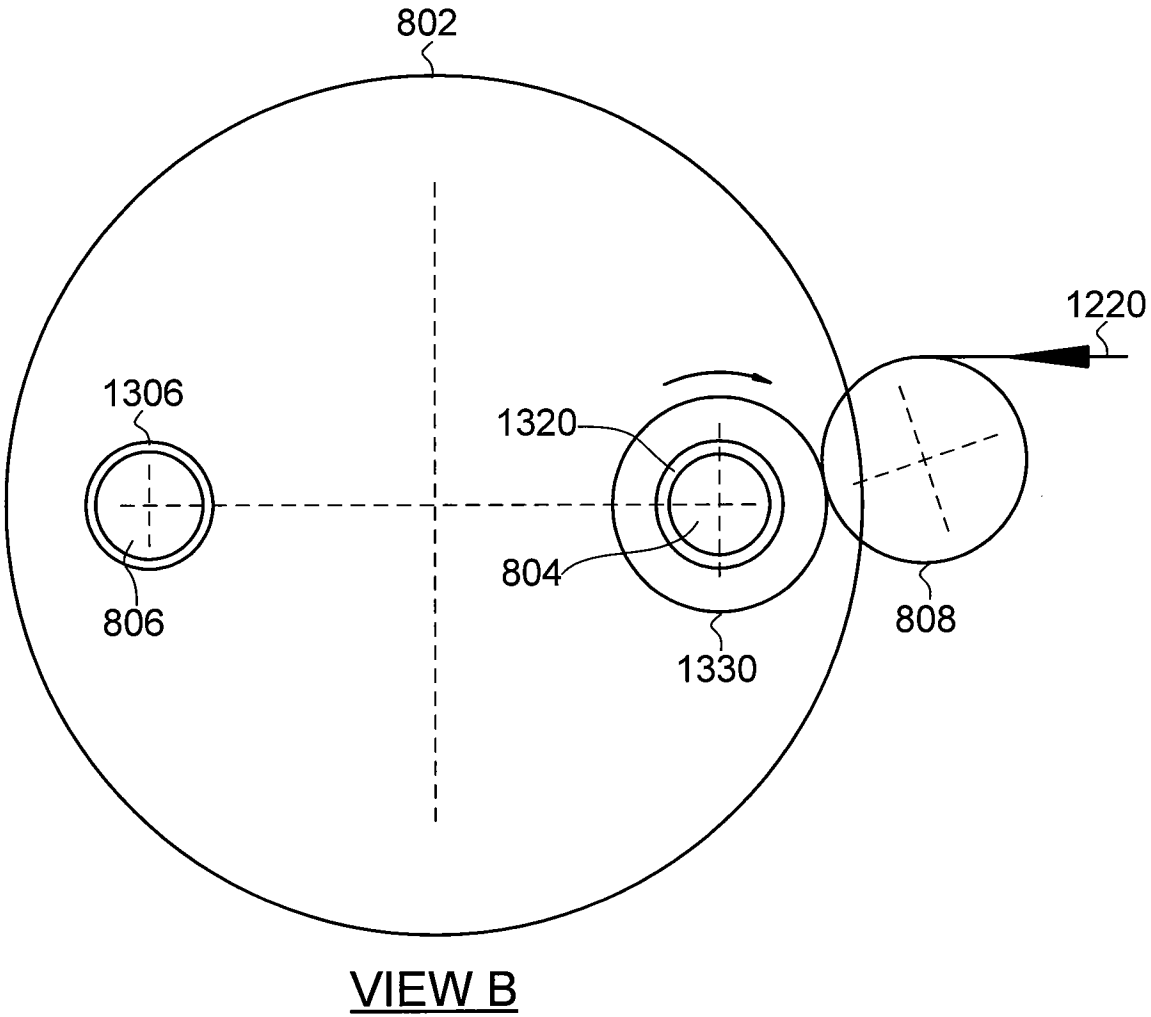
FIG. 13A-FIG. 13T show streaming processes for winding webs onto pre-formed cores.
Figure 13B:
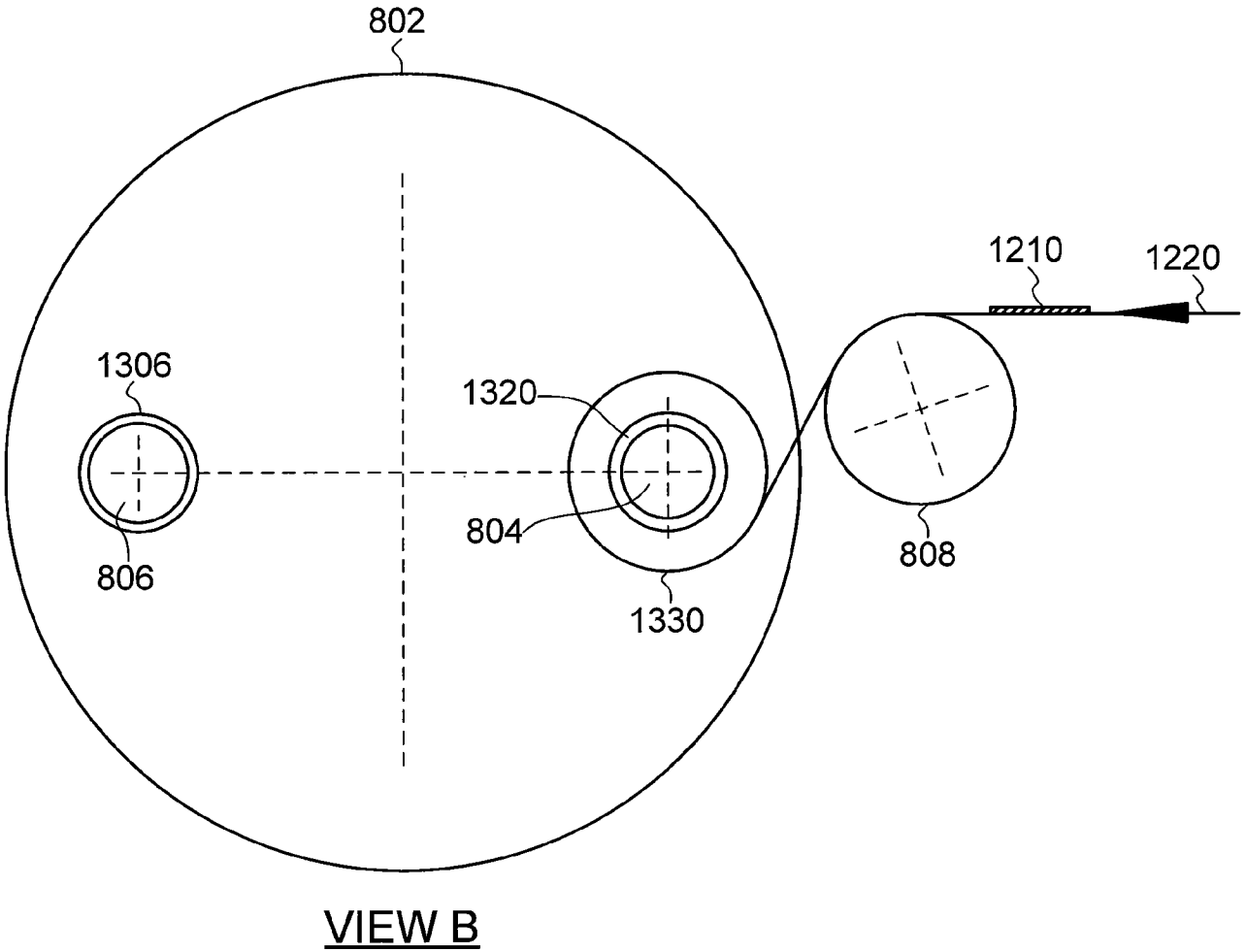
Figure 13C:
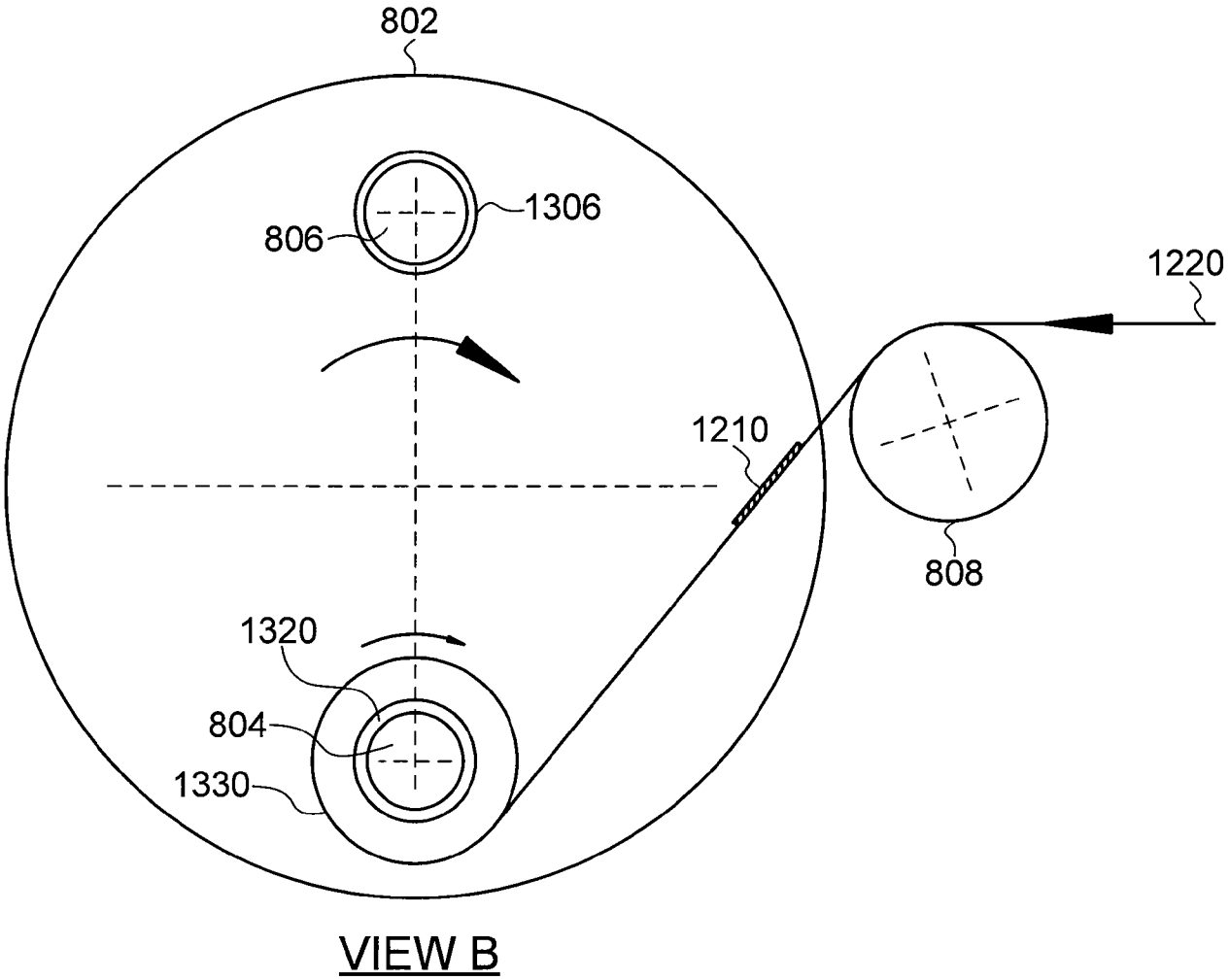
Figure 13D:
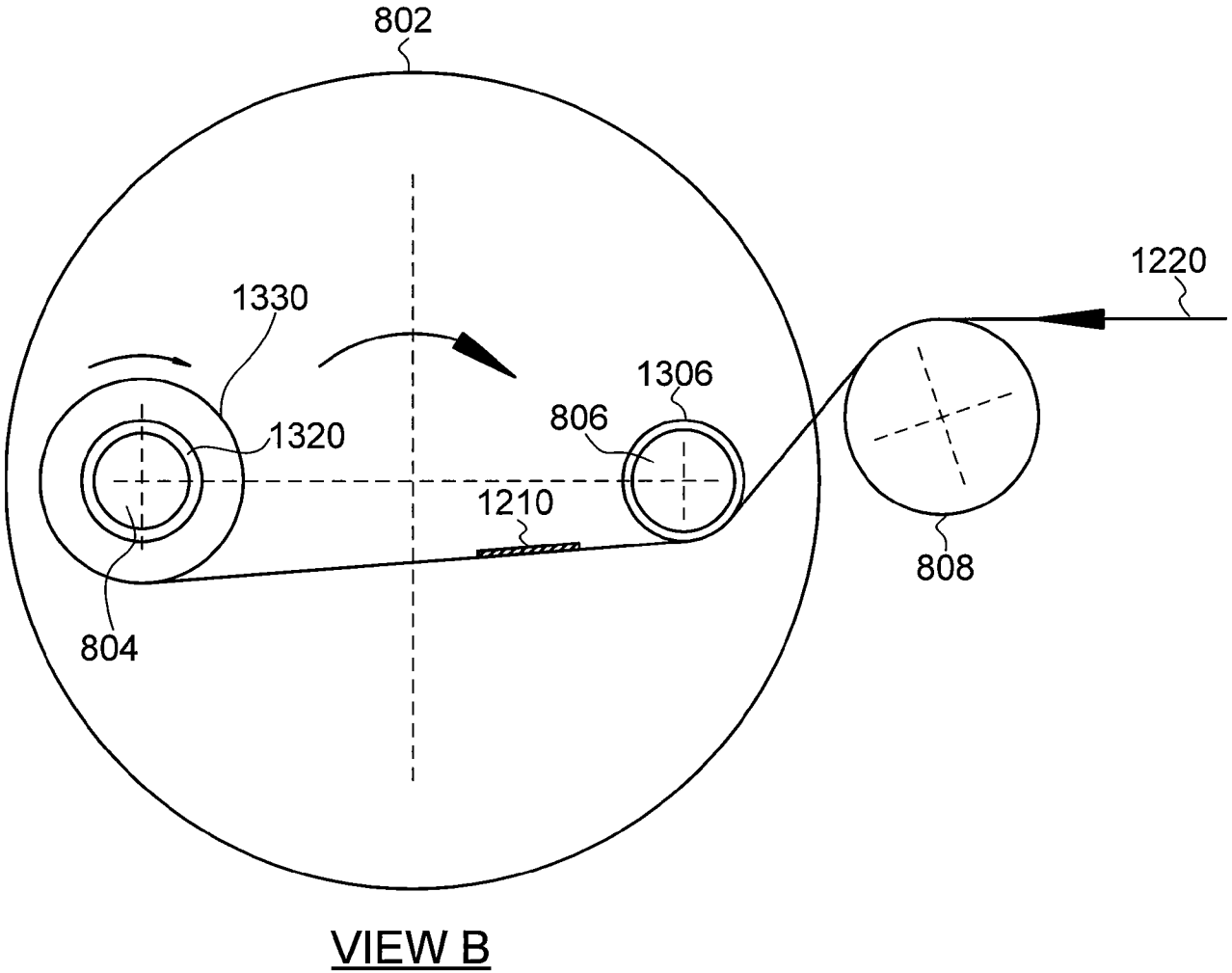

In the stage shown in FIG. 13A, pre-formed core 1306 is loaded onto mandrel 806. In general, multiple pre-formed cores can be loaded in parallel onto a single mandrel. Wound web roll 1330 has been wound onto pre-formed core 1320, which was previously loaded onto mandrel 804. Lay-on roller 808 nips web 1220 to wound web roll 1330. Web 1220 is a segment of a composite tab-web stream prepared in an upstream process. In FIG. 13B, lay-on roller 808 retracts. Tab 1210 is fed into position. In FIG. 13C, mandrel 804 rotates as turret 802 is indexing. In FIG. 13D, web 1220 advances to a cut position as turret 802 completes indexing. Note that pre-formed core 1306 does not contact tab 1210 during this sequence.

Figure 13E:
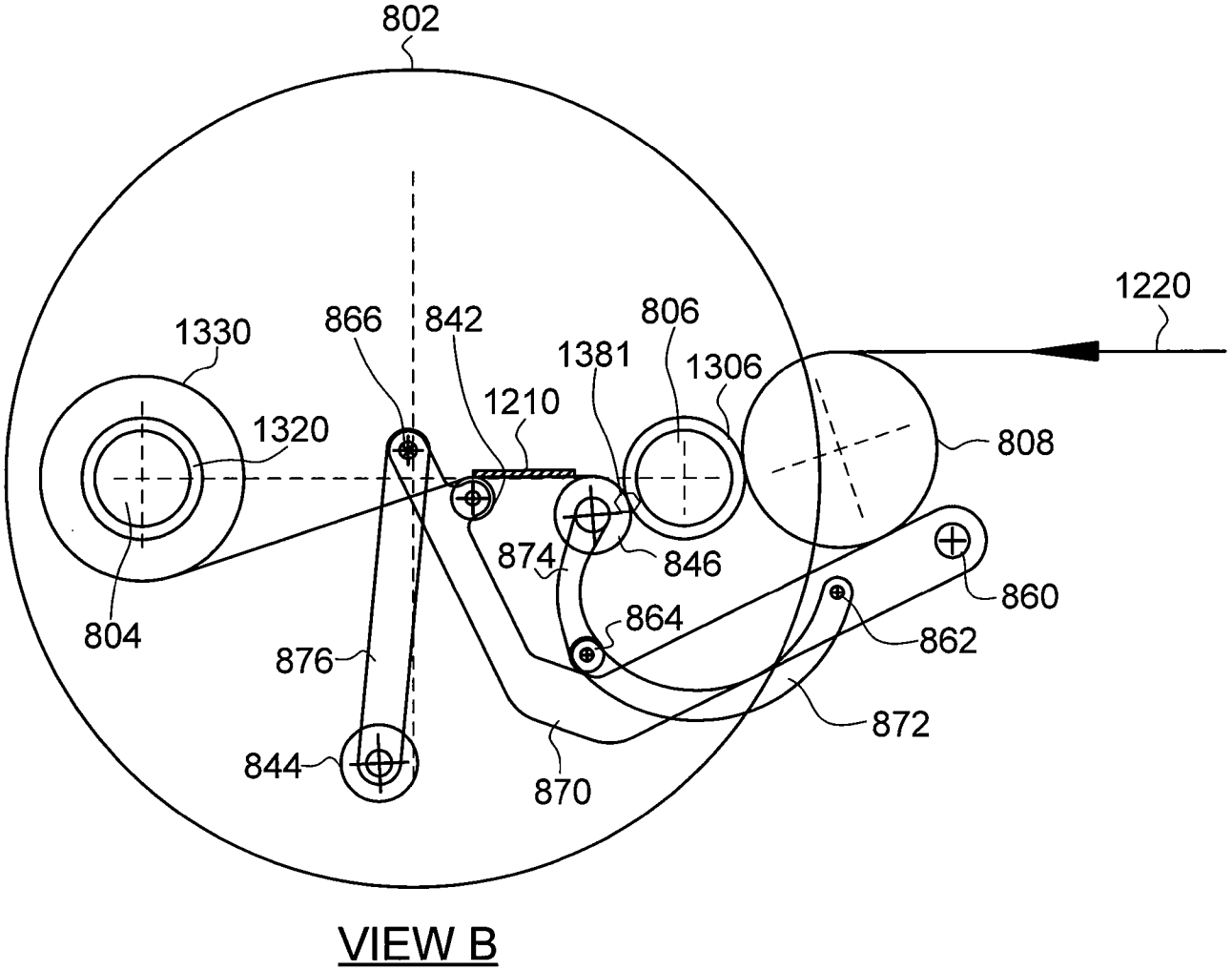
Figure 13F:
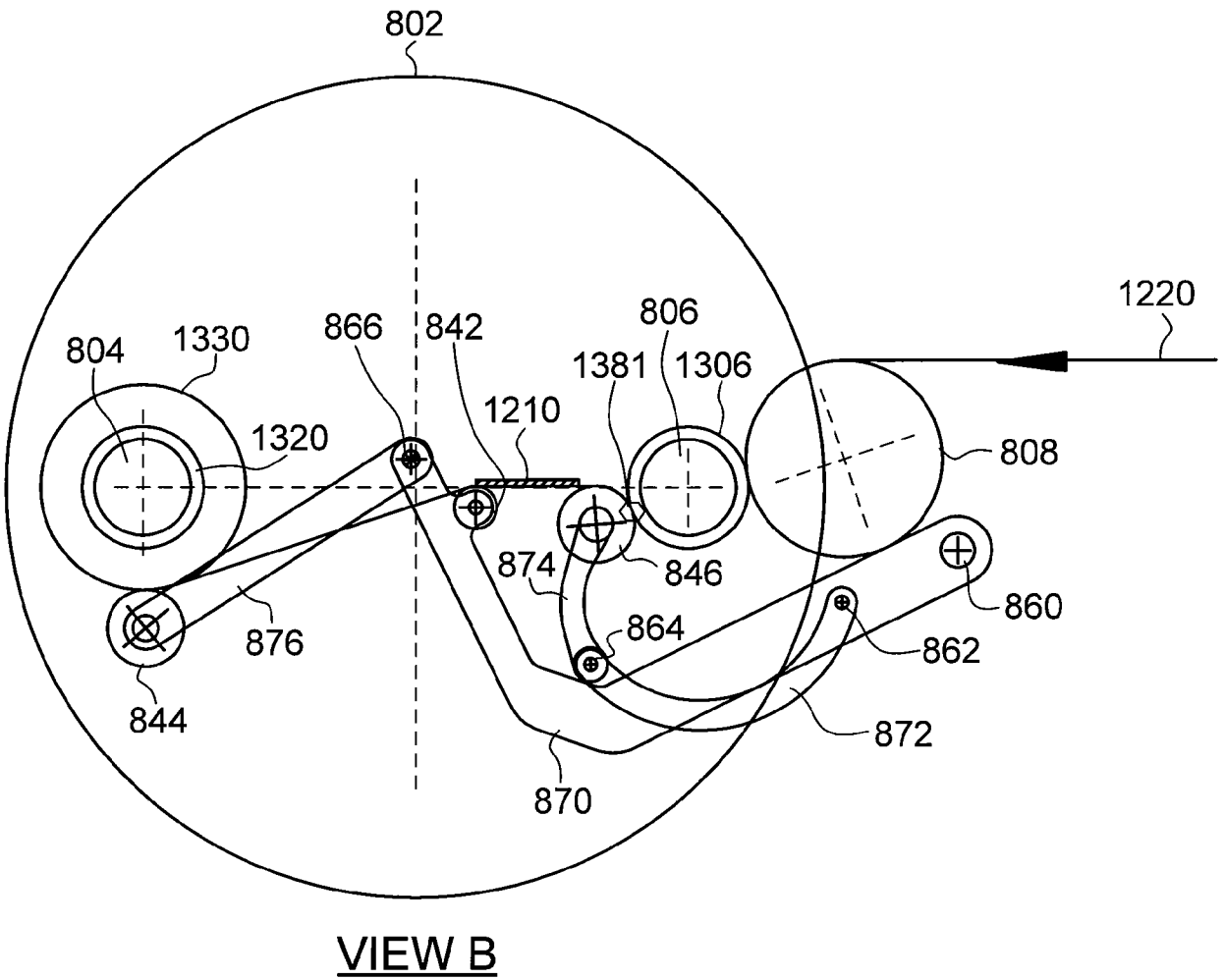
Figure 13G:
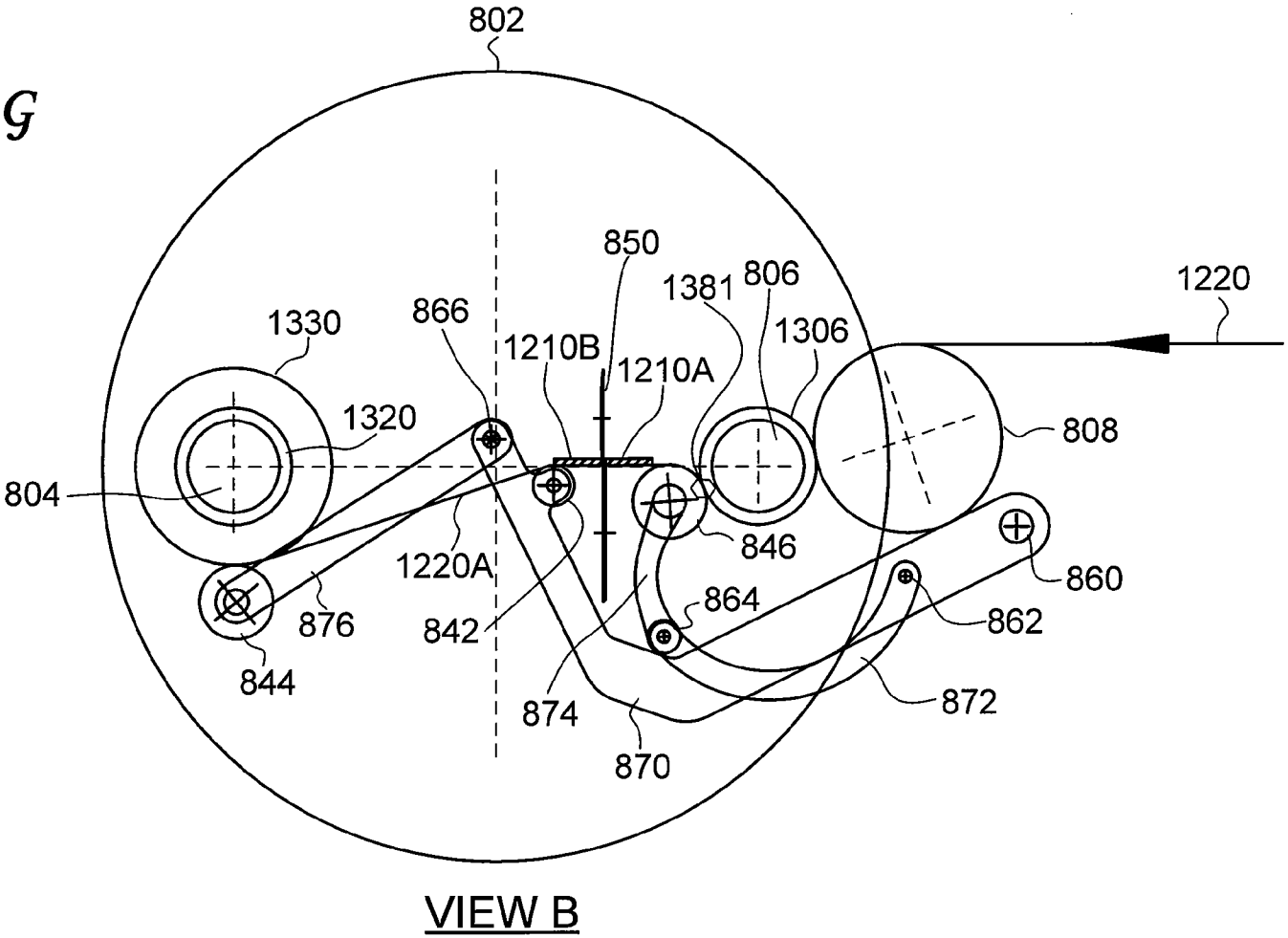
Figure 13H:
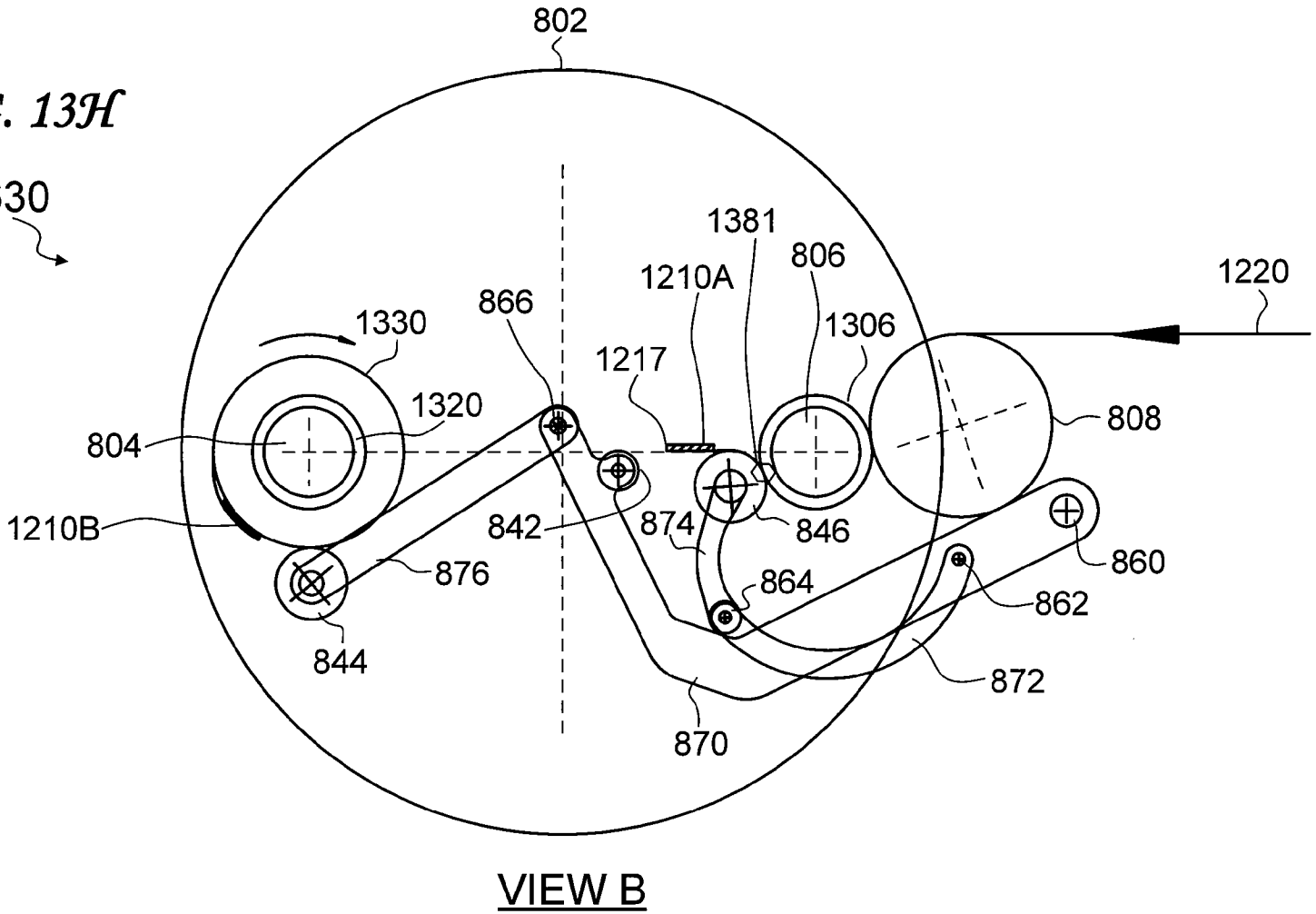

In FIG. 13E, support arm 870 is swung into operational position. Enveloper roller 846 nips web 1220 against pre-formed core 1306 at nip position 1381. Web support bar 842 establishes the desired web path for cut-off. In FIG. 13F, wipedown roller 844 nips against wound web roll 1330. In FIG. 13G, cut-off knife 850 severs tab 1210 (and the underlying web 1220) at a user-specified position. If a sealing tab is desired for wound web roll 1330, a tab segment 1210B remains attached to the trailing edge of web 1220A. If a sealing tab is not desired, cut-off knife 850 severs tab 1210 (and the underlying web 1220) at the leading edge of tab 1210 (no segment 1210B). In FIG. 13H, web 1220A and tab segment 1210B are fully wound onto wound web roll 1330. The adhesive on tab segment 1210B attaches tab segment 1210B onto the surface of previously wound web; therefore, finished wound web roll 1330 does not unravel. Tab segment 1210A now has leading edge 1217.

Figure 13I:
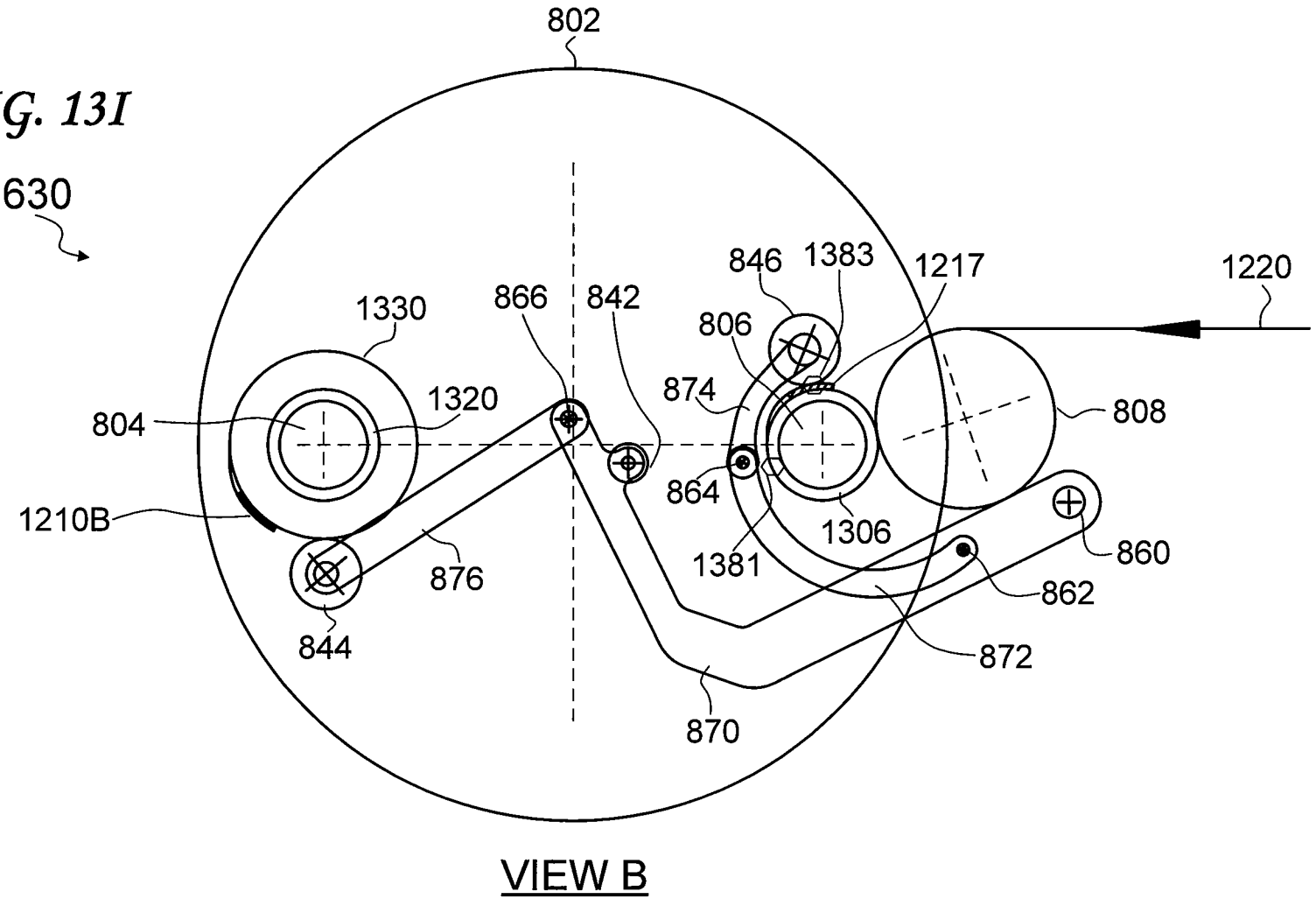
Figure 13J:
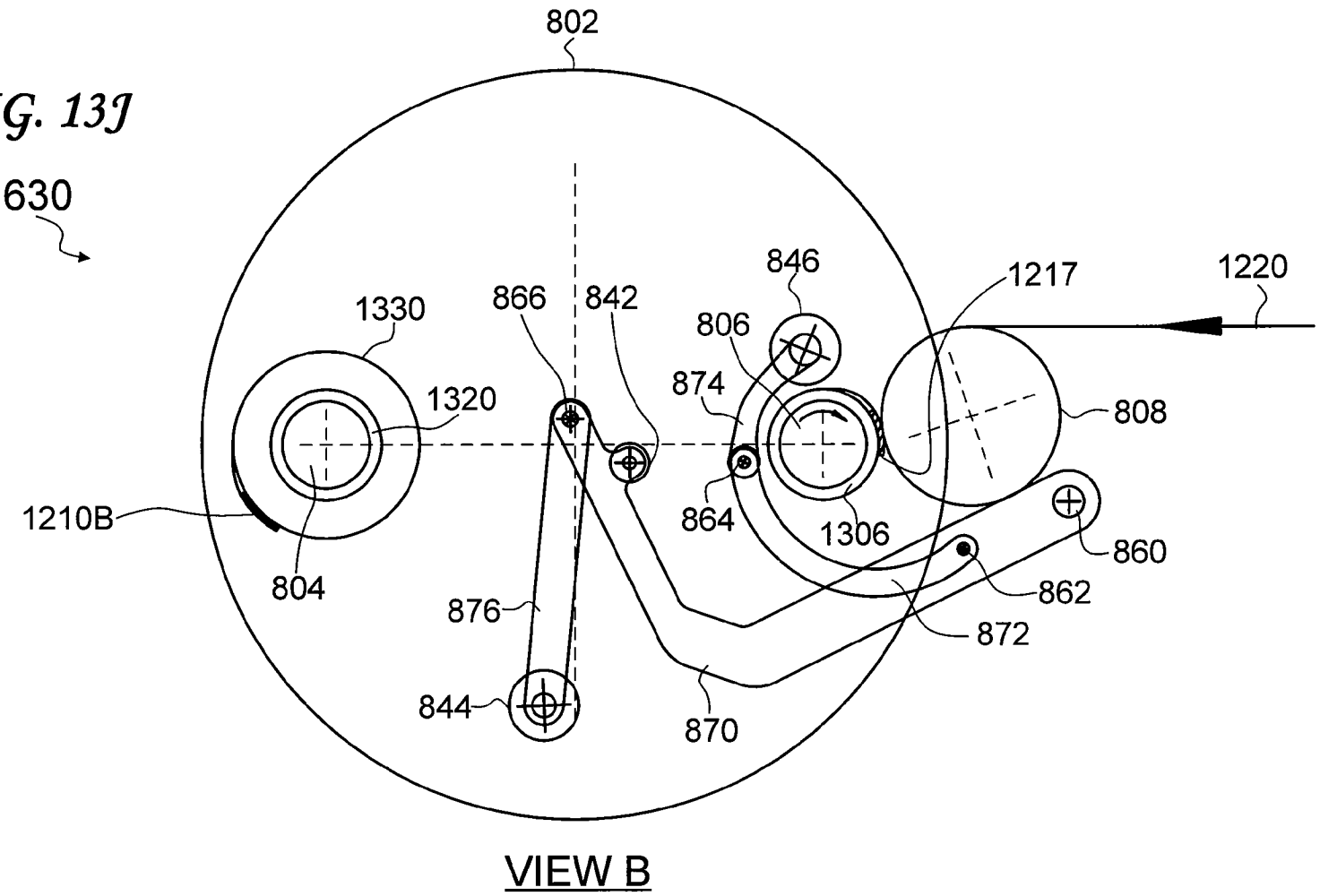

In FIG. 13I, enveloper roller 846 sweeps the web 1220 and tab segment 1210B around pre-formed core 1306. Enveloper roller 846 nips web 1220 and tab segment 1210B against pre-formed core 1306; the nip position follows the surface of pre-formed core 1306 from nip position 1381 to nip position 1383 and presses down leading edge 1217. The adhesive on tab segment 1210A attaches tab segment 1210A to pre-formed core 1306. In FIG. 13J, wipedown roller 844 and enveloper roller 846 start to retract. Mandrel 806 rotates to wind a length of web 1220 around pre-formed core 1306. Leading edge 1217 enters the nip between pre-formed core 1306 and lay-on roller 808.

Figure 13K:
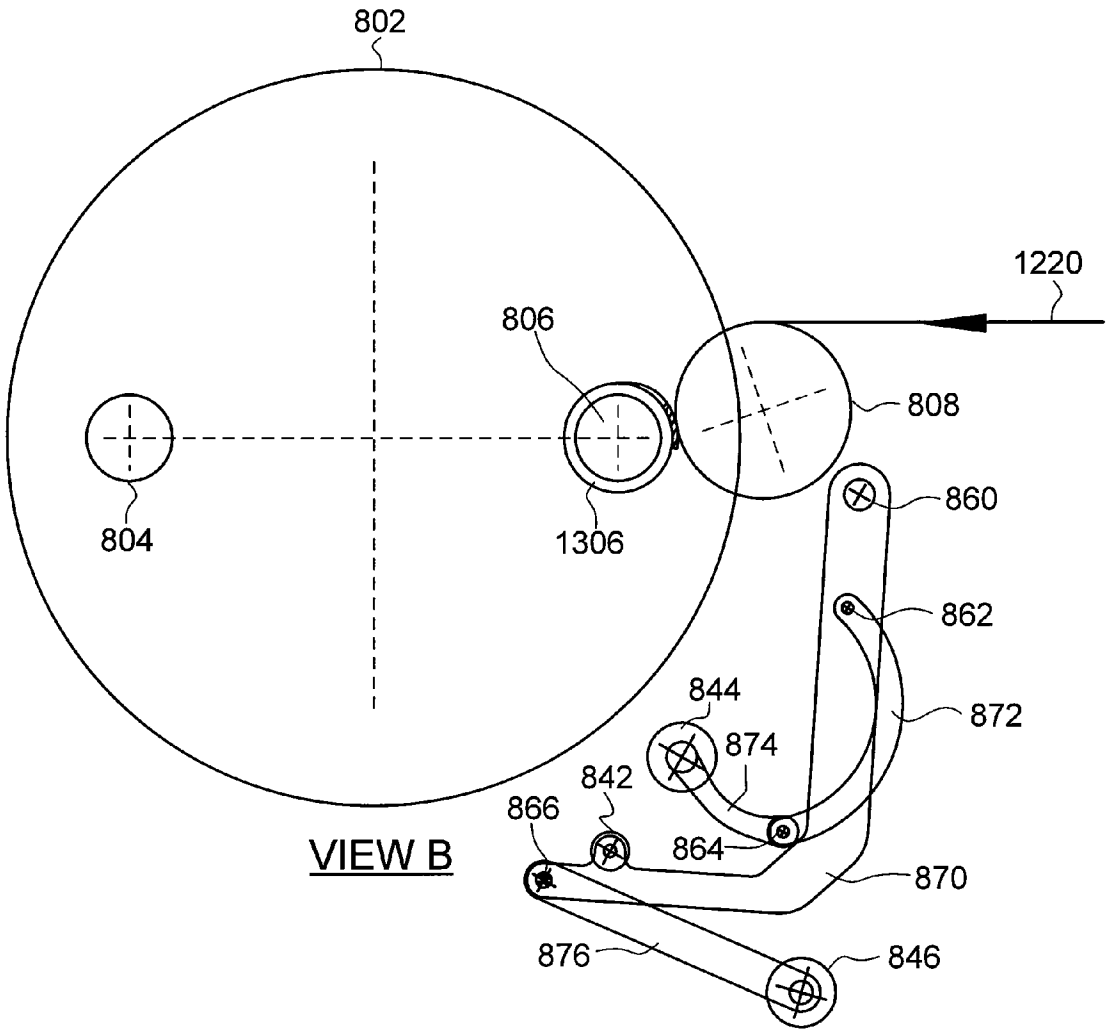
Figure 13L:
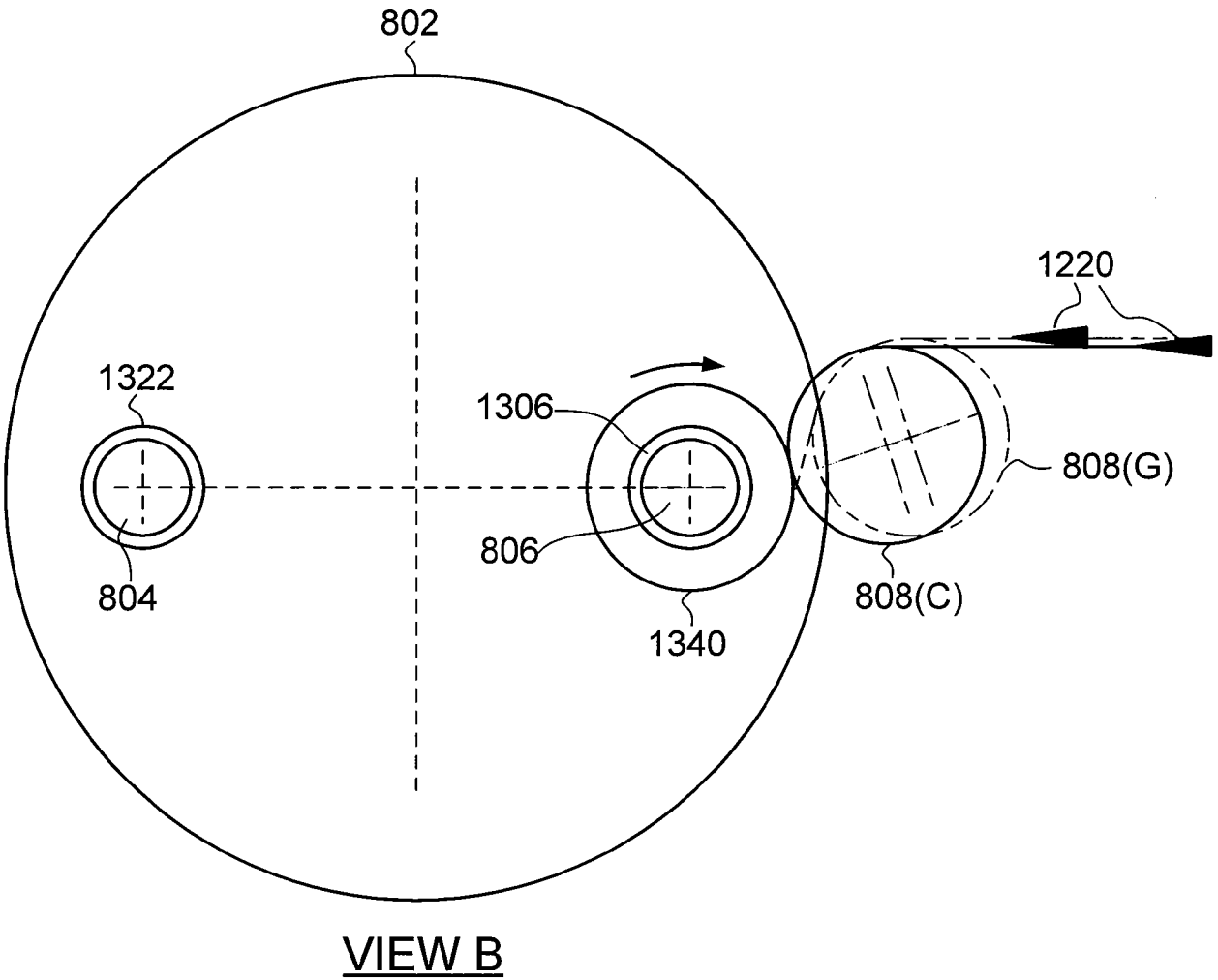

In FIG. 13K, support arm 870 retracts from the operational position, and finished wound web roll 1330 is unloaded from mandrel 804. In FIG. 13L, new pre-formed core 1322 is loaded onto mandrel 804. Mandrel 806 winds new web roll 1340 onto pre-formed core 1306. Lay-on roller 808 operates either in contact mode [shown as 808(C)] or gap mode [shown as 808(G)].

Figure 13M:
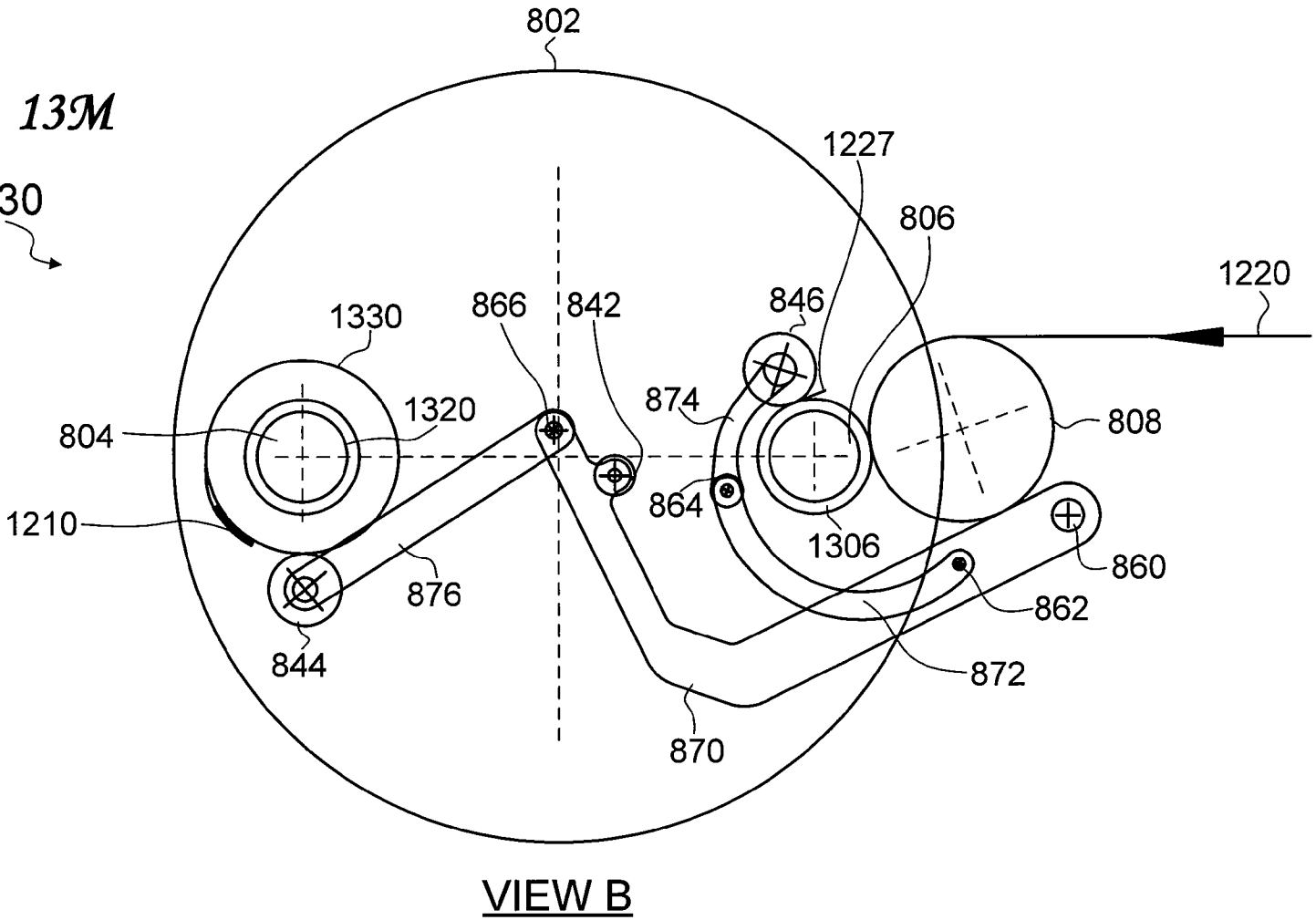

FIG. 13M-FIG. 13P (View B only) show a sequence of operations for a non-adhesive web in which the tab is used as a sealing tab on the finished wound web roll only. No tab is used to attach the leading edge of a new web onto a new pre-formed core. Refer back to FIG. 13G. In this instance, cut-off knife 850 severs web 1220 at the trailing edge of tab 1210. Refer to FIG. 13M, which corresponds to the previous stage shown in FIG. 13I. The entire tab 1210 is now used as a sealing tab for the finished wound web roll 1330. Leading edge 1227 is now the leading edge of web 1220, since there is no tab attached to the leading edge of web 1220. The enveloper roller 846 sweeps web 1220 around pre-formed core 1306.

Figure 13N:
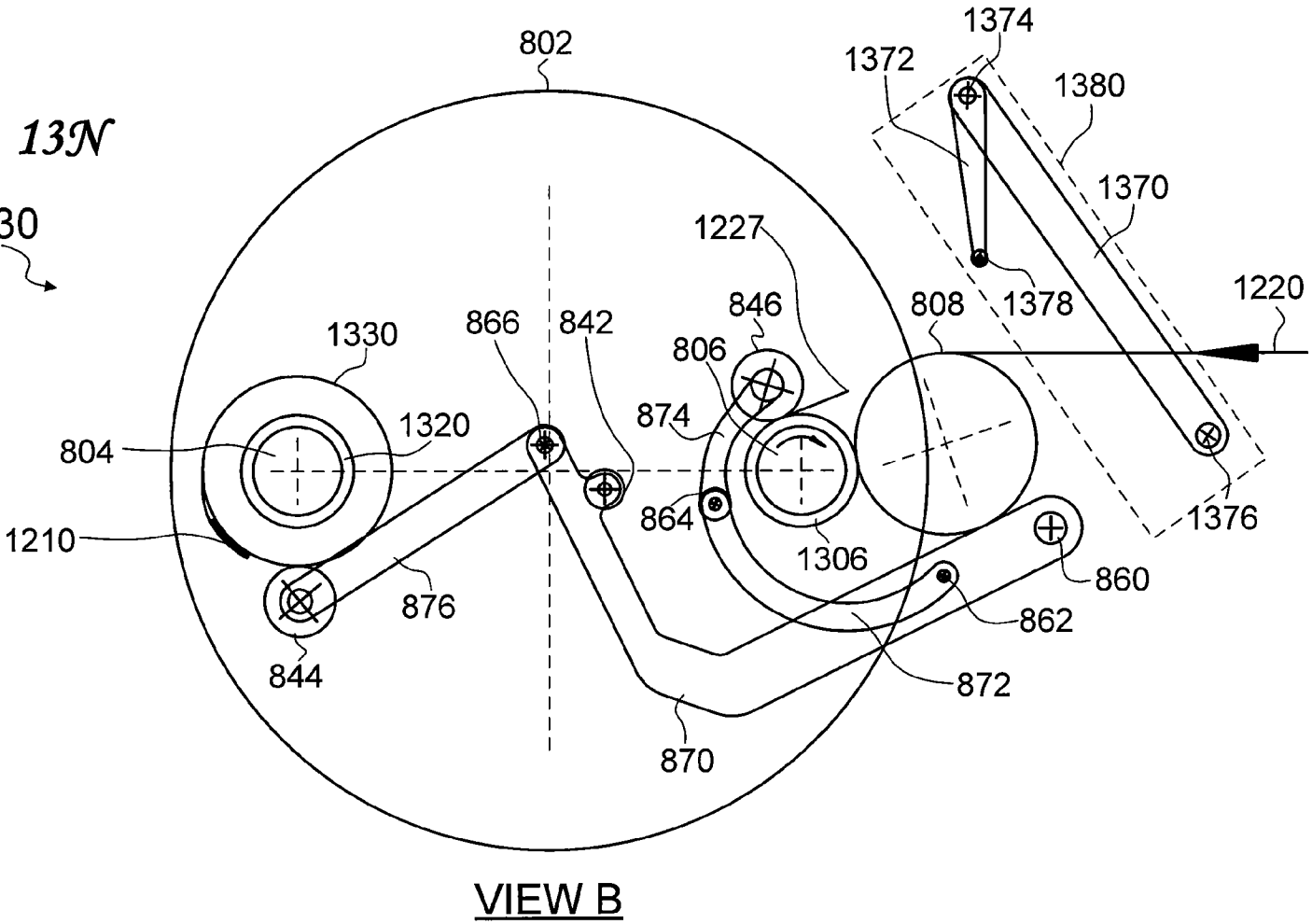

In FIG. 13N, mandrel 806 rotates to advance web 1220 to attain a desired length for tucking operation. A double-jointed tail tucker assembly 1380 is brought into operational position. The double-jointed tail tucker assembly 1380 includes support arm 1370 coupled by articulated joint 1376 to a support infrastructure (not shown), support arm 1372 coupled to support arm 1370 by articulated joint 1374, and tucker roller 1378 coupled to support arm 1372. To simplify the drawings in FIG. 13O-FIG. 13T, the dashed rectangle representing double-jointed tail tucker assembly 1380 is not shown, but the individual components are referenced. The double-jointed tail tucker assembly 1380 accommodates large diameter cores (see below). For small diameter cores, the single-jointed tail tucker 850 (see FIG. 8K) can be used.

Figure 13O:
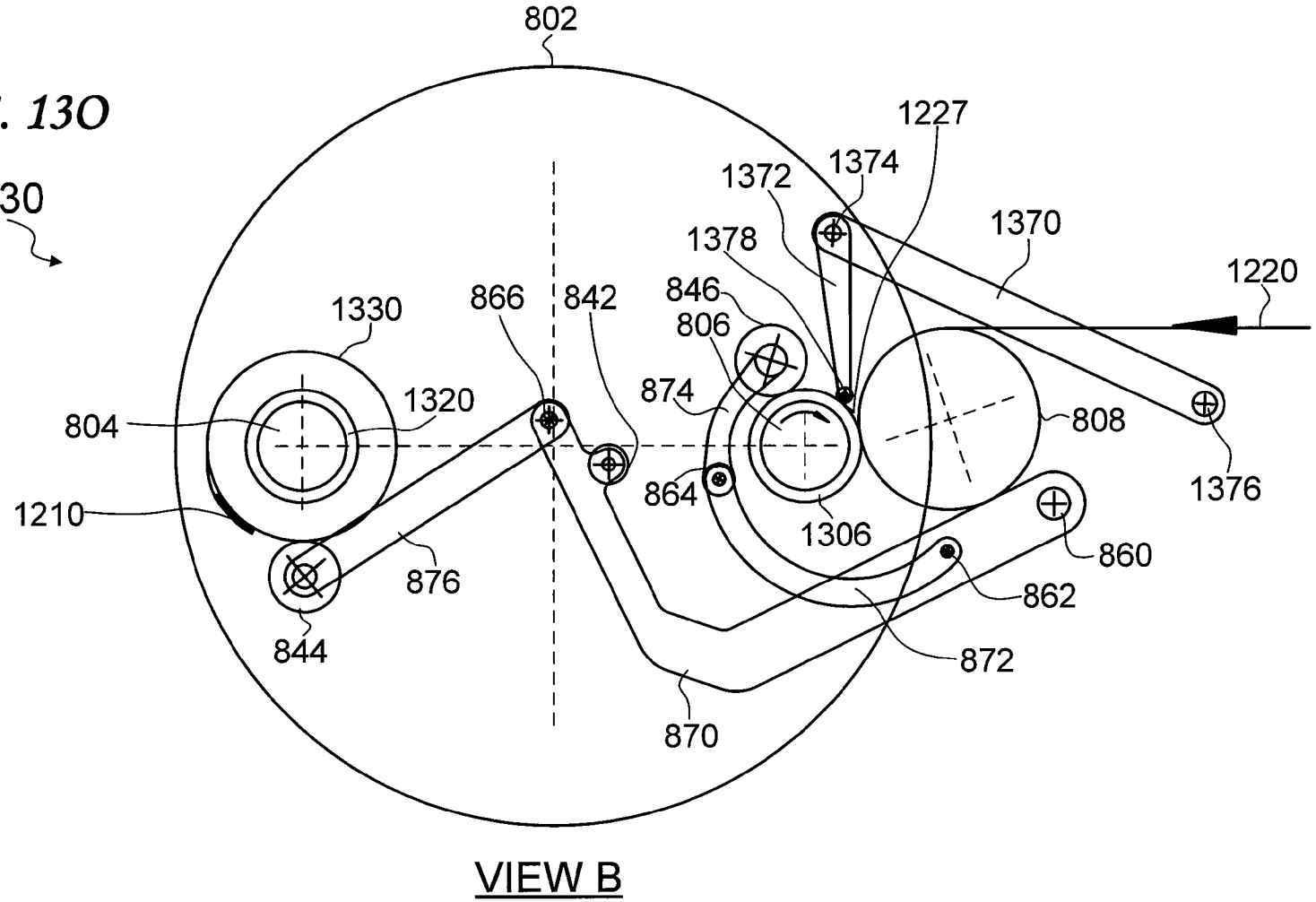
Figure 13P:
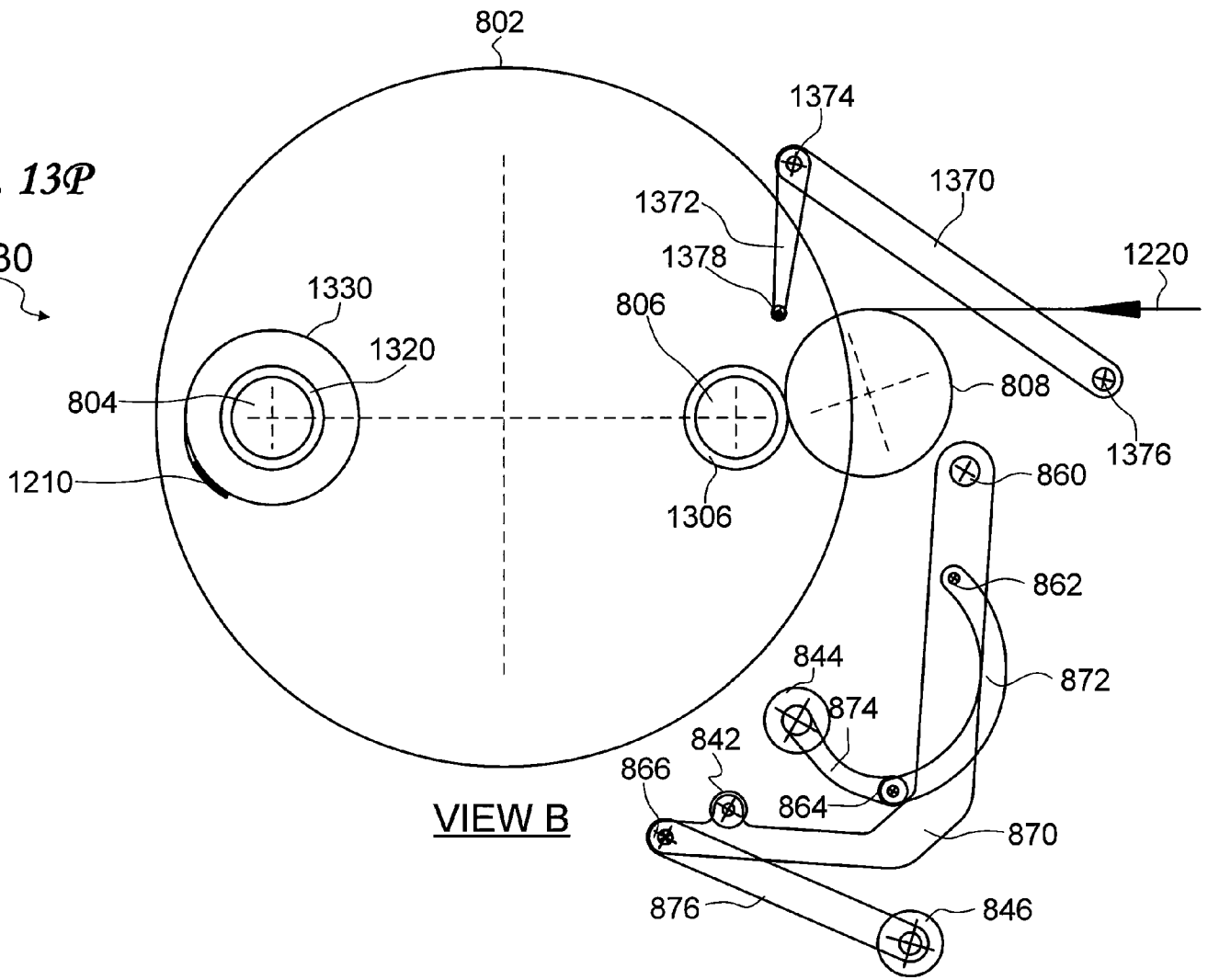
Figure 13Q:
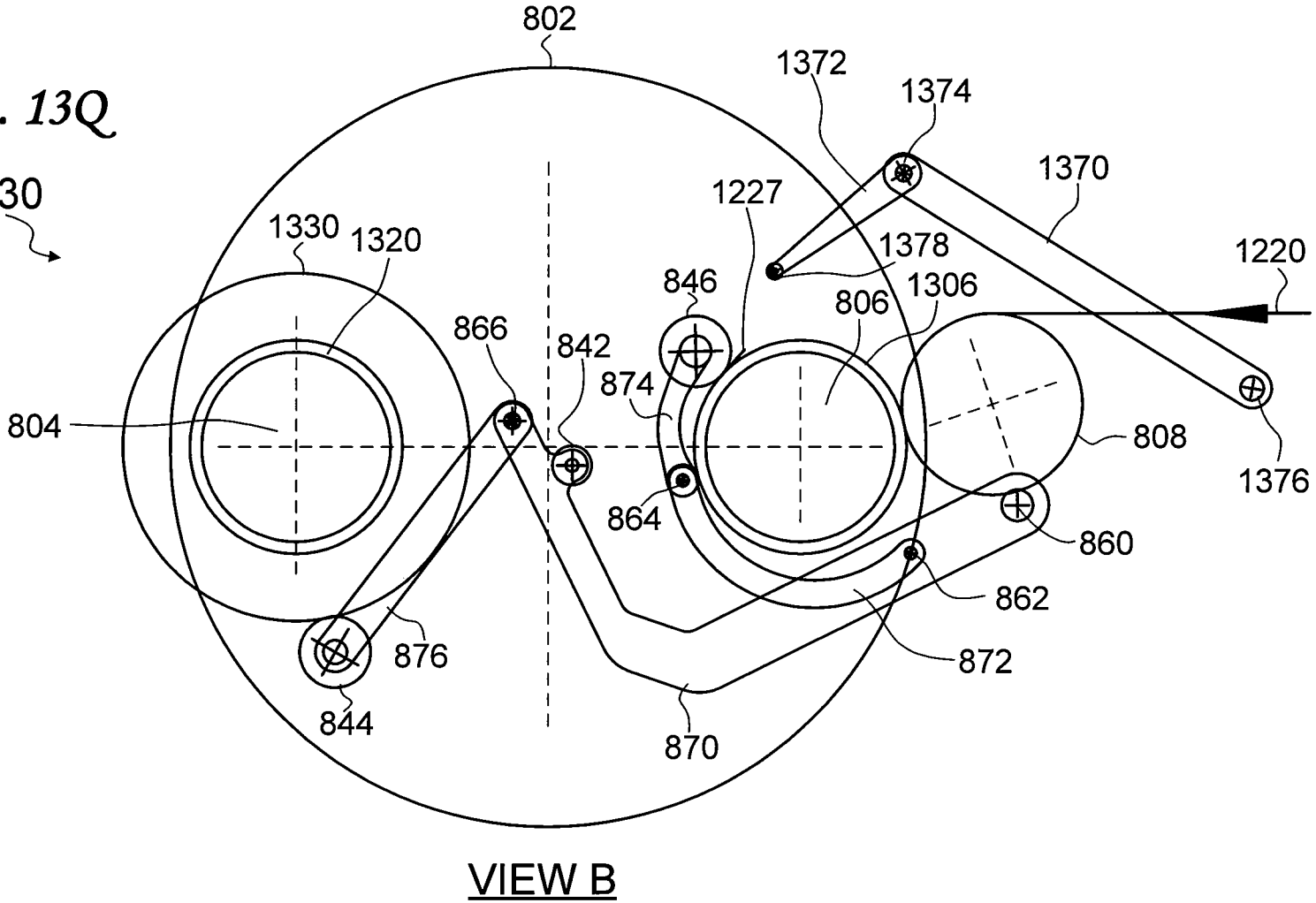

In FIG. 13O, tucker roller 1378 nips web 1220 near leading edge 1227 against pre-formed core 1306 in close proximity to lay-on roller 808. Leading edge 1227 enters the nip between pre-formed core 1306 and lay-on roller 808 to secure web 1220 to pre-formed core 1306. In FIG. 13P, support arm 870 and the double-jointed tail tucker assembly 1380 retract from the operational position. Web 1220 is wound around pre-formed core 1306 to start a new web roll.

Figure 13R:
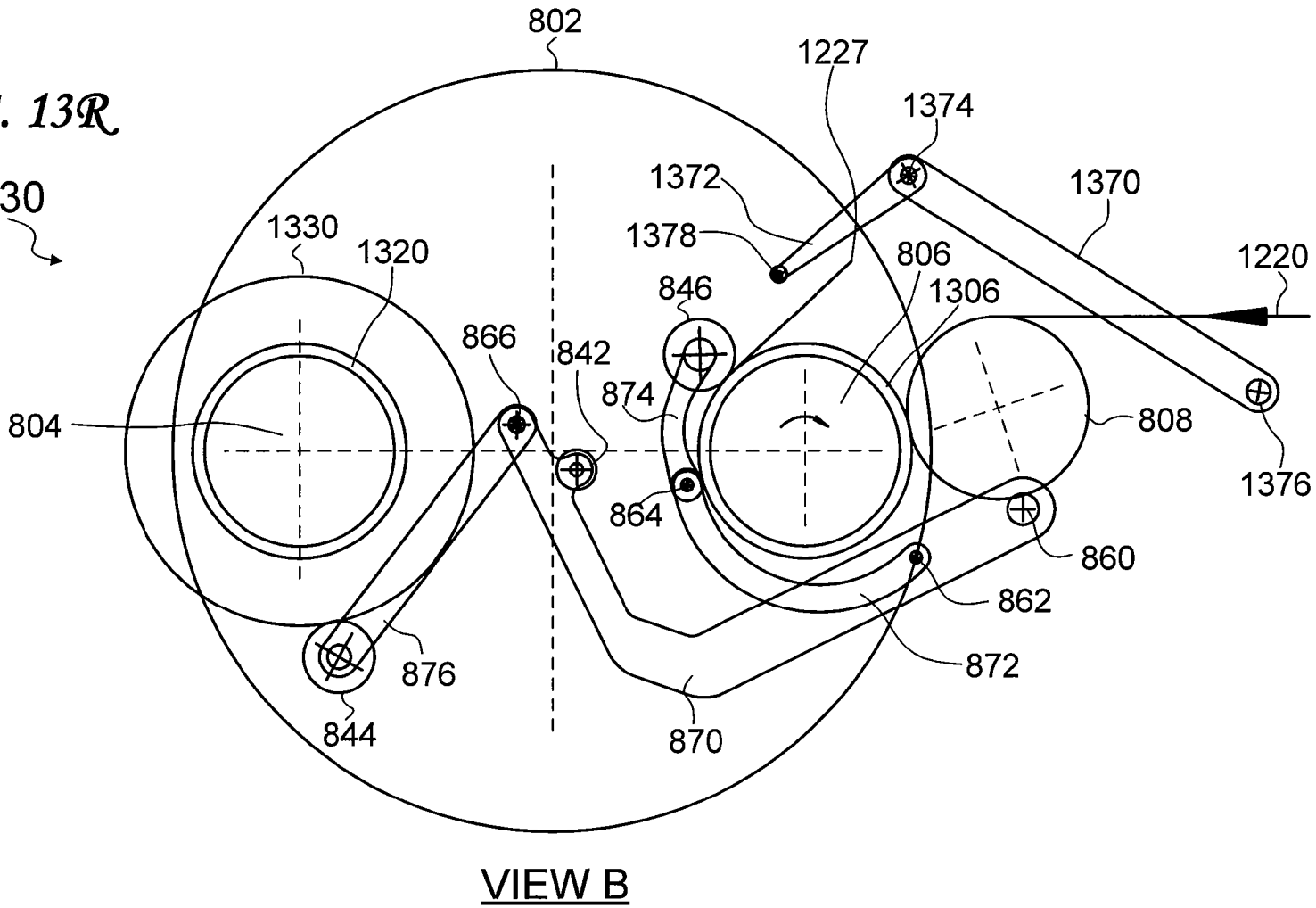
Figure 13S:
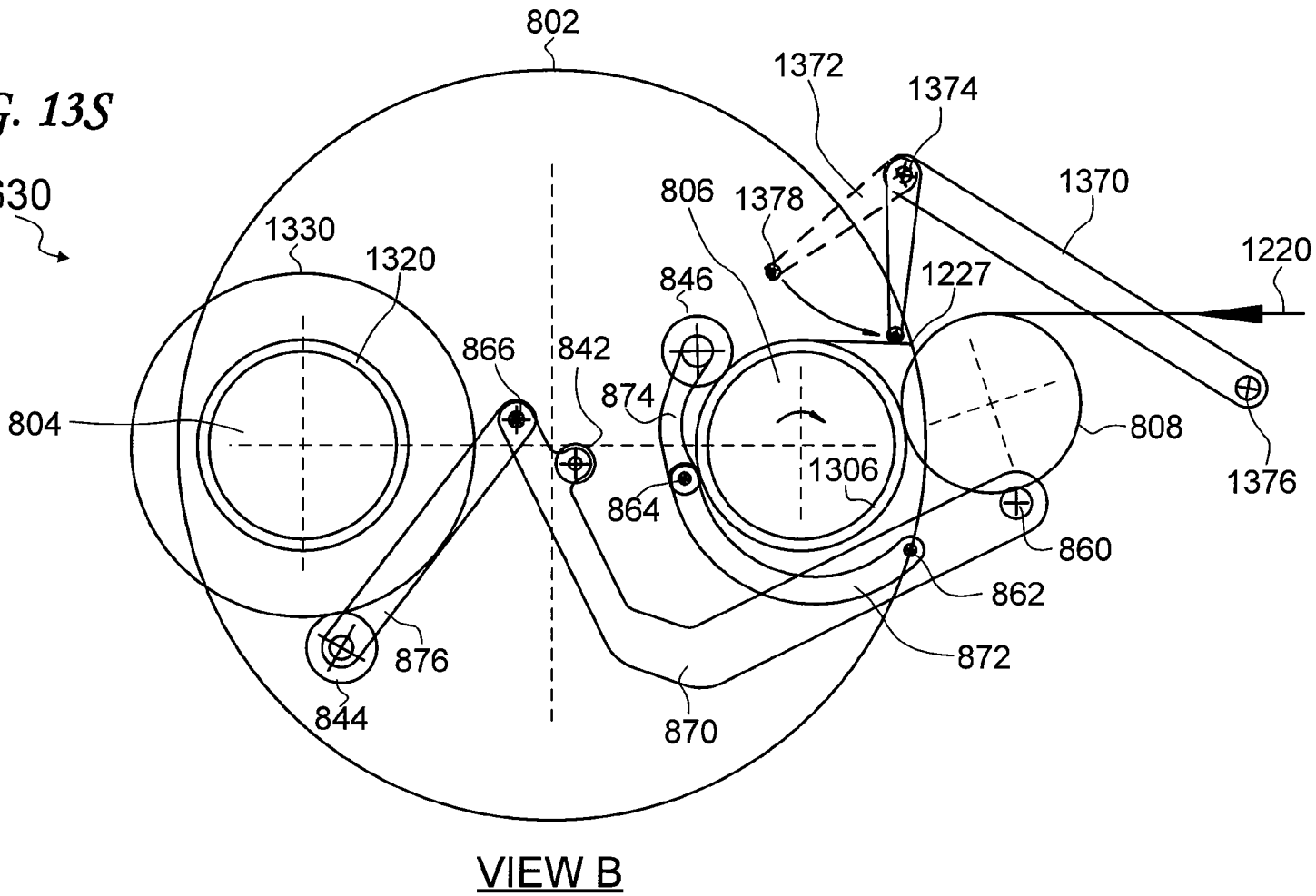
Figure 13T:
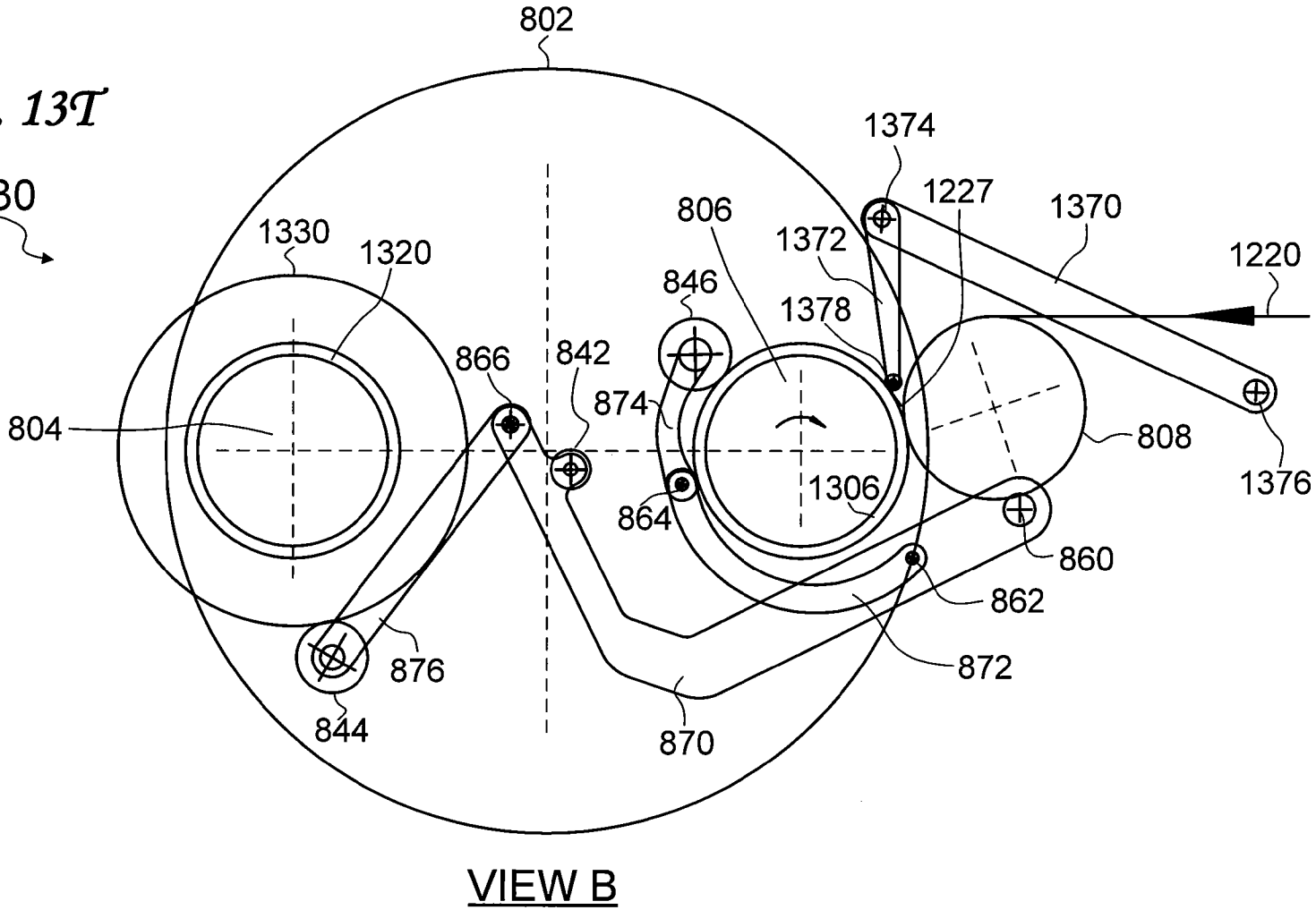

FIG. 13Q-FIG. 13T (View B only) show a sequence of operations for handling large diameter pre-formed cores. The stage in FIG. 13Q corresponds to that shown in FIG. 13N. Enveloper roller 846 sweeps web 1220 around pre-formed core 1306. The articulated joint 864 allows enveloper roller 846 to follow the contours of a large diameter pre-formed core. In FIG. 13R, mandrel 806 rotates to advance web 1220 to attain a desired length for tucking operation. In FIG. 13S, tucker roller 1378 sweeps web 1220 to a desired position for the tucking operation. In FIG. 13T, tucker roller 1378 nips web 1220 near leading edge 1227 against pre-formed core 1306 in close proximity to lay-on roller 808. Leading edge 1227 enters the nip between pre-formed core 1306 and lay-on roller 808 to secure web 1220 to pre-formed core 1306. The articulated joint 1374 allows tucker roller 1378 to descend steeply to the region near the nip between pre-formed core 1306 and lay-on roller 808. Winding operations then proceed as described above.

Other embodiments can be used for winding other web configurations. If a web is a non-adhesive web, the web can be wound around a pre-formed core without the use of tabs if a sealing tab on a finished wound web roll is not desired, and the tail tucking operation described above with reference to FIG. 13M-FIG. 13P is used to start the wind. If the web is an adhesive web (such as adhesive tape), a tab is not needed, since the web can adhere to a pre-formed core at the start of the winding operation (no tail tucking operation is needed).

As shown in FIG. 8S, enveloper assembly 880 enables enveloper roller 846 to be placed over a wide range of positions. Shown is a reference Cartesian coordinate frame with origin 801, x-axis 803, and y-axis 805. The origin 801 is placed along the longitudinal axis of a cylindrical reference surface 821 with radius r 831. The z-axis (not shown), is normal to the plane of the figure and coincident with the longitudinal axis. The cylindrical reference surface 821 can represent various physical surfaces, such as the surface of a mandrel, the surface of a core-forming substrate wound around a mandrel, the surface of a pre-formed core, and the surface of a web wound around either an in-line core or a pre-formed core. Enveloper assembly 880 can move enveloper roller 846 such that nip position 811 sweeps along cylindrical reference surface 821 over a user-specified range of polar reference angles from $\theta_1$ 841 to $\theta_2$ 843, measured about the longitudinal axis clockwise from the x-axis 803. Note that $\theta_1$ 841 can be less than 90 degrees and $\theta_2$ 843 can be greater than 180 degrees.

As discussed above, enveloper assembly 880 can be used to wind webs, core-forming substrates, tabs, composite substrate-web streams, and composite tab-web streams. Since "web" is used herein to refer to the product of interest, the term "web stream" is used herein to refer to any web material that can be wound. Web streams include webs, core-forming substrates, tabs, composite substrate-web streams, and composite tab-web streams. In general, then, enveloper assembly 880 can be used to wind web streams. To simplify the terminology, "an enveloper roller moves along a cylindrical surface" includes the instance in which the enveloper roller is disposed directly on the cylindrical surface and the instance in which a web stream is disposed on the cylindrical surface and the enveloper roller is disposed on the web stream. In the second instance, the enveloper roller nips the web stream against the cylindrical surface (such as the surface of a mandrel or a pre-formed core) and the nip position moves along the cylindrical surface.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A winding assembly for winding a web stream, the winding assembly comprising:

an enveloper assembly comprising:

a first support arm configured to be operatively coupled to a support infrastructure by a first articulated joint;

a second support arm operatively coupled to the first support arm by a second articulated joint;

a third support arm operatively coupled to the second support arm by a third articulated joint; and an enveloper roller operatively coupled to the third support arm; and a mandrel;

wherein:

the enveloper roller is movable to nip a portion of the web stream against a surface of the mandrel from a first position to a second position.

2. The winding assembly of claim 1, wherein:

the web stream comprises a core-forming substrate segment and a web segment attached to the core-forming substrate segment; and the portion of the web stream comprises a portion of the core-forming substrate segment.

3. The winding assembly of claim 2, wherein the mandrel is operable to wind the core-forming substrate segment and the web segment into a wound web roll with an in-line formed core.

4. A winding assembly for winding a web stream, the winding assembly comprising:

an enveloper assembly comprising:

a first support arm configured to be operatively coupled to a support infrastructure by a first articulated joint;

a second support arm operatively coupled to the first support arm by a second articulated joint;

a third support arm operatively coupled to the second support arm by a third articulated joint; and an enveloper roller operatively coupled to the third support arm; and a mandrel;

wherein:

the enveloper roller is movable to nip a portion of the web stream against a surface of a pre-formed core from a first position to a second position, wherein the pre-formed core is mounted on the mandrel.

5. The winding assembly of claim 4, wherein the web stream comprises an adhesive tab segment attached to a non-adhesive web segment, further comprising:

a lay-on roller operable to nip the non-adhesive web segment against the surface of the pre-formed core at a third position;

wherein:

the enveloper roller is movable to nip the adhesive tab segment and a portion of the non-adhesive web segment against the surface of the pre-formed core from the first position to the second position.

6. The winding assembly of claim 5, wherein the mandrel is operable to wind the non-adhesive web segment into a wound web roll with the pre-formed core.

7. The winding assembly of claim 4, wherein the web stream comprises a non-adhesive web segment having a leading edge, further comprising:

a lay-on roller operable to nip a portion of the non-adhesive web segment against the surface of the pre-formed core at a third position; and a tucker roller operable to nip the leading edge of the non-adhesive web segment against the surface of the pre-formed core at a fourth position in proximity to the third position;

wherein:

the enveloper roller is movable to nip the portion of the non-adhesive web segment against the surface of the pre-formed core from the first position to the second position.

8. The winding assembly of claim 7, wherein the mandrel is operable to wind the non-adhesive web segment into a wound web roll with the pre-formed core.

* * * * *